US012302947B2

(12) United States Patent
Qiu et al.

(10) Patent No.: US 12,302,947 B2
(45) Date of Patent: May 20, 2025

(54) CARTRIDGE, BATTERY DEVICE AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Sa Xiao, Jiangsu (CN); Guanyun Shi, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 920 days.

(21) Appl. No.: 17/473,983

(22) Filed: Sep. 13, 2021

(65) Prior Publication Data

US 2021/0401044 A1 Dec. 30, 2021

Related U.S. Application Data

(63) Continuation-in-part of application No. PCT/CN2020/078122, filed on Mar. 6, 2020.

(30) Foreign Application Priority Data

Mar. 13, 2019 (CN) ..... 201910190392.5
Mar. 13, 2019 (CN) ..... 201910190395.9
(Continued)

(51) Int. Cl.
*A24F 40/48* (2020.01)
*A24F 40/10* (2020.01)
(Continued)

(52) U.S. Cl.
CPC ..... *A24F 40/48* (2020.01); *A24F 40/10* (2020.01); *A24F 40/42* (2020.01); *A24F 40/485* (2020.01)

(58) Field of Classification Search
CPC ..... A24F 40/42; A24F 40/10; A24F 40/48; A24F 40/485
See application file for complete search history.

(56) References Cited

U.S. PATENT DOCUMENTS 10,397,981 B2 * 8/2019 Liu ..... A24F 40/42
2018/0049470 A1 * 2/2018 Chen ..... H05B 3/46
(Continued)

FOREIGN PATENT DOCUMENTS

CN 204763427 U 11/2015
CN 205567818 U 9/2016
(Continued)

OTHER PUBLICATIONS

The partial supplementary European search report of EP application No. 20770511.2 issued on Oct. 28, 2022.

*Primary Examiner* — Marcus E Harcum
(74) *Attorney, Agent, or Firm* — Andrew C. Cheng

(57) ABSTRACT

Disclosed are a cartridge and an electronic cigarette having the cartridge. The cartridge includes a liquid storage cavity, an atomizing cavity, a liquid suction member, a liquid outlet, a smoke outlet, and an air inlet opening. Before the cartridge is used, the liquid outlet is in a closed state, such that e-liquid in the liquid storage cavity is isolated from the liquid suction member. When the cartridge is used, the liquid outlet is in an open state, such that the e-liquid in the liquid storage cavity flows out through the liquid outlet. The atomizing cavity is provided with an opening, and the size of the heating member matches the size of the opening; and when the cartridge is used, the heating member extends into the atomizing cavity through the opening and comes into contact with the liquid suction member or stays a preset distance away from the liquid suction member.

8 Claims, 20 Drawing Sheets

(30) Foreign Application Priority Data

| | | |
|---|---|---|
| Mar. 13, 2019 | (CN) | 201910190403.X |
| Mar. 13, 2019 | (CN) | 201910190404.4 |
| Mar. 13, 2019 | (CN) | 201910190802.6 |
| Mar. 13, 2019 | (CN) | 201910190803.0 |
| Mar. 13, 2019 | (CN) | 201920317582.4 |
| Mar. 13, 2019 | (CN) | 201920318023.5 |

(51) Int. Cl.
*A24F 40/42* (2020.01)
*A24F 40/485* (2020.01)

(56) References Cited

U.S. PATENT DOCUMENTS

| | | | | |
|---|---|---|---|---|
| 2019/0029326 | A1* | 1/2019 | Qiu | A24F 40/44 |
| 2019/0159524 | A1* | 5/2019 | Qiu | A24F 40/485 |
| 2019/0191772 | A1* | 6/2019 | Qiu | A24F 40/44 |
| 2019/0208825 | A1* | 7/2019 | Qiu | A24F 40/485 |
| 2019/0307974 | A1* | 10/2019 | Qiu | A24F 40/49 |
| 2019/0328044 | A1* | 10/2019 | Qiu | A24F 40/49 |
| 2019/0350263 | A1* | 11/2019 | Qiu | A24F 40/49 |
| 2020/0069894 | A1* | 3/2020 | Qiu | A24F 40/49 |
| 2021/0235754 | A1* | 8/2021 | Yamada | A24F 40/20 |

FOREIGN PATENT DOCUMENTS

| | | | |
|---|---|---|---|
| CN | 205695704 | U | 11/2016 |
| CN | 206333374 | U | 7/2017 |
| CN | 207011680 | U | 2/2018 |
| CN | 107865462 | A | 4/2018 |
| CN | 107865463 | A | 4/2018 |
| CN | 109717519 | A | 5/2019 |
| CN | 209694060 | U | 11/2019 |
| CN | 209694061 | U | 11/2019 |
| CN | 209769000 | U | 12/2019 |
| CN | 209769001 | U | 12/2019 |
| CN | 209769002 | U | 12/2019 |
| WO | 2017124662 | A1 | 7/2017 |
| WO | 2017210898 | A1 | 12/2017 |
| WO | 2018094564 | A1 | 5/2018 |

* cited by examiner

CARTRIDGE, BATTERY DEVICE AND ELECTRONIC CIGARETTE

CROSS-REFERENCE TO RELATED APPLICATIONS

This application is a continuation-in-part of International Patent Application No. PCT/CN2020/078122, filed on Mar. 6, 2020, entitled "cartridge, battery device and electronic cigarette", which claims priority to Chinese Patent Application Nos. 201910190404.4, 201910190395.9, 201920317582.4, 201910190803.0, 201920318023.5, 201910190802.6, 201910190392.5 and 201910190403.X, filed on Mar. 13, 2019. All of the aforementioned patent applications are hereby incorporated by reference in their entireties.

TECHNICAL FIELD

The present application relates to the technical field of simulated smoking technology, and more particularly, relates to a cartridge, a battery device and an electronic cigarette.

BACKGROUND

The electronic cigarette currently on the market includes a cartridge and a battery device, usually having a heating member connected to the cartridge. In use, the heating member can be energized to work by triggering the cigarette lighting device. In the existing structure, on the one hand, the liquid suction member of the cartridge is always in contact with the e-liquid, so that the e-liquid easily leaks through the liquid suction member, or deteriorates after long-term contact with air. On the other hand, when the cartridge is replaced, it needs to be replaced together with the heating member, which makes the replacement cost high.

In addition, in use, external air enters the atomizing cavity through the air inlet opening of the cartridge, thereby bringing out the smoke formed in the atomizing cavity. The air inlet opening is in communication with the atomizing cavity and the outside environment. As a result, the condensate generated by the smoke in the atomizing cavity or the e-liquid that is not completely atomized will flow out to the outside of the electronic cigarette through the air inlet opening, which is very easy to cause leakage and pollution problems.

In addition, the liquid storage-type electronic cigarette on the market forms smoke by heating the e-liquid for the user to inhale, and is provided with a liquid storage cavity for storing the e-liquid. If the volume of the liquid storage cavity is too small, the amount of e-liquid stored cannot meet the user's smoking needs. If the volume of the liquid storage cavity is too large, the amount of stored e-liquid is too large, and the user may not be able to consume it up on the same day, so it is difficult to meet the user's needs.

In addition, in use, when the atomizing cavity configured to form smoke is cold, it will produce condensate. When the e-liquid is not completely atomized, large particles of the e-liquid will be mixed in the smoke; thus when the user inhales, the condensate and the large-particle e-liquid are easily sucked into the mouth, thereby affecting the user's taste.

The electronic cigarette currently on the market includes a cartridge and a battery device. In order to facilitate the replacement of parts, the cartridge and the battery device are usually detachably connected, a communication channel to facilitate gas circulation is often correspondingly provided at the connection interface between the cartridge and the battery device. When the cartridge is inserted backwards relative to the battery device, it will affect the normal use of the electronic cigarette, thereby reducing the user's experience.

In addition, the electronic cigarette currently on the market includes a cartridge and a battery device. When the cartridge is connected to the battery device, the heating member contacts the liquid suction member of the cartridge to atomize the e-liquid on the liquid suction member, so that the e-liquid generates smoke. However, due to certain installation and processing errors of the heating member and the liquid suction member, it is difficult to ensure that the heating member and the liquid suction member are in full contact, thereby affecting the working stability of the heating member.

In addition, when the existing electronic cigarette is working, the heating member usually heats the aerosol-forming substrate (for example, tobacco paste, e-liquid, etc.) to form smoke, and the smoke is for the user to inhale. At present, the design size of the heating member itself cannot meet the needs of the user. In particular, if the heating member is too thick, it is not conducive to heat conduction, and if the heating member is too thin, the strength is not enough to break easily.

In addition, the electronic cigarette currently on the market include a cartridge and a battery device. When in use, the heating member of the electronic cigarette can be energized by triggering the cigarette lighting device. When the cartridge and the battery device are separated, the heating member may be exposed. In this case, triggering the cigarette lighting device will make the heating member to be energized to work, it is very likely to cause scalding to the user, and especially for the children, it lacks necessary safety protection functions.

SUMMARY

Based on this, it is necessary to provide a cartridge in which the e-liquid and the liquid suction member are isolated from each other.

It is also necessary to provide an electronic cigarette with the cartridge.

The technical solution adopted by the present application to solve its technical problems is:

A cartridge for an electronic cigarette, wherein the electronic cigarette includes the cartridge and a heating member cooperating with the cartridge, the cartridge includes a liquid storage cavity, an atomizing cavity, a liquid suction member, a liquid outlet, a smoke outlet and an air inlet opening, the liquid outlet is in communication with the liquid storage cavity, the liquid suction member, the smoke outlet and the air inlet opening are all in communication with the atomizing cavity, the liquid suction member is arranged between the liquid outlet and the atomizing cavity; before the cartridge is used, the liquid outlet is in a closed state, such that e-liquid in the liquid storage cavity is isolated from the liquid suction member; when the cartridge is used, the liquid outlet is in an open state, such that the e-liquid in the liquid storage cavity flows out through the liquid outlet; the atomizing cavity has an opening, the size of the heating member matches the size of the opening; when the cartridge is used, the heating member extends into the atomizing cavity through the opening and is in contact with the liquid suction member or maintains a preset distance from the liquid suction member, the liquid suction member absorbs the e-liquid flowing out through the liquid outlet, the heating member is electrically driven to heat the e-liquid absorbed by the liquid suction member to form smoke, external air flows into the atomizing cavity through the air inlet opening under the action of suction and is mixed with the smoke and flows out through the smoke outlet.

Further, the cartridge further includes a cartridge casing and a sealing member, the liquid storage cavity and the liquid outlet are provided in the cartridge casing, the sealing member penetrates into the liquid storage cavity from the outside of the cartridge and seals the liquid outlet; when the sealing member is pulled in a direction away from the liquid storage cavity, the sealing member is separated from the liquid outlet, the liquid outlet is opened, and the liquid storage cavity supplies the e-liquid to the heating member.

Further, one end of the cartridge casing away from the liquid outlet is sealed by a sealing pad, the sealing pad is provided with a through hole, the sealing member includes an operating portion and a sealing portion, the sealing portion includes a first sealing portion and a second sealing portion connected to each other, one end of the operating portion extends to the outside of the cartridge, the other end of the operating portion extends into the liquid storage cavity and is connected to the first sealing portion, the connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected each other from the transverse cutout.

Further, when pulling the sealing member, the sealing member is deformed under the pulling force, a gap is formed between the operating portion and an inner wall of the through hole, external air enters into the liquid storage cavity through the gap; an outer wall of the first sealing portion is provided with a sealing strip protruding outward along a radial direction of the first sealing portion, the sealing strip seals the through hole when the first sealing portion is inserted into the through hole.

Further, the cartridge further includes a bottom base, a lower end of the cartridge casing extends downward along an axial direction of the cartridge casing to form a receiving portion, the bottom base is located in the receiving portion, a bottom base sealing member is provided between the bottom base and the cartridge casing, the bottom base sealing member is sleeved on the outside of an upper end of the bottom base, the liquid suction member is installed on the bottom base sealing member, the atomizing cavity and the air inlet opening are provided in the bottom base.

Further, the opening of the atomizing cavity for passage of the heating member is a lower opening, the atomizing cavity is further provided with an upper opening opposite to the lower opening, a mounting portion protrudes downward from a lower surface of the bottom base sealing member corresponding to the upper opening of the atomizing cavity, the mounting portion has a lower opening, the liquid suction member passes through the lower opening of the mounting portion and is received in the mounting portion, an upper end of the mounting portion is provided with a liquid passage hole in communicating with the liquid suction member, the liquid passage hole is also in communication with the liquid outlet when the liquid outlet is opened.

Further, the liquid suction member is installed on the mounting portion through a liquid suction member holder, the liquid suction member holder has substantially a hollow box-like structure with through holes at upper and lower ends, the liquid suction member is installed in an inner cavity of the liquid suction member holder, a plurality of bending portions capable of being bent are provided on a side wall of the liquid suction member holder around the upper through hole of the liquid suction member holder.

Further, the cartridge further includes a suction nozzle installed on one end of the cartridge casing away from the atomizing cavity, an airflow channel is provided in the cartridge casing, the liquid storage cavity and the airflow channel are isolated from each other, the smoke outlet is provided in the suction nozzle, one end of the airflow channel is in communication with the atomizing cavity, the other end of the airflow channel is in communication with the smoke outlet.

An electronic cigarette includes the cartridge as described above.

Further, the electronic cigarette further includes a battery device cooperating with the cartridge, the cartridge is detachably connected to the battery device, the heating member is provided on the battery device; when the cartridge is connected to the battery device, the heating member extends into the atomizing cavity and is in contact with the liquid suction member or maintains a preset distance from the liquid suction member.

The beneficial effects of the present application are: in the cartridge or electronic cigarette provided by the present application, on the one hand, the liquid suction member of the cartridge and the e-liquid can be isolated from each other before use, which prevents the e-liquid from leaking, and also prevents the e-liquid from deteriorating. On the other hand, when the cartridge is replaced, the heating member does not need to be replaced together, which reduces the replacement cost.

In addition, the present application also provides a cartridge that can prevent the condensate or e-liquid from contacting the sensor.

It is also necessary to provide an electronic cigarette with the cartridge.

The technical solution adopted by the present application to solve its technical problems is:

A cartridge for an electronic cigarette, wherein the electronic cigarette includes the cartridge and a battery device cooperating with the cartridge, the cartridge includes a liquid storage cavity, an atomizing cavity, a smoke outlet and an air inlet opening, the battery device includes a sensor and a heating member, the atomizing cavity and the air inlet opening are all in communication with the smoke outlet, the air inlet opening and the atomizing cavity are staggered from each other along an axial direction of the cartridge; when the cartridge is cooperated with the battery device, the air inlet opening is further in communication with a space in which the sensor is located, and the heating member extends into the atomizing cavity; when sucking, the air in the space in which the sensor is located is at least partially sucked out through the air inlet opening and the smoke outlet in sequence to cause the sensor to generate a suction signal, the heating member heats e-liquid supplied from the liquid storage cavity according to the suction signal to form smoke, and the smoke flows out through the smoke outlet.

Further, the cartridge includes a cartridge casing and a bottom base, the liquid storage cavity is provided in the cartridge casing, the bottom base is provided at one end of the cartridge casing, the atomizing cavity is provided in the bottom base; a communication groove is further provided in the bottom base, one end of the communication groove passes through a cavity wall of the atomizing cavity along a radial direction of the cartridge and is in communication with the atomizing cavity, the other end of the communication groove passes through a lower surface of the bottom base along an axial direction of the cartridge to form the air inlet opening.

Further, a partition plate is provided in the communication groove, an air passage hole is provided through the partition plate, the air passage hole is respectively in communication with the air inlet opening and the communication groove.

Further, an airflow channel is further provided in the cartridge casing, the liquid storage cavity is isolated from the airflow channel; one side of a cavity wall of the liquid storage cavity and one side of a channel wall of the airflow channel are the same wall body; a lower end of the wall body and the other sides of the cavity wall of the liquid storage cavity cooperate to form a liquid outlet, an upper end of the wall body and the other sides of the channel wall of the airflow channel cooperate to form an upper opening of the airflow channel, the lower end of the wall body and the other sides of the channel wall of the airflow channel cooperate to form a lower opening of the airflow channel, the lower end of the wall body is inclined toward the liquid storage cavity, such that an aperture size of the upper opening of the airflow channel is smaller than an aperture size of the lower opening of the airflow channel.

Further, a bottom base sealing member is further provided between the bottom base and the cartridge casing, the bottom base sealing member is sleeved on the outside of an upper end of the bottom base, an upper surface of the bottom base sealing member protrudes upward to form an air guiding portion, the air guiding portion is inserted into the airflow channel from the lower opening of the airflow channel; an air guiding groove corresponding to the air guiding portion is provided in the bottom base, one end of the air guiding groove passes through the upper surface of the bottom base along the axial direction of the cartridge and is in communication with the air guiding portion, the other end of the air guiding groove passes through the cavity wall of the atomizing cavity along the radial direction of the cartridge and is in communication with the atomizing cavity.

Further, the cartridge further includes a sealing member and a liquid suction member, the liquid suction member is in communication with the atomizing cavity, the liquid suction member is arranged between the liquid outlet and the atomizing cavity; the sealing member extends into the liquid storage cavity from the outside of the cartridge and seals the liquid outlet; when the sealing member is pulled in a direction away from the liquid storage cavity, the sealing member is separated from the liquid outlet, and the liquid outlet is opened; when the cartridge is used, the heating member extends into the atomizing cavity and is in contact with the liquid suction member or maintains a preset distance from the liquid suction member.

Further, one end of the cartridge casing away from the liquid outlet is sealed by a sealing pad, the sealing pad is provided with a through hole, the sealing member includes an operating portion and a sealing portion, the sealing portion includes a first sealing portion and a second sealing portion connected to each other; one end of the operating portion extends to the outside of the cartridge, the other end of the operating portion extends into the liquid storage cavity and is connected to the first sealing portion, the connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet, and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected each other from the transverse cutout.

Further, the cartridge further includes a suction nozzle, the suction nozzle is provided at one end of the cartridge casing away from the atomizing cavity, the smoke outlet is provided in the suction nozzle, a liquid collecting member is provided in the suction nozzle.

An electronic cigarette includes the cartridge as described above.

Further, the electronic cigarette further includes a battery device cooperating with the cartridge, the cartridge is detachably connected to the battery device; when the cartridge is connected to the battery device, the heating member extends into the atomizing cavity.

The beneficial effects of the present application are: in the cartridge or electronic cigarette provided by the present application, the air inlet opening and the atomizing cavity are staggered from each other, which can effectively prevent the condensate or e-liquid from leaking from the bottom of the atomizing cavity via the air inlet opening, and avoid pollution and liquid leakage.

In addition, the present application also provides a cartridge that is convenient for the user to suck.

It is also necessary to provide an electronic cigarette with the cartridge.

The technical solution adopted by the present application to solve its technical problems is:

A cartridge for an electronic cigarette, wherein the electronic cigarette includes the cartridge and a battery device cooperating with the cartridge, the cartridge includes a suction nozzle and a cartridge casing, the suction nozzle is installed on the cartridge casing, one end of the suction nozzle away from the cartridge casing is a suction end, the suction end is provided with a smoke outlet, a liquid storage cavity for storing e-liquid is provided in the cartridge casing, a volume of the liquid storage cavity is 0.5-3 ml, the battery device includes a battery casing; when the cartridge and the battery device are cooperated with each other, the cartridge is partially received in the battery casing, and the suction end is located outside the battery casing.

Further, the cartridge further includes a sealing member, one end of the liquid storage cavity away from the suction end is provided with a liquid outlet, one end of the sealing member is located outside the suction end, the other end of the sealing member passes through the suction end and extends into the liquid storage cavity to seal the liquid outlet; when the sealing member is pulled in a direction away from the liquid storage cavity to cause the other end of the sealing member to be separated from the liquid outlet, the liquid outlet is opened; a maximum movement distance of the other end of the sealing member is 5-50 mm when the sealing member is pulled in a direction away from the liquid storage cavity.

Further, one end of the cartridge casing away from the liquid outlet is sealed by a sealing pad, the sealing pad is provided with a through hole, the sealing member includes an operating portion and a sealing portion, the sealing portion includes a first sealing portion and a second sealing portion connected to each other, one end of the operating portion extends to the outside of the cartridge, the other end of the operating portion extends into the liquid storage cavity and is connected to the first sealing portion, the connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected each other from the transverse cutout.

Further, when pulling the sealing member, the sealing member is deformed, a gap is formed between the operating portion and an inner wall of the through hole, external air enters into the liquid storage cavity through the gap; an outer wall of the first sealing portion is provided with a sealing strip protruding outward along a radial direction of the first sealing portion, the sealing strip seals the through hole when the first sealing portion is inserted into the through hole.

Further, the cartridge further includes an atomizing cavity, a liquid suction member and an air inlet opening, the battery device further includes a heating member; the liquid suction member, the smoke outlet and the air inlet opening are all in communication with the atomizing cavity, the liquid suction member is arranged between the liquid outlet and the atomizing cavity;

before the cartridge is used, the liquid outlet is in a closed state, such that e-liquid in the liquid storage cavity is isolated from the liquid suction member;

when the cartridge is used, the liquid outlet is in an open state, such that the e-liquid in the liquid storage cavity flows out through the liquid outlet;

the atomizing cavity has an opening, the size of the heating member matches the size of the opening; when the cartridge is used, the heating member extends into the atomizing cavity through the opening and is in contact with the liquid suction member or maintains a preset distance from the liquid suction member, the liquid suction member absorbs the e-liquid flowing out through the liquid outlet, the heating member is electrically driven to heat the e-liquid absorbed by the liquid suction member to form smoke, external air flows into the atomizing cavity through the air inlet opening under the action of suction and is mixed with the smoke and flows out through the smoke outlet.

Further, the cartridge further includes a bottom base, a lower end of the cartridge casing extends downward along an axial direction of the cartridge casing to form a receiving portion, the bottom base is located in the receiving portion, a bottom base sealing member is provided between the bottom base and the cartridge casing, the bottom base sealing member is sleeved on the outside of an upper end of the bottom base, the liquid suction member is installed on the bottom base sealing member, the atomizing cavity and the air inlet opening are provided in the bottom base.

Further, the opening of the atomizing cavity for passage of the heating member is a lower opening, the atomizing cavity is further provided with an upper opening opposite to the lower opening, a mounting portion protrudes downward from a lower surface of the bottom base sealing member corresponding to the upper opening of the atomizing cavity, the mounting portion has a lower opening, the liquid suction member passes through the lower opening of the mounting portion and is received in the mounting portion, an upper end of the mounting portion is provided with a liquid passage hole in communicating with the liquid suction member, the liquid passage hole is also in communication with the liquid outlet when the liquid outlet is opened.

Further, the liquid suction member is installed on the mounting portion through a liquid suction member holder, the liquid suction member holder has substantially a hollow box-like structure with through holes at upper and lower ends, the liquid suction member is installed in an inner cavity of the liquid suction member holder, a plurality of bending portions capable of being bent are provided on a side wall of the liquid suction member holder around the upper through hole of the liquid suction member holder.

An electronic cigarette includes the cartridge as described above.

Further, the electronic cigarette further includes a battery device, the cartridge is detachably connected to the battery device; when the cartridge is connected to the battery device, the cartridge is partially received in the battery casing, and the suction end is located outside the battery casing.

The beneficial effects of the present application are: in the cartridge or electronic cigarette provided by the present application, a volume of the liquid storage cavity volume is in the range of 0.5-3 ml, which is equivalent to the number of puffs of a cigarette, and the suction end is located outside the battery casing, thereby making it convenient for the user to perform suction operation.

In addition, it is necessary to provide a cartridge that can prevent condensate or large particles of e-liquid from being inhaled.

It is also necessary to provide an electronic cigarette with the cartridge.

The technical solution adopted by the present application to solve its technical problems is:

A cartridge for an electronic cigarette, wherein the cartridge includes a suction nozzle and a cartridge casing, the suction nozzle is installed on the cartridge casing, one end of the suction nozzle away from the cartridge casing is a suction end, the suction end is provided with a smoke outlet, a liquid storage cavity and an airflow channel are provided in the cartridge casing, the liquid storage cavity is isolated from the airflow channel; one side of a cavity wall of the liquid storage cavity and one side of a channel wall of the airflow channel are the same wall body; a lower end of the wall body and the other sides of the cavity wall of the liquid storage cavity cooperate to form a liquid outlet, an upper end of the wall body and the other sides of the channel wall of the airflow channel cooperate to form an upper opening of the airflow channel, the lower end of the wall body and the other sides of the channel wall of the airflow channel cooperate to form a lower opening of the airflow channel, the lower end of the wall body is inclined toward the liquid storage cavity, such that an aperture size of the upper opening of the airflow channel is smaller than an aperture size of the lower opening of the airflow channel.

Further, the cartridge further includes an atomizing cavity and an air inlet opening, the atomizing cavity and the air inlet opening are all in communication with the smoke outlet, the air inlet opening and the atomizing cavity are staggered from each other along an axial direction of the cartridge.

Further, the cartridge includes a bottom base, the bottom base is provided at one end of the cartridge casing, the atomizing cavity is provided in the bottom base; a communication groove is further provided in the bottom base, one end of the communication groove passes through a cavity wall of the atomizing cavity along a radial direction of the cartridge and is in communication with the atomizing cavity, the other end of the communication groove passes through a lower surface of the bottom base along an axial direction of the cartridge to form the air inlet opening.

Further, a partition plate is provided in the communication groove, an air passage hole is provided through the partition plate, the air passage hole is respectively in communication with the air inlet opening and the communication groove.

Further, a bottom base sealing member is further provided between the bottom base and the cartridge casing, the bottom base sealing member is sleeved on the outside of an upper end of the bottom base, an upper surface of the bottom base sealing member protrudes upward to form an air guiding portion, the air guiding portion is inserted into the airflow channel from the lower opening of the airflow channel; an air guiding groove corresponding to the air guiding portion is provided in the bottom base, one end of the air guiding groove passes through the upper surface of the bottom base along the axial direction of the cartridge and is in communication with the air guiding portion, the other end of the air guiding groove passes through the cavity wall of the atomizing cavity along the radial direction of the cartridge and is in communication with the atomizing cavity.

Further, the cartridge further includes a sealing member and a liquid suction member, the electronic cigarette further includes a heating member, the liquid suction member is in communication with the atomizing cavity, the liquid suction member is arranged between the liquid outlet and the atomizing cavity; the sealing member extends into the liquid storage cavity from the outside of the cartridge and seals the liquid outlet; when the sealing member is pulled in a direction away from the liquid storage cavity, the sealing member is separated from the liquid outlet, and the liquid outlet is opened; when the cartridge is used, the heating member extends into the atomizing cavity and is in contact with the liquid suction member or maintains a preset distance from the liquid suction member.

Further, one end of the cartridge casing away from the liquid outlet is sealed by a sealing pad, the sealing pad is provided with a through hole, the sealing member includes an operating portion and a sealing portion, the sealing portion includes a first sealing portion and a second sealing portion connected to each other; one end of the operating portion extends to the outside of the cartridge, the other end of the operating portion extends into the liquid storage cavity and is connected to the first sealing portion, the connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet, and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected each other from the transverse cutout.

Further, when pulling the sealing member, the sealing member is deformed, a gap is formed between the operating portion and an inner wall of the through hole, external air enters into the liquid storage cavity through the gap; an outer wall of the first sealing portion is provided with a sealing strip protruding outward along a radial direction of the first sealing portion, the sealing strip seals the through hole when the first sealing portion is inserted into the through hole.

An electronic cigarette includes the cartridge as described above.

Further, the electronic cigarette further includes a battery device cooperating with the cartridge, the cartridge is detachably connected to the battery device.

The beneficial effects of the present application are: in the cartridge or electronic cigarette of the present application, the liquid storage cavity and the airflow channel share the same wall body; in addition, the wall body is inclined toward the liquid storage cavity, so that the lower opening of the airflow channel has a larger aperture size, which can effectively prevent the e-liquid from condensing. It can also prevent large particles of e-liquid from being sucked out, thereby improving the user's taste.

In addition, it is necessary to provide a cartridge and a battery device that are convenient for the user to install.

It is also necessary to provide an electronic cigarette with the cartridge and the battery device.

The technical solution adopted by the present application to solve its technical problems is:

A cartridge for an electronic cigarette, wherein the electronic cigarette includes the cartridge and a battery device cooperating with the cartridge, the cartridge includes a suction nozzle and a cartridge casing, the suction nozzle is installed on the cartridge casing, one end of the suction nozzle away from the cartridge casing is a suction end, the suction end is provided with a smoke outlet, a liquid storage cavity for storing e-liquid is provided in the cartridge casing, the cartridge casing is provided with a first positioning portion and a second positioning portion, a distance from the first positioning portion to the suction end is greater than a distance from the second positioning portion to the suction end; the battery device includes a battery casing, when the cartridge and the battery device are cooperated with each other, the cartridge is partially received in the battery casing from an open end of the battery basing, the first positioning portion and the second positioning portion resists corresponding sides of the open end of the battery basing.

Further, two opposite surfaces of the suction nozzle constitute a first positioning surface and a second positioning surface, the first positioning surface and the second positioning surface both extend along an axial direction of the cartridge from the suction end, a distance of the first positioning surface extending along the axial direction of the cartridge is greater than a distance of the second positioning surface extending along the axial direction of the cartridge, the side of the first positioning surface away from the suction end is the first positioning portion, and the side of the second positioning surface away from the suction end is the second positioning portion.

Further, a liquid storage cavity is provided in the cartridge casing, the cartridge further includes a sealing member, one end of the liquid storage cavity away from the suction end is provided with a liquid outlet, one end of the sealing member is located outside the suction end, the other end of the sealing member passes through the suction end and extends into the liquid storage cavity to seal the liquid outlet; when the sealing member is pulled in a direction away from the liquid storage cavity to cause the other end of the sealing member to be separated from the liquid outlet, the liquid outlet is opened; a maximum movement distance of the other end of the sealing member is 5-50 mm when the sealing member is pulled in a direction away from the liquid storage cavity.

Further, one end of the cartridge casing away from the liquid outlet is sealed by a sealing pad, the sealing pad is provided with a through hole, the sealing member includes an operating portion and a sealing portion, the sealing portion includes a first sealing portion and a second sealing portion connected to each other, one end of the operating portion extends to the outside of the cartridge, the other end of the operating portion extends into the liquid storage cavity and is connected to the first sealing portion, the connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected each other from the transverse cutout.

Further, when pulling the sealing member, the sealing member is deformed, a gap is formed between the operating portion and an inner wall of the through hole, external air enters into the liquid storage cavity through the gap; an outer wall of the first sealing portion is provided with a sealing strip protruding outward along a radial direction of the first sealing portion, the sealing strip seals the through hole when the first sealing portion is inserted into the through hole.

A battery device for an electronic cigarette, wherein the electronic cigarette includes the battery device and a cartridge cooperating with the battery device, the battery device includes a battery casing and a heating member, the heating member is received in the battery casing, the battery casing has a first end and an opposite second end, the second end is an open end, the open end is configured for the cartridge to be detachably inserted into the battery casing, a distance from the lowest point of the open end to an upper surface of the heating member is greater than zero, the battery casing is provided with a first limiting portion and a second limiting portion, a distance from the first limiting portion to the first end is smaller than a distance from the second limiting portion to the first end; when the cartridge and the battery device are cooperated with each other, the cartridge is partially received in the battery casing from an open end of the battery basing, the first limiting portion and the second limiting portion resists corresponding sides of the cartridge.

Further, two opposite surfaces of the battery casing constitute a first limiting surface and a second limiting surface, both the first limiting surface and the second limiting surface extend from the first end to the second end along an axial direction of the battery device, a distance of the first limiting surface extending along the axial direction of the battery device is smaller than a distance of the second limiting surface extending along the axial direction of the battery device, the side of the first limiting surface at the second end is the first limiting portion, the side of the second limiting surface at the second end is the second limiting portion.

Further, the battery device further includes a battery bracket and a bracket sealing member, the battery bracket is provided in the battery casing, the bracket sealing member is sleeved on the outside of an upper end of the battery bracket and is closely attached to an inner wall of the battery casing.

Further, a center portion of an upper surface of the bracket sealing member extends upward to form a protrusion along an axial direction of the bracket sealing member, a top of the protrusion is recessed downward to form a liquid collecting groove, the heating member is located above the liquid collecting groove.

An electronic cigarette includes the cartridge as described above and the battery device as described above, wherein when the cartridge and the battery device are installed in place, the first positioning portion resists the first limiting portion, and the second positioning portion resists the second limiting portion.

The beneficial effects of the present application are: in the cartridge or battery device or electronic cigarette provided by the present application, the suction nozzle is set as an inclined surface, the opening of the battery casing is set as an oblique opening, it can effectively prevent the cartridge and the battery device from being inserted backwards, which is convenient for the user to install.

In addition, it is necessary to provide a battery device for an electronic cigarette that can ensure that the heating member and the liquid suction member are in full contact.

It is also necessary to provide an electronic cigarette with the battery device.

The technical solution adopted by the present invention to solve its technical problems is:

A battery device for an electronic cigarette, wherein the battery device includes a battery device main body, a heating member and a conductive post, the conductive post is located at one end of the battery device main body, the conductive post is electrically connected with the battery device main body and the heating member, such that the battery device main body is able to provide electrical energy to the heating member through the conductive post; the conductive post includes a first connecting portion and a second connecting portion, the first connecting portion is fixed to the heating member, the first connecting portion is able to move away from or toward the second connecting portion under the action of an external force.

Further, the first connecting portion includes a fixing tube fixed to the heating member, the second connecting portion is fixed to the battery device main body; the second connecting portion includes an outer sleeve fixed to the battery device, the fixing tube is telescopically arranged in the outer sleeve.

Further, the conductive post further includes an elastic member and an insulating member, the elastic member and the insulating member are received in the outer sleeve, one end of the elastic member elastically resists a lower end of the outer sleeve, the other end of the elastic member elastically resists the insulating member, a lower end of fixing tube is in contact with the insulating member.

Further, the insulating member is an insulating ball.

Further, the first connecting portion further includes a claw installed in one end of the fixing tube, the claw includes a collar connected to an inner wall of the fixing tube and a clamping portion installed on one end of the collar, one end of the clamping portion opposite to the collar is bent toward a central axis of the collar.

Further, the battery device main body includes a battery casing, a battery bracket and a bracket sealing member, the battery bracket is provided in the battery casing, the bracket sealing member is sleeved on the outside of an upper end of the battery bracket, the conductive post is provided at the upper end of the battery bracket and extends into the bracket sealing member, the pin of the heating member is connected to the conductive post after passing through the bracket sealing member.

Further, the battery device main body further includes a battery, the battery is provided on the battery bracket, one pin of the heating member is electrically connected to one of a positive electrode and a negative electrode of the battery through one conductive post, another pin of the heating member is electrically connected to the other one of the positive electrode and the negative electrode of the battery through another conductive post.

Further, a center portion of an upper surface of the bracket sealing member extends upward to form a protrusion along an axial direction of the bracket sealing member, a top of the protrusion is recessed downward to form a liquid collecting groove, the heating member is located above the liquid collecting groove; a top of the liquid collecting groove is provided with two insertion holes passing through the upper and lower surfaces of the bracket sealing member; the two pins of the heating member respectively pass through the two insertion holes and are electrically connected to the corresponding conductive posts.

An electronic cigarette includes the battery device as described above.

Further, the electronic cigarette further includes a cartridge cooperating with the battery device, the cartridge includes a liquid storage cavity, a liquid outlet, a liquid suction member and an atomizing cavity, the liquid outlet is in communication with the liquid storage cavity, the liquid suction member is in communication with the atomizing cavity, the liquid suction member is arranged between the liquid outlet and the atomizing cavity; when the cartridge is connected to the battery device, the heating member extends into the atomizing cavity and is in contact with the liquid suction member or maintains a preset distance from the liquid suction member.

The beneficial effects of the present application are: in the battery device or electronic cigarette provided by the present application, the conductive post includes a first connection portion and a second connection portion, the first connecting portion is relatively fixed to the heating member, the first connecting portion can move away from or toward the second connecting portion under the action of an external force, thereby ensuring that the liquid suction member and the heating member will not be in full contact with each other due to production errors.

In addition, it is necessary to provide a battery device for an electronic cigarette with high working stability.

It is also necessary to provide an electronic cigarette with the battery device.

The technical solution adopted by the present invention to solve its technical problems is:

A battery device for an electronic cigarette, wherein the battery device includes a battery device main body, a heating member and a conductive post, the conductive post is electrically connected with the battery device main body and the heating member, such that the battery device main body is able to provide electrical energy to the heating member through the conductive post; the heating member is located at one end of the battery device main body, the heating member is in the shape of a sheet, a thickness of the heating member is in the range of 0.45-0.55 mm, a maximum width of the heating member is in the range of 1.5-4.5 mm, and a maximum length of the heating member is in the range of 2.5-13.5 mm.

Further, the heating member is provided with at least one slot, a length of the slot is 1-2 mm, and a width of the slot is 0.2-0.5 mm.

Further, both sides of the heating member are provided with through holes, the slot is located between the through holes, pins are installed in the through holes, the pin is electrically connected to the conductive post.

Further, the pin is made of a hard material.

Further, the battery device main body includes a battery casing, a battery bracket and a bracket sealing member, the battery bracket is provided in the battery casing, the bracket sealing member is sleeved on the outside of an upper end of the battery bracket, the conductive post is provided at the upper end of the battery bracket and extends into the bracket sealing member, the pin of the heating member is connected to the conductive post after passing through the bracket sealing member.

Further, the battery device main body further includes a battery, the battery is provided on the battery bracket, one pin of the heating member is electrically connected to one of a positive electrode and a negative electrode of the battery through one conductive post, another pin of the heating member is electrically connected to the other one of the positive electrode and the negative electrode of the battery through another conductive post.

Further, a center portion of an upper surface of the bracket sealing member extends upward to form a protrusion along an axial direction of the bracket sealing member, a top of the protrusion is recessed downward to form a liquid collecting groove.

Further, the heating member is located above the liquid collecting groove, a top of the liquid collecting groove is provided with two insertion holes passing through the upper and lower surfaces of the bracket sealing member; the two pins of the heating member respectively pass through the two insertion holes and are electrically connected to the corresponding conductive posts.

An electronic cigarette includes the battery device as described above.

Further, the electronic cigarette further includes a cartridge cooperating with the battery device, the cartridge includes a liquid storage cavity, a liquid outlet, a liquid suction member and an atomizing cavity, the liquid outlet is in communication with the liquid storage cavity, the liquid suction member is in communication with the atomizing cavity, the liquid suction member is arranged between the liquid outlet and the atomizing cavity; when the cartridge is connected to the battery device, the heating member extends into the atomizing cavity and is in contact with the liquid suction member or maintains a preset distance from the liquid suction member.

The beneficial effects of the present application are: in the battery device or electronic cigarette provided by the present application, the thickness of the heating member is in the range of 0.45-0.55 mm, the maximum width of the heating member is in the range of 1.5-4.5 mm, the maximum length of the heating member is in the range of 2.5-13.5 mm; it can ensure the thermal conductivity of the heating member, and it can also ensure the contact and atomization area between the heating member and the liquid suction member.

Based on this, it is necessary to provide an electronic cigarette with safety protection function.

The technical solution adopted by the present application to solve its technical problems is:

An electronic cigarette includes a cartridge and a battery device, wherein the cartridge is detachably connected to the battery device, the battery device includes a battery, a heating member, a detection assembly, a sensor and a first control board; the detection assembly is configured to generate a connection signal when the cartridge is connected to the battery device, the sensor is configured to generate a suction signal under the action of suction; only when the detection assembly generates the connection signal and also the sensor generates the suction signal, the first control board controls the battery to supply power to the heating member, such that the heating member performs atomization work.

Further, the detection assembly is configured to generate a separation signal when the cartridge is removed from the battery device, the first control board controls the heating member to clean the residue on the heating member according to the separation signal.

Further, the power of the heating member used for the atomization work is less than the power of the heating member used for cleaning the residue on the heating member.

Further, the cartridge includes a cooperating portion, the detection assembly includes a state detection circuit, the state detection circuit is configured to detect the installation state of the cartridge; when the cartridge is installed on the battery device, the state detection circuit cooperates with the cooperating portion to be in a conducting state; when the cartridge is removed from the battery device, the state detection circuit loses cooperation with the cooperating portion and is in a disconnected state; the state detection circuit generates the connection signal when it is in the conducting state, and the state detection circuit generates the separation signal when it is in the disconnected state.

Further, a switch element is provided in the state detection circuit; when the cartridge is installed on the battery device, the cooperating portion drives the switch element to turn on the state detection circuit to cause the state detection circuit to generate the connection signal, the switch element is separated from the cooperating portion and reset when the cartridge is removed from the battery device to cause the state detection circuit to generate the separation signal.

Further, the switch element includes an ejector pin and a switch button, the battery device is provided with an installation through hole for installing the ejector pin on an installation side, the ejector pin is inserted in the installation through hole; the switch button is arranged on the first control board where the state detection circuit is located and corresponds to the position of the ejector pin; when the cartridge is installed on the battery device, the cooperating portion presses the switch button to a closed position through the ejector pin; when the cartridge is removed from the battery device, the ejector pin is reset and the switch button is reset to an opened position.

Further, the battery device is further provided with a hollow cavity, the sensor is received in the hollow cavity, the cartridge includes a suction nozzle with a smoke outlet, the hollow cavity is in communication with the smoke outlet; when the cartridge is installed on the battery device, the sensor generates the suction signal when sucking through the suction nozzle.

Further, the cartridge includes a bottom base, an atomizing cavity and an air inlet opening are provided in the bottom base, a portion of a lower surface of the bottom base away from the air inlet opening forms as the cooperating portion; when the cartridge is installed on the battery device, the heating member is located in the atomizing cavity, and the air inlet opening is in communication with the hollow cavity.

Further, the cartridge further includes a cartridge casing, the battery device includes a battery bracket and a bracket sealing member, the battery bracket is provided in the battery casing, the bracket sealing member is sleeved on the outside of an upper end of the battery bracket and is closely attached to an inner wall of the battery casing; the bracket sealing member divides an inner cavity of the battery casing into an accommodating cavity and a mounting cavity; the heating member is located in the accommodating cavity, when the cartridge is installed on the battery device, the cartridge is partially received in the accommodating cavity.

Further, the battery bracket is provided with a sensing channel, the sensing channel is in communication with the hollow cavity and the air inlet opening, the bracket sealing member is provided with an air inlet aperture, an air vent hole is provided in a side wall of the battery casing, the air inlet aperture is in communication with the air vent hole and the air inlet opening.

The beneficial effects of the present application are: in the electronic cigarette of the present application, only when the detection assembly generates a connection signal and the sensor generates a suction signal, the first control board controls the battery to supply power to the heating member, which can play a safety protection function for children.

Figure 1:
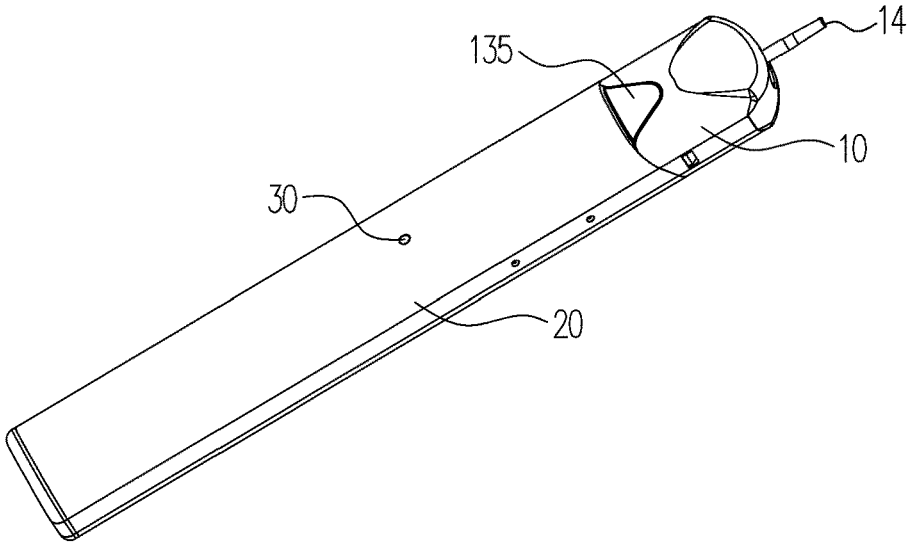
FIG. 1 is a perspective view of an electronic cigarette according to one embodiment of the present application.

| | |
|---|---|
| cartridge 10 | battery device 20 |
| sealing member 14 | smoke outlet 131 |
| suction nozzle 13 | cartridge casing 16 |
| sealing pad 162 | liquid suction member 17 |
| liquid suction member holder 18 | bottom base 15 |
| atomizing cavity 151 | air inlet opening 152 |
| cooperating portion 153 | liquid storage cavity 19 |
| airflow channel 165 | through hole 163 |
| liquid outlet 191 | bending portion 181 |
| operating portion 141 | first sealing portion 142 |
| second sealing portion 143 | transverse cutout 145 |
| sealing strip 1421 | heating member 21 |
| bottom base sealing member 161 | mounting portion 166 |
| liquid passage hole 167 | recessed groove 1611 |
| inserting portion 160 | air guiding portion 168 |
| air guiding groove 157 | communication groove 155 |
| air inlet opening 152 | partition plate 156 |
| air passage hole 1561 | groove 169 |
| liquid collecting member 164 | first communication tube 132 |
| second communication tube 133 | third communication tube 134 |
| reinforcing rib 136 | guiding groove 1621 |
| installation groove 1622 | locking protrusion 1601 |
| locking groove 1301 | cutout 135 |
| conductive post 231 | detection assembly 25 |
| battery casing 24 | battery bracket 23 |
| bracket sealing member 22 | battery 233 |
| first control board 29 | accommodating cavity 242 |
| mounting cavity 243 | pin 211 |
| latching buckle 241 | latching groove 11 |
| sliding groove 1612 | switch element 653 |
| ejector pin 651 | switch button 652 |
| hollow cavity 61 | sensor sealing member 26 |
| sensor 66 | protrusion 226 |
| liquid collecting groove 2211 | insertion hole 224 |
| air inlet aperture 221 | first air vent hole 245 |
| sensing tube 2212 | sensing channel 2213 |

-continued

| | |
|---|---|
| slot 212 | outer sleeve 2311 |
| elastic member 2312 | insulating member 2313 |
| fixing tube 2314 | claw 2315 |
| collar 2317 | clamping portion 2318 |
| second control board 235 | connecting post 281 |
| contacting electrode 282 | charging base 40 |
| electronic cigarette insertion slot 411 | charging post 412 |
| operating switch 27 | indicator 30 |
| support cover 232 | first cavity 253 |
| second cavity 254 | first sensor 251 |
| second sensor 252 | first portion 261 |
| second portion 262 | air inlet hole 222 |
| cooperating hole 223 | second air vent hole 236 |
| first receiving groove 237 | second receiving groove 238 |
| communication portion 239 | partition portion 229 |
| deformation portion 225 | communication hole 230 |

DETAILED DESCRIPTION OF PREFERRED EMBODIMENTS

The application will now be described in detail in conjunction with the accompanying drawings. These drawings are simplified schematic diagrams, which only schematically illustrates the basic structure of the application, so it only shows the structures related to the application.

Figure 2:
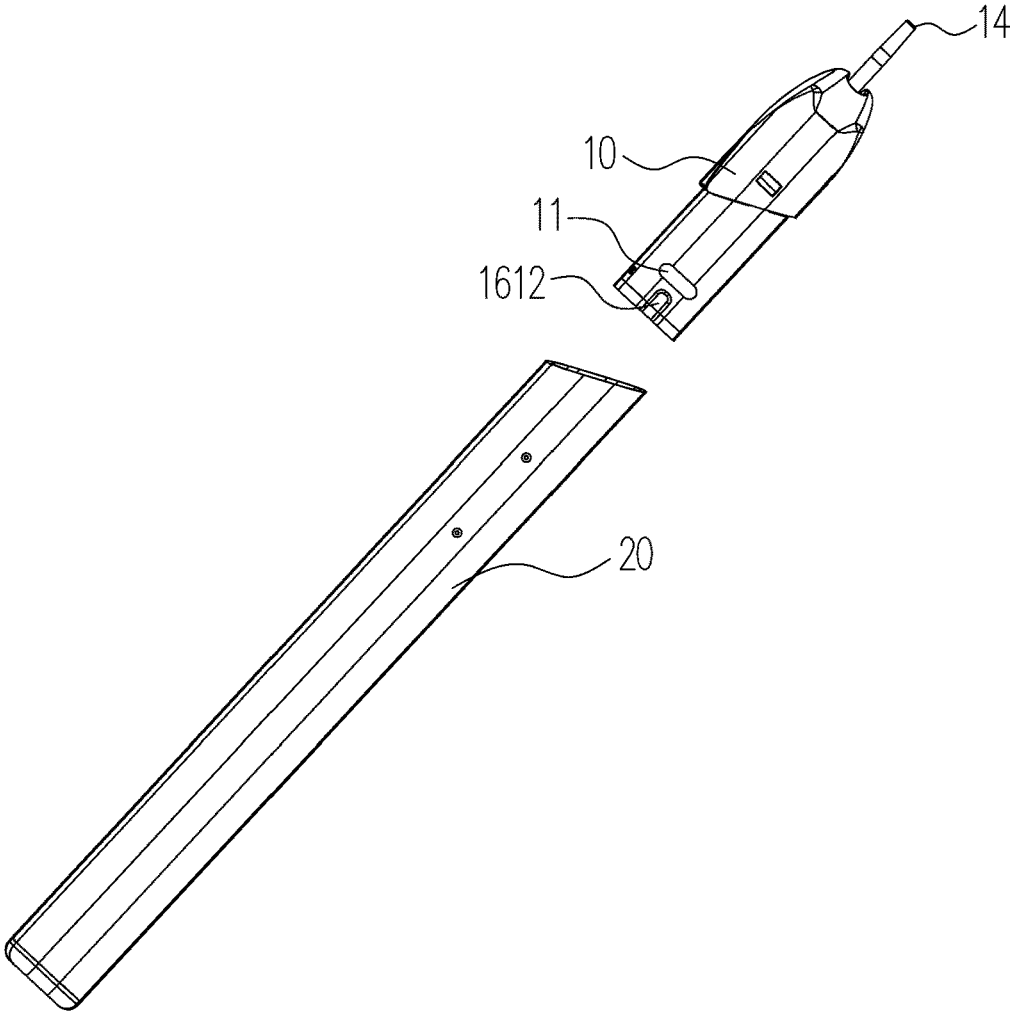
FIG. 2 is an exploded view of the electronic cigarette shown in FIG. 1.

Referring to FIGS. 1 and 2, the present application provides an electronic cigarette. The electronic cigarette includes a cartridge 10 and a battery device 20 cooperating with the cartridge 10. The cartridge 10 is detachably connected to the battery device 20. The electronic cigarette further includes an atomizing device. In use, the battery device 20 provides power, the atomizing device atomizes the aerosol-forming substrate stored in the cartridge 10 under the electric driving of the battery device 20, the aerosol-forming substrate forms smoke under the action of atomization, and the smoke is provided for the user to inhale. The atomizing device can be at least one of a microwave heating device, an infrared heating device, an electromagnetic sensing heating device, an ultrasonic atomizing device, and a resistance heating device. The atomizing device can be provided on the cartridge 10, can be provided on the battery device 20, or can be provided independently of the cartridge 10 and the battery device 20. When the atomizing device is provided on the battery device 20, or is provided independently of the cartridge 10 and the battery device 20, the user does not discard the atomizing device when replacing the cartridge 10, so as to reduce the user's replacement cost. The aerosol-forming substrate can be e-liquid, tobacco shred or tobacco paste. When the type of the aerosol-forming substrate is different, the structure of the cartridge 10 is also different. For example, when the aerosol-forming substrate is tobacco shred, the cartridge 10 can be formed into a structure similar to that of an ordinary cigarette. In this embodiment, the aerosol-forming substrate is an e-liquid as an example.

Figure 4:
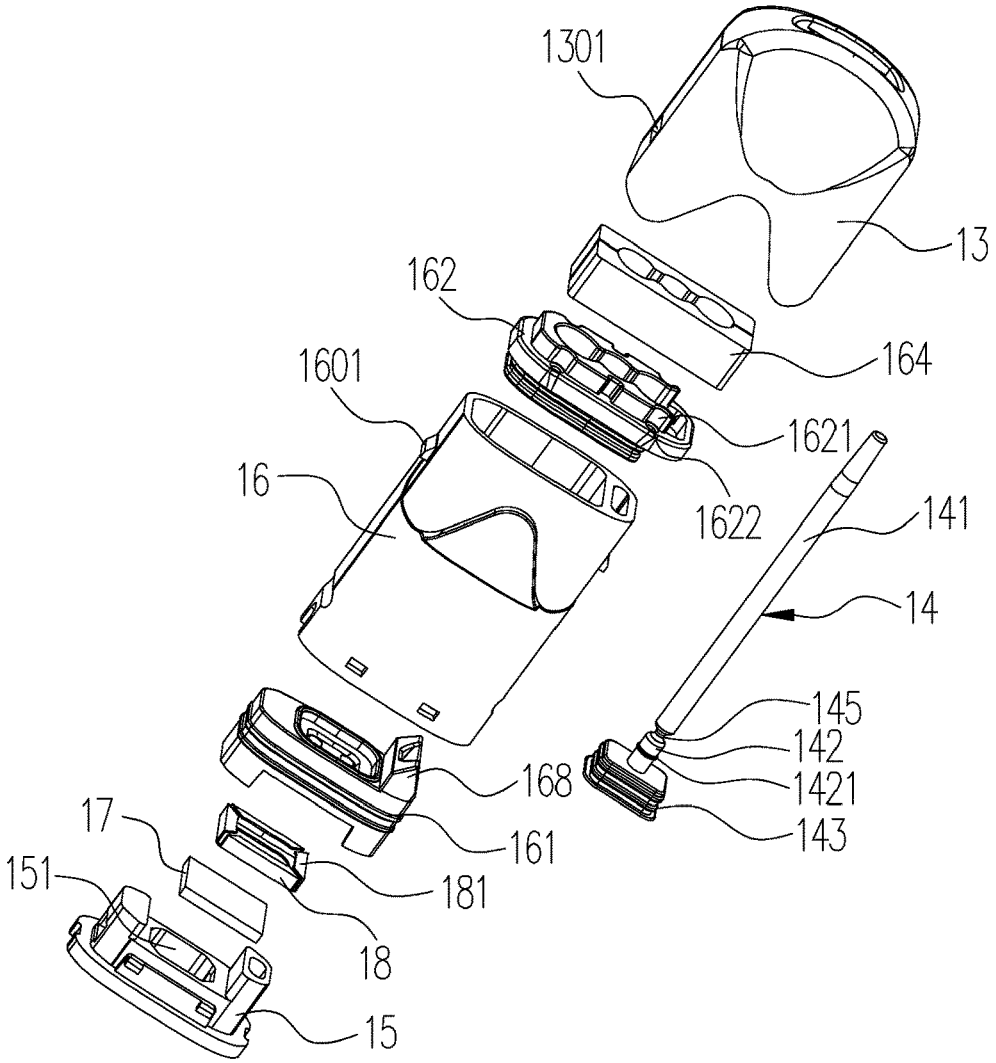
FIG. 4 is an exploded view of the cartridge of the electronic cigarette shown in FIG. 3.
Figure 7:
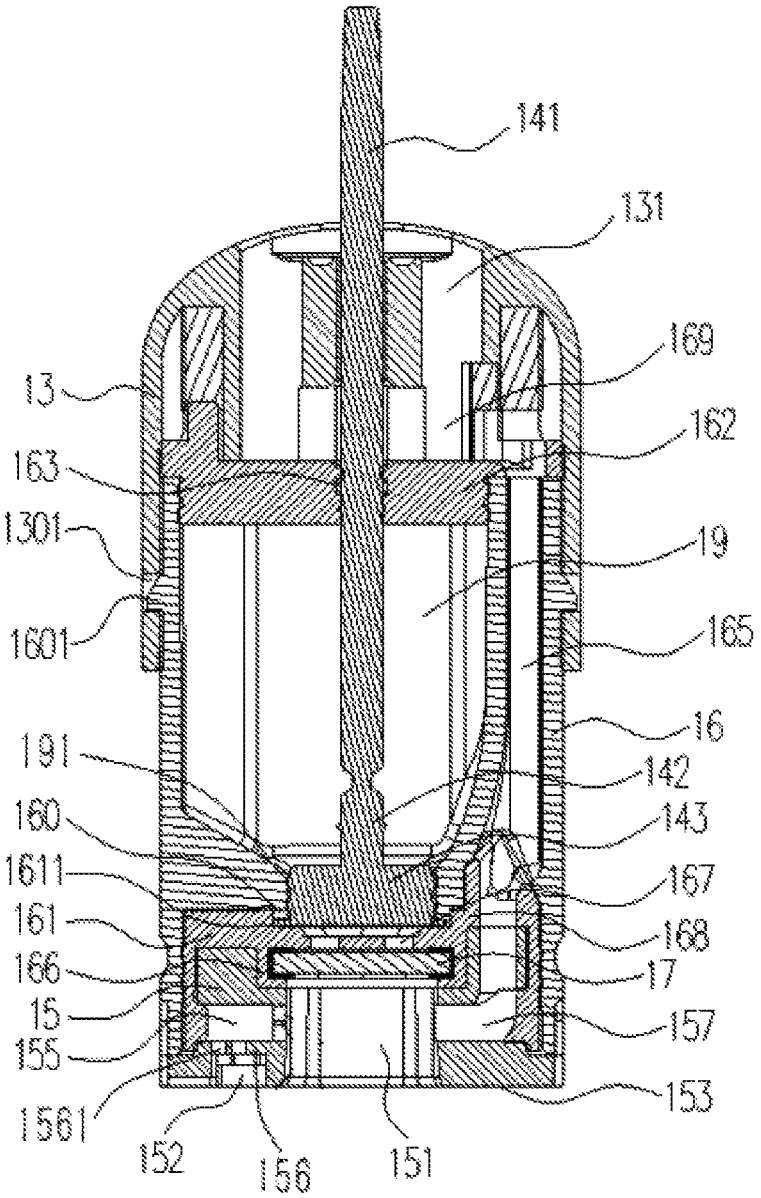
FIG. 7 is a cross-sectional view of the cartridge of the electronic cigarette shown in FIG. 1.
Figure 8:
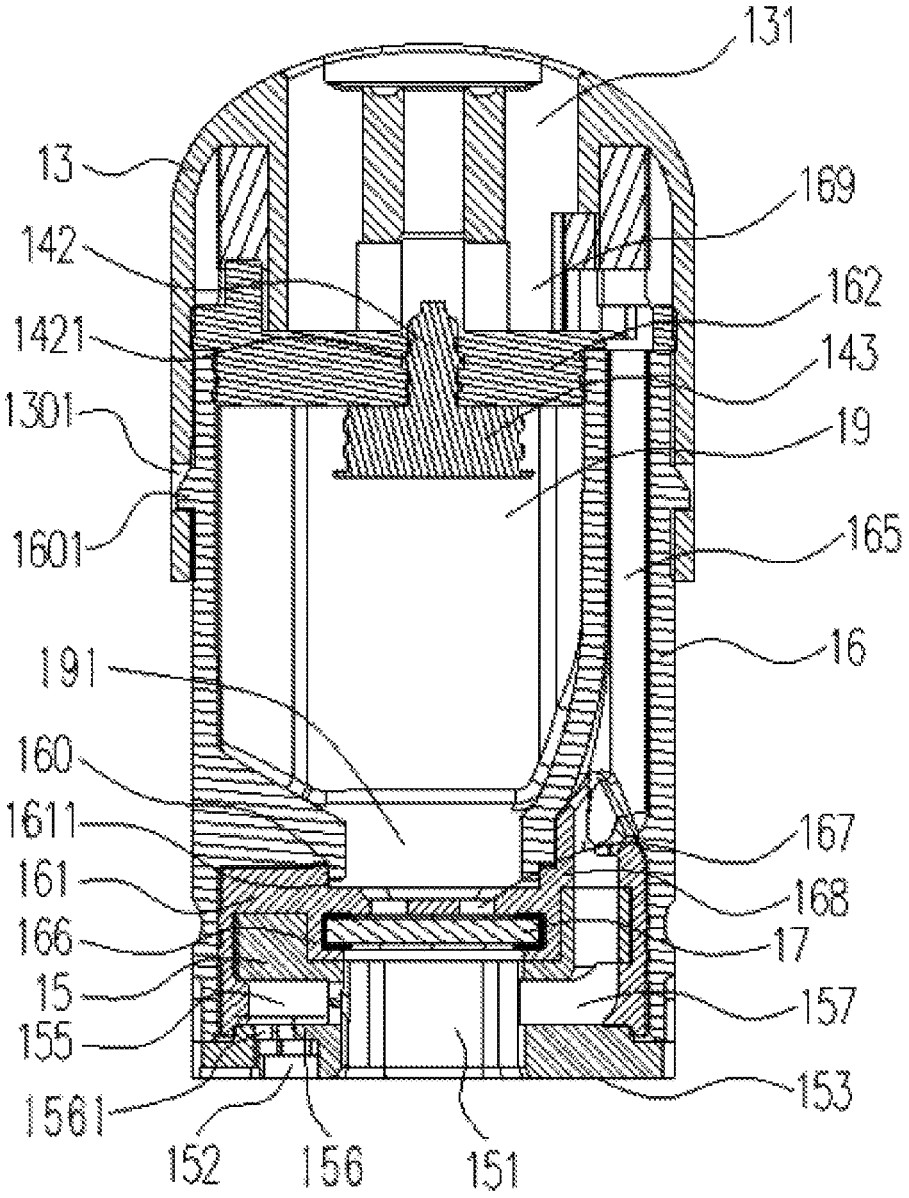
FIG. 8 is a cross-sectional view of the cartridge of the electronic cigarette shown in FIG. 1 in another state (the sealing member is pulled apart)

Please refer to FIGS. 4, 7 and 8, the cartridge 10 includes a sealing member 14, a suction nozzle 13 provided with a smoke outlet 131, a cartridge casing 16, a sealing pad 162, a liquid suction member 17, a liquid suction member holder 18, and a bottom base 15. The suction nozzle 13 is installed on the upper end of the cartridge casing 16. The sealing pad 162 is arranged at the upper end of the cartridge casing 16 and is located between the suction nozzle 13 and the cartridge casing 16. A part of the sealing member 14 is inserted into the cartridge casing 16 sequentially through the suction nozzle 13 and the sealing pad 162. Another part of the sealing member 14 is exposed to the outside of the cartridge 10. The liquid suction member 17 and the liquid suction member holder 18 are arranged at the lower end of the cartridge casing 16, and the bottom base 15 is connected to the lower end of the cartridge casing 16. The bottom base 15 is provided with an atomizing cavity 151, an air inlet opening 152 and a cooperating portion 153. The air inlet opening 152 and the cooperating portion 153 are respectively located on opposite sides of the atomizing cavity 151. When the cartridge 10 is installed on the battery device 20, the cooperating portion 153 and the battery device 20 together form a specific matching structure configured for detecting whether the cartridge 10 is installed on the battery device 20 or whether the cartridge 10 is removed from the battery device 20.

The cartridge casing 16 is substantially a hollow cylindrical structure with both ends being opened, and the inner cavity of the cartridge casing 16 forms a liquid storage cavity 19 for storing e-liquid. The volume of the liquid storage cavity 19 is 0.5-3 ml (millilitre). If the volume of the liquid storage cavity 19 is too small, the amount of stored e-liquid cannot meet the user's smoking needs. If the volume of the liquid storage cavity 19 is too large, the amount of stored e-liquid will be too large, and the user may not be able to use it up on the same day. When the volume of the liquid storage cavity 19 is 0.5-3 ml, it can just meet the user's suction demand. An airflow channel 165 is defined in the sidewall at one side of the cartridge casing 16 along the axial direction of the cartridge casing 16. The liquid storage cavity 19 and the airflow channel 165 are both opened at the upper and lower ends, and the liquid storage cavity 19 and the airflow channel 165 are isolated from each other. The lower opening of the airflow channel 165 is in communication with the atomizing cavity 151 of the bottom base 15, the upper opening of the airflow channel 165 is in communication with the smoke outlet 131 of the suction nozzle 13, and the air inlet opening 152 of the bottom base 15 is in communication with the atomizing cavity 151. The upper opening of the liquid storage cavity 19 is sealed by the sealing pad 162. The sealing pad 162 is provided with a through hole 163 for the sealing member 14 to pass through. The lower opening of the liquid storage cavity 19 forms as a liquid outlet 191, and the liquid outlet 191 is used to communicate the liquid storage cavity 19 and the liquid suction member 17. The lower end of the cartridge casing 16 extends downward along the axial direction of the cartridge casing 16 to form a receiving portion (not labeled). The liquid suction member 17 is fixedly installed on the outside of the liquid outlet 191 through the liquid suction member holder 18 and is located in the receiving portion. The liquid suction member 17 is in communication with the atomizing cavity 151 of the bottom base 15. The lower end of the sealing member 14 sequentially passes through the suction nozzle 13 and the through hole 163 of the sealing pad 162 from the outside of the cartridge 10 and is inserted into the liquid storage cavity 19 to seal the liquid outlet 191, so that the liquid storage cavity 19 is sealed and the e-liquid will thus not leak before the cartridge 10 is used, which is convenient for storage and transportation of the cartridge 10, and the e-liquid in the liquid storage cavity 19 will also not deteriorate due to coming into contact with the external air. When the electronic cigarette needs to be used, the user can operate the sealing member 14 in order to remove the sealing member 14 from the liquid outlet 191, so that the liquid outlet 191 is opened, and the e-liquid in the liquid storage cavity 19 can contact with the liquid suction member 17 through the liquid outlet 191 and is then absorbed by the liquid suction member 17.

In a specific embodiment, the liquid suction member holder 18 has substantially a hollow box-like structure with through holes at the upper and lower ends, the liquid suction member 17 is installed in the inner cavity of the liquid suction member holder 18. A plurality of bending portions 181 capable of being bent are provided on the side wall of the liquid suction member holder 18 around the upper through hole of the liquid suction member holder 18. When installing, the liquid suction member 17 is received in the inner cavity of the liquid suction member holder 18, so that the lower surface of the liquid suction member 17 is in contact with the bottom wall of the liquid suction member holder 18. Then, after the bending portions 181 are bent to a certain angle, apply downward pressure to make the bending portions 181 abut on the upper surface of the liquid suction member 17, thereby fixing the liquid suction member 17 on the liquid suction member holder 18. The operation is simple and convenient, so that the automatic installation of the liquid suction member 17 can be realized. In this embodiment, the liquid suction member 17 is cotton. It is understood that, in other embodiments not shown, the liquid suction member 17 can also be a component with liquid suction ability such as fiber rope, porous ceramic or porous graphite, which is not limited herein.

Please further combine FIG. 4, FIG. 7 and FIG. 8, in this embodiment, the sealing member 14 includes an operating portion 141 and a sealing portion (not labeled), one end of the operating portion 141 extends to the outside of the cartridge 10 to be operated by the user, and the other end of the operating portion 141 passes through the through hole 163 and then extends into the liquid storage cavity 19, the portion of the operating portion 141 located in the through hole 163 seals the through hole 163 to prevent the leakage of the e-liquid. The sealing portion includes a first sealing portion 142 and a second sealing portion 143 connected with each other, one end of the first sealing portion 142 is connected to one end of the operating portion 141 that is located in the liquid storage cavity 19, and the other end of the first sealing portion 142 is connected to the second sealing portion 143. The connecting position between the first sealing portion 142 and the operating portion 141 has a transverse cutout 145. The second sealing portion 143 is used to seal the liquid outlet 191, when the operating portion 141 moves outward along the through hole 163 under the action of an external force, it drives the first sealing portion 142 to move upward along the axial direction of the cartridge 10, and the first sealing portion 142 further drives the second sealing portion 143 to open the liquid outlet 191. The radial width of the second sealing portion 143 is greater than the aperture size of the through hole 163. When the operating portion 141 is continued to be pulled upward along the axial direction of the cartridge 10 until the second sealing portion 143 abuts against the lower surface of the sealing pad 162, the sealing member 14 cannot continue to move upward, and the first sealing portion 142 is inserted into the through hole 163 to seal the through hole 163. Since the connecting position between the first sealing portion 142 and the operating portion 141 has a transverse cutout 145, the operating portion 141 and the first sealing portion 142 can be disconnected under the action of the external force, so that the operating portion 141 is separated from the first sealing portion 142 and taken out, and the first sealing portion 142 seals the through hole 163 so as not to affect the sealing at the upper end of the liquid storage cavity 19. Also, the through hole of the suction nozzle 13 for inserting the sealing member 14 is used as the smoke outlet 131 after the operating portion 141 is taken out. In this embodiment, the outer wall of the first sealing portion 142 is provided with a sealing strip 1421 protruding outward along the radial direction of the first sealing portion 142, and the sealing strip 1421 closely contacts with the inner wall of the through hole 163, thereby improving the tightness for sealing the liquid storage cavity 19. The movement stroke of the sealing member 14 (i.e., the movement distance of the second sealing portion 143 moving from the liquid outlet 191 to abutting against the lower surface of the sealing pad 162 is 5-50 mm. In a specific embodiment, the movement stroke of the sealing member 14 is 10-15 mm. If the movement stroke is too short, it indicates that the axial length of the liquid storage cavity 19 is too short, in this way, the volume of the liquid storage cavity 19 may be too small, and if the movement stroke is too long, it will cause inconvenience to the user.

In addition, when pulling the sealing member 14, the sealing member 14 is deformed under the pulling force, so that a gap is formed between the operating portion 141 and the inner wall of the through hole 163, and external air can enter the liquid storage cavity 19 through the gap. Therefore, it is convenient for the e-liquid in the liquid storage cavity 19 to flow out from the liquid outlet 191 to contact with the liquid suction member 17 and then be absorbed by the liquid suction member 17. Otherwise, negative pressure will be formed in the liquid storage cavity 19, which is not conducive to the outflow of the e-liquid. Further, the liquid suction member 17 is located between the upper opening of the atomizing cavity 151 and the liquid outlet 191. Since the liquid suction member 17 is arranged directly below the liquid outlet 191, when the liquid outlet 191 is opened, the e-liquid in the liquid storage cavity 191 can be absorbed by the liquid suction member 17 after flowing out of the liquid outlet 191, to shorten the flowing distance of the e-liquid. In actual use, the size of the liquid outlet 191 can be set to be slightly larger, as long as the size of the liquid outlet 191 matches the size of the liquid suction member 17. As a result, the e-liquid can be quickly absorbed by the liquid suction member 17, thereby reducing the waiting time of absorbing the e-liquid by the liquid suction member 17 after the user takes out the operating portion 141, so as to facilitate the user to quickly use the electronic cigarette.

In this embodiment, the atomizing device is provided on the battery device 20. The atomizing device is a resistance heating device. Specifically, the atomizing device is a heating member 21. The size of the lower opening of the atomizing cavity 151 matches the size of the heating member 21. When the cartridge 10 is installed on the battery device 20, the heating member 21 provided on the battery device 20 extends into the atomizing cavity 151 from the lower opening of the atomizing cavity 151, and contacts with the liquid suction member 17 or maintains a preset distance from the liquid suction member 17. The heating member 21 can generate heat to heat the e-liquid on the liquid suction member 17 under the action of the electric driving, and the e-liquid is heated to form smoke. When the electronic cigarette is used by the user, the smoke generated in the atomizing cavity 151 by atomizing the e-liquid flows out through the airflow channel 165 and the smoke outlet 131. When the e-liquid in the liquid storage cavity 19 is exhausted, the user can replace the cartridge 10 with a new one. Since the heating member 21 is provided on the battery device 20, the replacement of the cartridge 10 does not involve the heating member 21, thereby reducing the replacement cost of the cartridge 10. Further, the diameter of the lower opening of the airflow channel 165 is larger than that of the upper opening of the airflow channel 165, so that the suction pressure at the lower opening of the airflow channel 165 is relatively small, for preventing large particles of e-liquid from being sucked out. In addition, the channel wall at the lower end of the airflow channel 165 is set to be a curved surface, so that the connection is smoother, the smoke encounters less obstruction, and it is not easy to generate condensate. Specifically, one side of the cavity wall of the liquid storage cavity 19 and one side of the channel wall of the airflow channel 165 are the same wall body (not labeled). The lower end of the wall body and the other sides of the cavity wall of the liquid storage cavity 19 cooperate to form the liquid outlet 191, the upper end of the wall body and the other sides of the channel wall of the airflow channel 165 cooperate to form the upper opening of the airflow channel 165, and the lower end of the wall body and the other sides of the channel wall of the airflow channel 165 cooperate to form the lower opening of the airflow channel 165. The lower end of the wall body is inclined toward the liquid storage cavity 19 so that the aperture size of the upper opening of the airflow channel 165 is smaller than the aperture size of the lower opening of the airflow channel 165. At the same time, the size of the liquid outlet 191 is relatively small. Specifically, the lower end of the liquid storage cavity 19 shrinks inward to prevent the e-liquid in the liquid storage cavity 19 from flowing out through the liquid outlet 191 too fast.

In addition, the electronic cigarette of the present application adopts an isolating structure. Specifically, before using the electronic cigarette, the e-liquid in the liquid storage cavity 19 is isolated from the liquid suction member 17 by the isolating structure, so that the e-liquid is kept in the liquid storage cavity 19. In use, the liquid storage cavity 19 is opened, so that the e-liquid in the liquid storage cavity 19 flows to the liquid suction member 17 and is absorbed by the liquid suction member 17. In this way, the storage and transportation of the cartridge 10 are convenient. Moreover, it can effectively prevent the liquid suction member 17 from absorbing part of the e-liquid before contacting with the heating member 21, resulting in the squeezing out of the e-liquid absorbed on the liquid suction member 17 when the heating member 21 squeezes the liquid suction member 17 during the installation of the cartridge 10, so as to avoid the leakage of the e-liquid. It is understood that, when the liquid suction member 17 is made of hard materials such as porous ceramic, the isolating structure may not be provided between the liquid storage cavity 19 and the liquid suction member 17. The liquid suction member 17 will not deform under the squeezing of the heating member 21, therefore, the e-liquid on the liquid suction member 17 will not be squeezed out. It is understood that, in other embodiments not shown, in addition to using the sealing member 14 as an isolating structure, other isolating structures may also be used. For example, a pierceable sealing film or a movable sealing plate may be used by piercing through the sealing film or by moving the sealing plate in order to open the liquid storage cavity 19.

Please refer to FIGS. 7 and 8 again, the bottom base 15 is located in the receiving portion, the bottom base 15 is engaged with the cartridge casing 16. To ensure the sealing of the bottom base 15, a bottom base sealing member 161 is also provided between the bottom base 15 and the cartridge casing 16. The bottom base sealing member 161 is sleeved on the outside of the upper end of the bottom base 15. A mounting portion 166 protrudes downward from the lower surface of the bottom base sealing member 161 corresponding to the upper opening of the atomizing cavity 151, and the mounting portion 166 has a lower opening. The liquid suction member 17 is installed on the liquid suction member holder 18, and the liquid suction member 17 and the liquid suction member holder 18 together pass through the lower opening of the mounting portion 166 and are then received in the mounting portion 166. The upper end of the mounting portion 166 is provided with a liquid passage hole 167 in communication with the liquid suction member 17. When the liquid outlet 191 is opened, the liquid passage hole 167 is further in communication with the liquid outlet 191. In addition, the upper surface of the bottom base sealing member 161 is recessed downward to form a recessed groove 1611 in communication with the liquid passage hole 167. Corresponding to the liquid outlet 191, the lower end of the liquid storage cavity 19 extends downward to form an insertion portion 160 for engaging with the recessed groove 1611. The insertion portion 160 is inserted in the recessed groove 1611, which can effectively prevent the leakage of the e-liquid. At the same time, the cavity wall of the liquid storage cavity 19 is inclined from a predetermined distance from the liquid outlet 191, and the inclined cavity wall can guide the flowing of the e-liquid, so as to facilitate the smooth outflow of the e-liquid.

The upper surface of the bottom base sealing member 161 protrudes upward to form an air guiding portion 168, the air guiding portion 168 is inserted into the airflow channel 165 from the lower opening of the airflow channel 165 to increase the sealing performance of the airflow channel 165. An air guiding groove 157 is provided in the bottom base 15 corresponding to the air guiding portion 168. One end of the air guiding groove 157 passes through the upper surface of the bottom base 15 along the axial direction of the cartridge 10 and is in communication with the air guiding portion 168. The other end of the air guiding groove 157 passes through the cavity wall of the atomizing cavity 151 along the radial direction of the cartridge 10 and is in communication with the atomizing cavity 151. The smoke in the atomizing cavity 151 flows out through the air guiding groove 157, the air guiding portion 168, the airflow channel 165 and the smoke outlet 131 in sequence. A communication groove 155 is provided in the bottom base 15 opposite to the air guiding groove 157. One end of the communication groove 155 passes through the cavity wall of the atomizing cavity 151 along the radial direction of the cartridge 10 and is in communication with the atomizing cavity 151. The other end of the communication groove 155 passes through the lower surface of the bottom base 15 along the axial direction of the cartridge 10 to form the air inlet opening 152. In this way, the air inlet opening 152 and the lower opening of the atomizing cavity 151 are arranged in parallel along the axial direction of the cartridge 10, that is, the two are staggered in the axial direction of the cartridge 10, which can prevent the condensate formed by the smoke in the atomizing cavity 151 from entering the air inlet opening 152, further entering the battery device 20 through the air inlet opening 152 to affect the use of the electronic components in the battery device 20. In addition, a partition plate 156 is provided in the communication groove 155, an air passage hole 1561 is provided through the partition plate 156, the air passage hole 1561 is respectively in communication with the air inlet opening 152 and the communication groove 155. The aperture size of the air passage hole 1561 is relatively small, and the condensate is difficult to enter the air inlet opening 152 through the air passage hole 1561 due to the action of surface tension. The air passage hole 1561 can also be provided in the cavity wall of the atomizing cavity 151, the air passage hole 1561 provided in the cavity wall of the atomizing cavity 151 is in communication with the atomizing cavity 151 and the communication groove 155, used for preventing the condensate from entering the communication groove 155.

In order to facilitate the injection of e-liquid into the liquid storage cavity 19, the upper surface of the sealing pad 162 is provided with a groove 169 on opposite sides of the sealing member 14 respectively. The suction nozzle 13 is provided with a communication port (not labelled) on opposite sides of the sealing member 14 respectively. When e-liquid is injected, one of the communication ports is configured as a liquid injection port, and the other of the communication ports is configured as an exhaust port. A liquid injection needle (not shown) sequentially passes through the liquid injection port and the groove 169 corresponding to the liquid injection port, and extends into the liquid storage cavity 19 to inject e-liquid into the liquid storage cavity 19. An exhaust needle (not shown) sequentially passes through the exhaust port and the groove 169 corresponding to the exhaust port, and extends into the liquid storage cavity 19 to exhaust the gas in the liquid storage cavity 19 during the liquid injection process. After the liquid injection is finished, the liquid injection needle and the exhaust needle are pulled out, the sealing pad 162 forms a self-sealing at the positions pierced by the liquid injection needle and the exhaust needle and does not leak. The presence of the groove 169 can reduce the thickness of the sealing pad 162, thereby facilitating the piercing by the liquid injection needle and the exhaust needle. During the entire liquid injection process, the liquid suction member 17 and the liquid storage cavity 19 are always isolated from each other, which can effectively prevent the leakage of e-liquid through the liquid suction member 17. It can also prevent the air from disturbing the liquid suction member 17 to cause the position of the liquid suction member 17 to shift. When smoking is performed through the suction nozzle 13, the two communicating ports are used as the smoke outlet 131.

Figure 5:
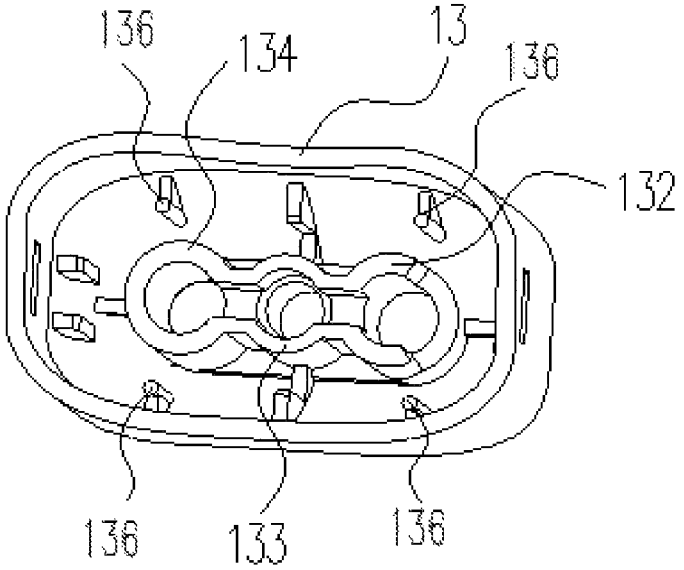
FIG. 5 is a perspective view of the suction nozzle of the cartridge shown in FIG. 4.
Figure 6:
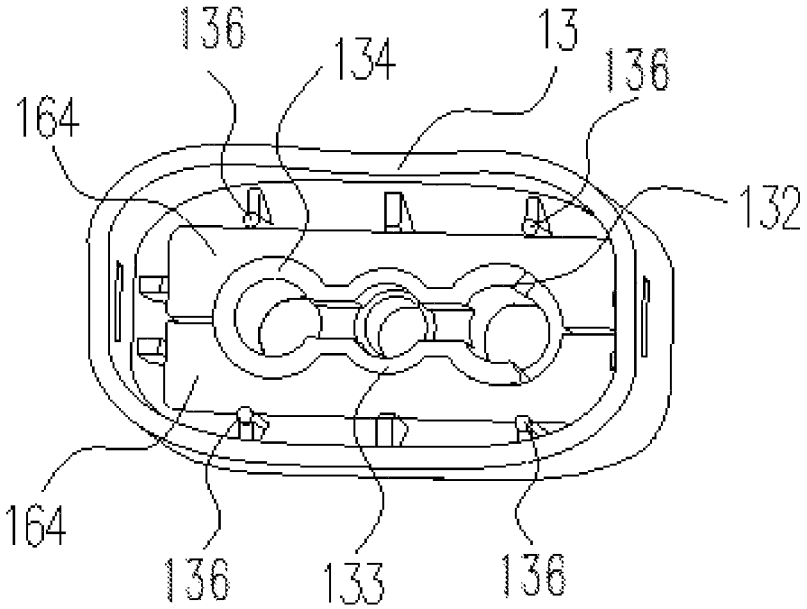
FIG. 6 is a schematic view showing the connection structure between the suction nozzle and the liquid collecting member of the cartridge shown in FIG. 4.

In addition, referring to FIGS. 4, 5 and 6, a liquid collecting member 164 is further provided between the sealing pad 162 and the suction nozzle 13, the liquid collecting member 164 is configured to absorb large particles of the e-liquid or condensate. Specifically, the inner surface of the suction nozzle 13 protrudes along the axial direction of the cartridge 10 to form a first communication tube 132, a second communication tube 133 and a third communication tube 134 arranged in sequence and each having both ends being opened, wherein the inner cavity of the first communication tube 132 forms as one of the communicating ports, the inner cavity of the third communication tube 134 forms as the other of the communicating ports, and the operating portion 141 of the sealing member 14 passes through the inner cavity of the second communication tube 133. The inner surface of the suction nozzle 13 is further provided with a plurality of reinforcing ribs 136 along the axial direction of the cartridge 10. The liquid collecting member 164 is sandwiched between the reinforcing ribs 136 and at least one of the first communication tube 132, the second communication tube 133 and the third communication tube 134. In this embodiment, the liquid collecting member 164 has two and are arranged opposite to each other. In a specific embodiment, the liquid collecting member 164 is cotton, the cotton is relatively soft and can be fully adhered to the first communication tube 132, the second communication tube 133, the third communication tube 134 and the reinforcing ribs 136, so as to effectively prevent condensate or large particles of the e-liquid from entering the user's mouth through the liquid collecting member 164, which is beneficial to improve the liquid absorption capacity of the liquid collecting member 164. It is understood that, in other embodiments not shown, the liquid collecting member 164 can also be a component with liquid absorption ability, such as fiber rope, porous ceramic, porous graphite, or the like. In addition, referring to FIG. 4, the sealing pad 162 is provided with a guiding groove 1621 and an installation groove 1622 corresponding to the reinforcing rib 136, when the suction nozzle 13 is installed, the reinforcing rib 136 slides along the guiding groove 1621, so that the reinforcing rib 136 is partially inserted into the installation groove 1622, thereby realizing the connection relationship between the suction nozzle 13 and the sealing pad 162.

Figure 3:
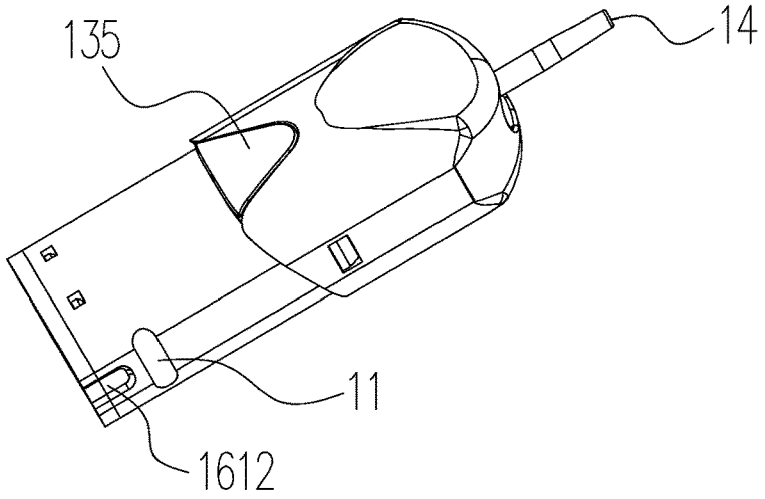
FIG. 3 is a perspective view of the cartridge of the electronic cigarette shown in FIG. 2.

Please refer to FIG. 4 and FIG. 7 again, the suction nozzle 13 is sleeved on the outside of the upper end of the cartridge casing 16, both the suction nozzle 13 and the cartridge casing 16 are of flat structure, which can effectively prevent the cartridge 10 from rolling down from a supporting surface (for example, a desktop). In addition, opposite side walls of the cartridge casing 16 are each protruded to form a locking protrusion 1601, the side wall of the suction nozzle 13 is provided with a locking groove 1301 corresponding to the locking protrusion 1601, the locking protrusion 1601 is engaged in the locking groove 1301, to realize the connection relationship between the cartridge casing 16 and the suction nozzle 13, and prevent the suction nozzle 13 from being arbitrarily disassembled after installation. At the same time, the end of the suction nozzle 13 away from the cartridge casing 16 is the suction end, and the smoke outlet 131 is provided on the suction end. The outer surface of the suction nozzle 13 shrinks inward to be a curved surface from a preset distance from the suction end, which is ergonomic and has a good suction experience. When the cartridge 10 is installed in place, the suction end is located outside the battery casing 24. The cartridge casing 16 is made of a transparent or translucent material, and a portion of the suction nozzle 13 corresponding to the liquid storage cavity 19 is provided with a cutout 135, as shown in FIGS. 1, 3 and 4, so that the cartridge casing 16 is partially exposed through the cutout 135, and a window through which the liquid storage cavity 19 can be observed is formed, which is convenient for the user to observe the used amount or remaining amount of the e-liquid.

The bottom of the cartridge 10 may be sleeved with a dust cover (not shown) or the cartridge 10 may be contained in a sealing bag (not shown) to prevent the liquid suction member 17 from being contaminated before use and affecting the use by the user.

Figure 18:
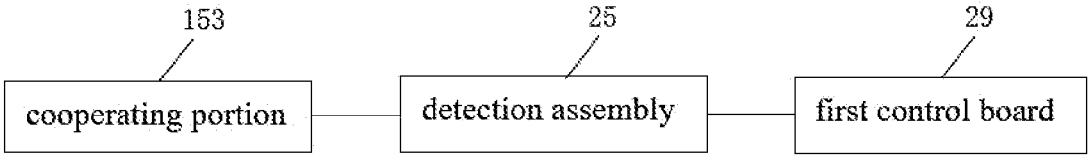
FIG. 18 is a block diagram of the connection between the cooperating portion of the cartridge and the battery device shown in FIG. 9.

Referring to FIGS. 9 to 13, the battery device 20 includes a heating member 21, conductive posts 231 and a battery device main body. The battery device main body includes a detection assembly 25 (FIG. 18), a battery casing 24, a battery bracket 23, a bracket sealing member 22, a battery 233, and a first control board 29. The heating member 21 may be a heating sheet, a heating net, a heating wire or a heating rod. When the heating member 21 is a heating sheet or a heating net, the contact area between the heating member 21 and the liquid suction member 17 is large and uniform, so as to uniformly heat the e-liquid on the liquid suction member 17 to prevent local overheating. The heating member 21 may be made of a metal material, a ceramic material, or a metal-ceramic composite material. In a specific embodiment, the heating member 21 may be a ceramic heating sheet, which is sintered with tungsten paste filled in aluminum nitride ceramic. The aluminum nitride ceramic and the tungsten paste are tightly combined and have a porosity of less than 1%, so that the heating member 21 can be heated to quickly rise in temperature and have a uniform temperature distribution, but the type of the heating member 21 is not limited to this. Aluminum nitride ceramic means that its composition includes aluminum nitride. Also, the composition of the aluminum nitride ceramic may further include other substances, such as alumina. In addition to using aluminum nitride ceramic, the main body of the heating member 21 may also be made of other ceramic materials, for example, aluminum oxide or silicon nitride. In addition to using tungsten paste, the heating part of the heating member 21 may also be made of other metal pastes, for example, silver paste. The battery bracket 23 is disposed in the battery casing 24, and the battery 233 is disposed on the battery bracket 23. The bracket sealing member 22 is sleeved on the outside of the upper end of the battery bracket 23 and is closely attached to the inner wall of the battery casing 24 to prevent the e-liquid from leaking into the battery device 20 through the gap between the battery casing 24 and the battery bracket 23. The conductive posts 231 are disposed at the upper end of the battery bracket 23 and extend into the bracket sealing member 22, and the conductive posts 231 are configured to electrically connect the heating member 21 and the battery 233. The bracket sealing member 22 divides the inner cavity of the battery casing 24 into an accommodating cavity 242 located above the bracket sealing member 22 and a mounting cavity 243 located below the bracket sealing member 22. The battery bracket 23, the battery 233 and the first control board 29 are all located in the mounting cavity 243. A part of the detection assembly 25 is located in the mounting cavity 243, and the other part is located in the accommodating cavity 242. The heating member 21 is located in the accommodating cavity 242, and the two pins 211 of the heating member 21 pass through the bracket sealing member 22 and are respectively inserted into the conductive posts 231 to realize the fixing of the heating member 21 and the electrical connection with the conductive posts 231. The accommodating cavity 242 protects the heating member 21 and can prevent the heating member 21 from breaking when the battery device 20 is falling off. In addition, the distance from the top of the accommodating cavity 242 to the upper surface of the heating member 21 is greater than zero, for preventing the user's fingers from contacting the heating member 21, thereby preventing the residual heat of the heating member 21 and the heat generated during self-cleaning from scalding the user. Please refer to FIG. 15 and FIG. 3, latching buckles 241 are provided on two opposite cavity walls of the accommodating cavity 242, and latching grooves 11 are correspondingly provided on two opposite side walls of the cartridge casing 16. The latching buckle 241 engages in the latching groove 11 so that the cartridge 10 is detachably installed on the battery device 20. When the cartridge 10 is installed on the battery device 20, the cartridge 10 is partially received in the accommodating cavity 242, so as to prevent the cartridge 10 from shaking randomly, improve the installation stability of the cartridge 10 and reduce the overall length of the electronic cigarette. In addition, it should be noted that when the cartridge 10 is installed in place, the suction nozzle 13 is located outside the battery casing 24 to facilitate the user's smoking. In addition, a sliding groove 1612 is formed on the side wall of the cartridge casing 16 along the sliding direction of the latching buckle 241 relative to the latching groove 11. During the installation of the cartridge 10 and the battery device 20, the latching buckle 241 slides along the sliding groove 1612, and then slides over the sliding groove 1612 to be engaged in the latching groove 11. The presence of the sliding groove 1612 can guide the installation of the cartridge 10, so that it is convenient to install.

When the cartridge 10 and the battery device 20 are installed in place, the heating member 21 extends into and is located in the atomizing cavity 151 to maintain a preset distance from, or contact with, the liquid suction member 17. The liquid suction member 17 is configured for supplying e-liquid to the heating member 21 for atomization. When the cartridge 10 is installed on the battery device 20, the cooperating portion 153 on the cartridge 10 is in contact with the detection assembly 25. When the cartridge 10 is removed from the battery device 20, the cooperating portion 153 on the cartridge 10 is separated from the detection assembly 25. The detection assembly 25 is connected to the first control board 29. The detection assembly 25 is configured to generate a separation signal when it is separated from the cooperating portion 153. The first control board 29 is configured, according to the separation signal, to control the heating member 21 to work under preset parameters, so as to remove the residue adhered to the heating member 21. The detection assembly 25 is further configured to generate a connection signal when it is in contact with the cooperating portion 153; at this time, the first control board 29 cannot control the heating member 21 to work under the preset parameters to remove the residue adhered to the heating member 21. Residue include, but are not limited to, residual aerosol-forming substrates and carbides produced at high temperature. When the separation signal is detected, the self-cleaning mode is activated. In actual implementation, the heating member 21 is controlled to work for a relatively short time with a relatively high power. For example, the heating member 21 is controlled to work at a relatively high power for 0.8 seconds. It should be noted that the power used for self-cleaning is higher than the power of the heating member 21 used for the atomization. Removing the residue on the heating member 21 can prevent the residue from affecting the use of the electronic cigarette. For example, when the residue are residual e-liquid, the residual e-liquid can be prevented from entering the mounting cavity 243 to affect the electronic components in the mounting cavity 243. In addition, the self-cleaning is performed after the cartridge 10 is removed from the from the battery device 20, which can prevent the liquid suction member 17 from being carbonized under the high temperature during self-cleaning.

Two embodiments of implementing the detection assembly 25 are provided below.

Figure 20:
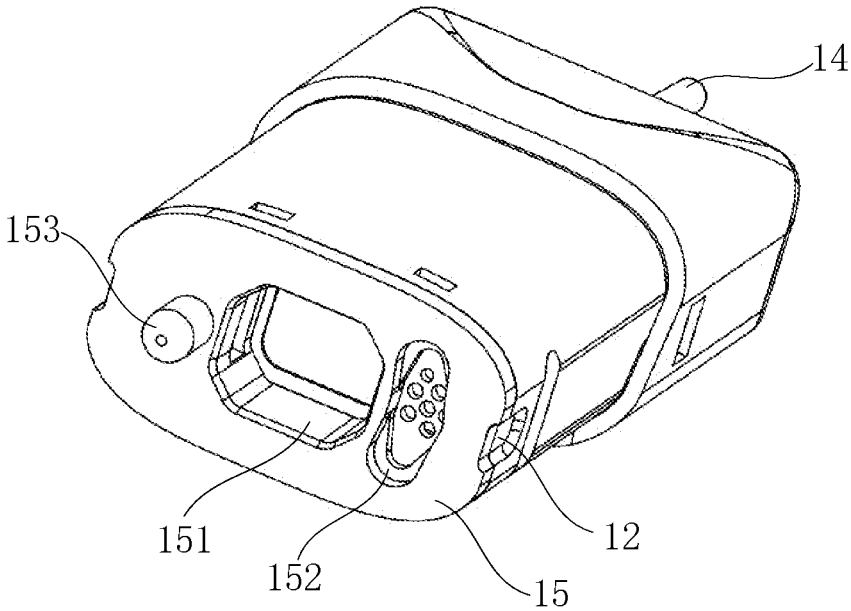
FIG. 20 is a perspective view of a cartridge of an electronic cigarette according to another embodiment of the present application.
Figure 21:
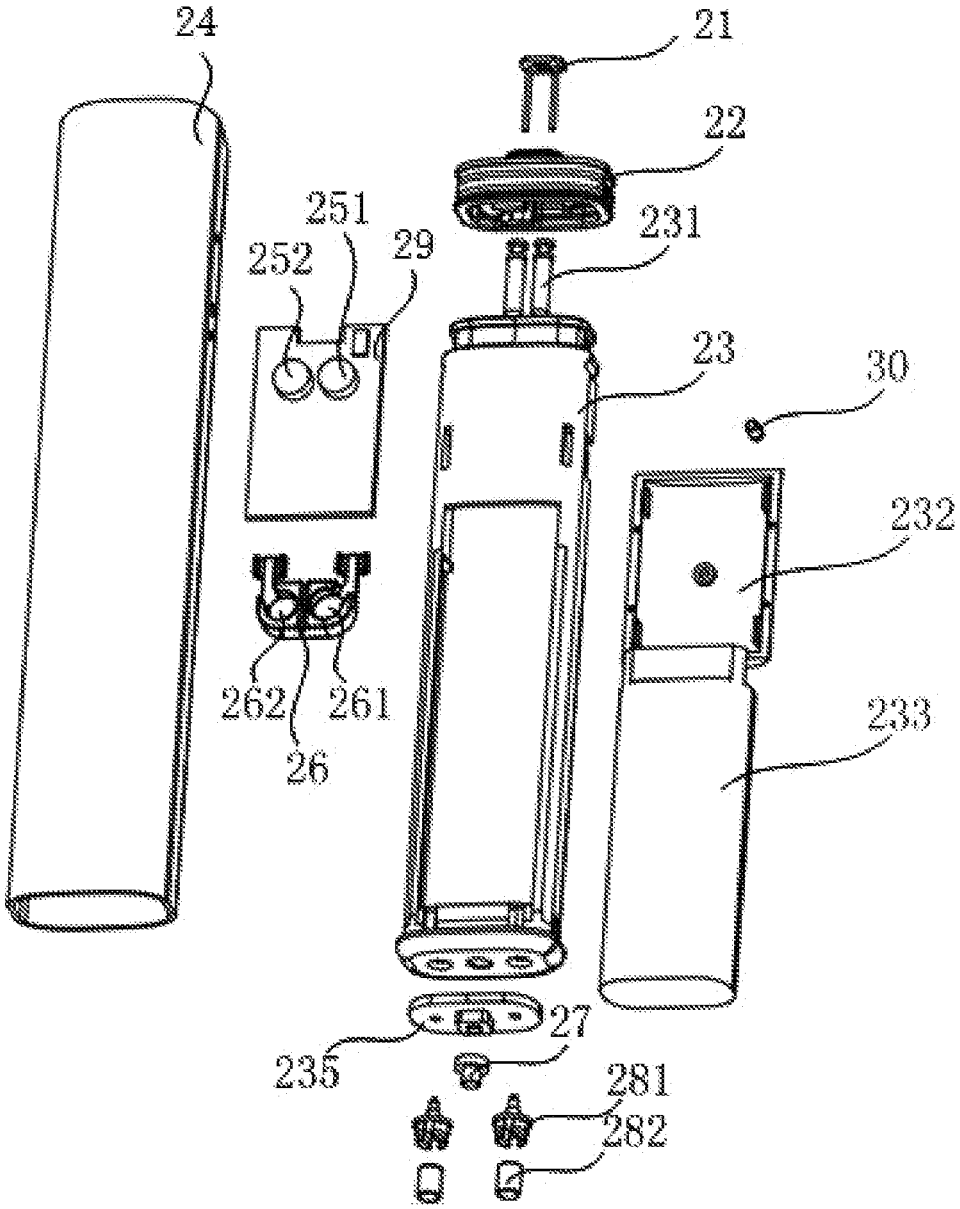
FIG. 21 is an exploded view of a battery device cooperating with the cartridge shown in FIG. 20.
Figure 22:
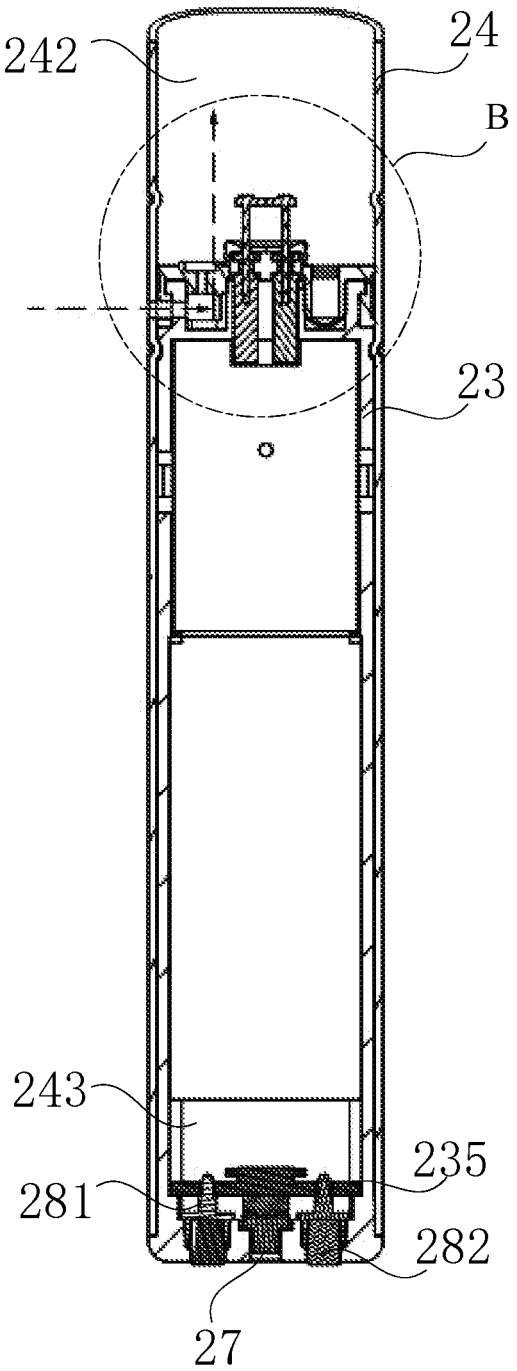
FIG. 22 is a cross-sectional view of the battery device shown in FIG. 21.
Figure 23:
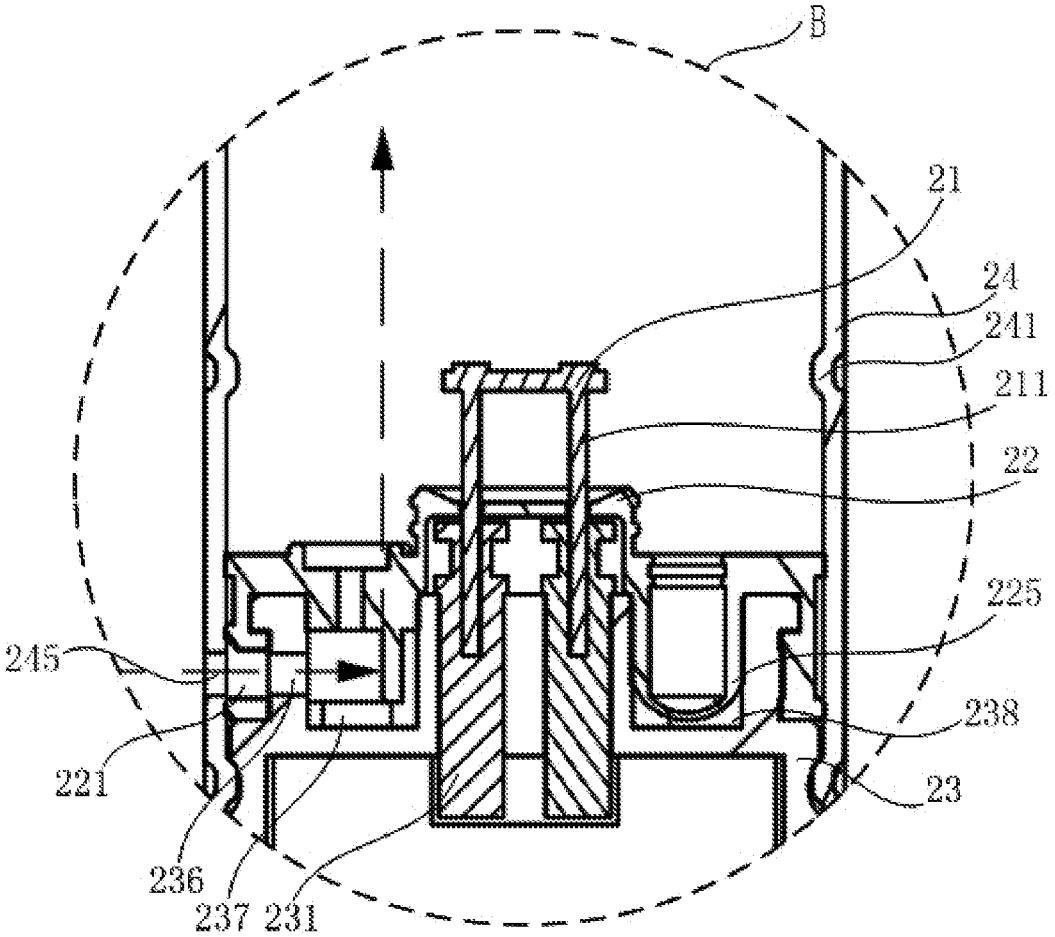
FIG. 23 is a partially enlarged view of the portion B in the battery device shown in FIG. 22.
Figure 24:
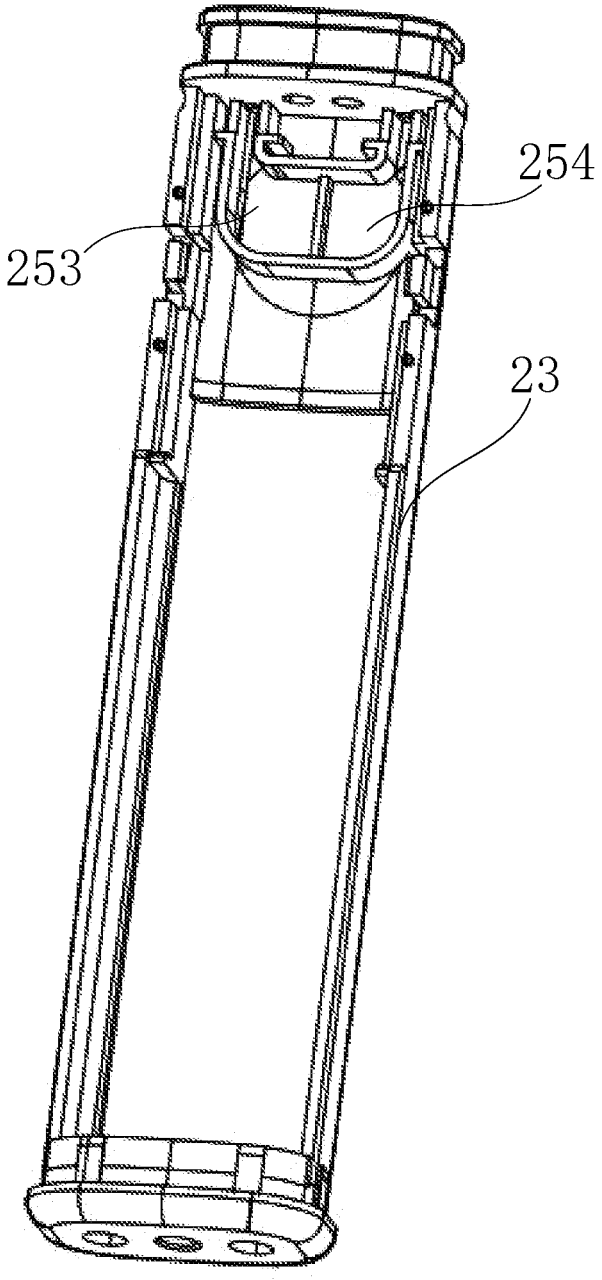
FIG. 24 is a perspective view of the battery bracket of the battery device shown in FIG. 21.
Figure 25:
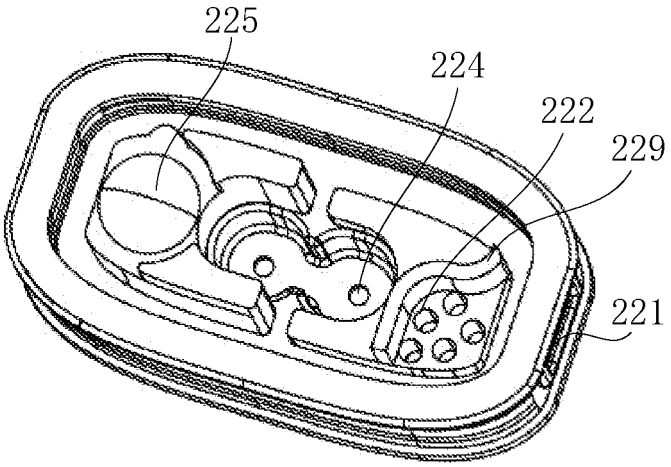
FIG. 25 is a perspective view of the bracket sealing member of the battery device shown in FIG. 21.
Figure 26:
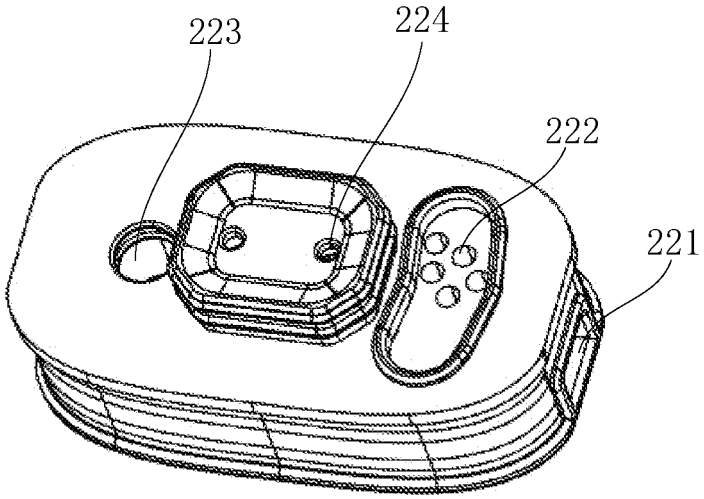
FIG. 26 is another perspective view of the bracket sealing member of the battery device shown in FIG. 21.

In the first embodiment, referring to FIGS. 20-27, the detection assembly 25 includes a sensor sealing member 26, a first cavity 253, a second cavity 254, a first sensor 251, and a second sensor 252. The first cavity 253 and the second cavity 254 are provided on one side surface of the battery bracket 23 away from the upper end of the battery bracket 23 by a preset distance. The sensor sealing member 26 is provided with a first portion 261 and a second portion 262 respectively corresponding to the first cavity 253 and the second cavity 254. The first sensor 251 is installed in the first portion 261 and received in the first cavity 253, the opening of the first cavity 253 is in communication with the air inlet opening 152. The second sensor 252 is installed in the second portion 262 and received in the second cavity 254. The cooperating portion 153 is a sealing protrusion, as shown in FIG. 20, the cooperating portion 153 is protruded downwardly from the lower surface of the bottom base 15 corresponding to the air guiding groove 157. When the cartridge 10 is installed on the battery device 20, the cooperating portion 153 seals the opening of the second cavity 254. The first sensor 251 and the second sensor 252 are respectively connected to the first control board 29 to transmit airflow signals to the first control board 29. Through the cooperating structure of the battery bracket 23, the sensor sealing member 26 and the first control board 29, the first cavity 253 and the second cavity 254 can be isolated from each other to avoid mutual airflow interference. When the cooperating portion 153 opens the opening of the second cavity 254 as the cartridge 10 is removed from the battery device 20, negative pressure will be generated in the second cavity 254, so that the second sensor 252 detects the change of internal air pressure and generates a corresponding airflow signal, that is, it will generate a high-level signal. At the same time, since the user will not inhale the electronic cigarette when removing the cartridge 10, the first cavity 253 remains in communication with the outside environment, the air pressure in the first cavity 253 therefore does not change, and the first sensor 251 will not detect the airflow change, that is, it will generate a low-level signal. Thus, when the cartridge 10 is removed from the battery device 20, the airflow signal of the first sensor 251 is at a low level and the airflow signal of the second sensor 252 is at a high level. When the airflow signal of the first sensor 251 is at a low level and the airflow signal of the second sensor 252 is at a high level, it is concluded that the separation signal that the cartridge 10 is removed from the battery device 20 is detected. It should be noted that when the types of the first sensor 251 and the second sensor 252 are different, the relevant information of the airflow used for detection is different, it can be the flow rate of the airflow, or it can be the change of air pressure caused by the airflow. The first sensor 251 and the second sensor 252 generate airflow signals when detecting corresponding information about the airflow.

After detecting the separation signal, the self-cleaning mode is activated, the first control board 29 controls the heating member 21 to work under the preset parameters to remove the residue adhered to the heating member 21. In actual implementation, the heating member 21 is controlled to work for a relatively short time with a relatively high power, for example, heating for 1 second. The power used for self-cleaning is higher than the power of the heating member 21 used for atomization work. Removing the residue on the heating member 21 can prevent the residue from affecting the use of the electronic cigarette. For example, when the residue are residual e-liquid, the residual e-liquid can be prevented from entering the mounting cavity 243 to affect the electronic components in the mounting cavity 243. In addition, the self-cleaning is performed after the cartridge 10 is removed from the battery device 20, which can prevent the liquid suction member 17 from being carbonized under the high temperature during self-cleaning.

Following the above, please refer to FIG. 23 and FIGS. 24 to 27, the bracket sealing member 22 is provided with an insertion hole 224 for inserting the pin of the heating member 21, an air inlet hole 222 in communication with the opening of the first cavity 253, a cooperating hole 223 in communication with the opening of the second cavity 254, and an air inlet aperture 221. The insertion hole 224 is provided on the upper surface of the bracket sealing member 22. The air inlet hole 222 and the cooperating hole 223 are located on opposite sides of the insertion hole 224. The pin of the heating member 21 passes through the insertion hole 224 and then is inserted into the conductive post 231. The air inlet aperture 221 is provided in the side wall of the bracket sealing member 22 at a preset distance from the air inlet hole 222. The cooperating portion 153 of the cartridge 10 closes or opens the opening of the second cavity 254 through the cooperating hole 223 in communication with the opening of the second cavity 254. Please refer to FIG. 23, the battery casing 24 is provided with a first air vent hole 245, the side wall at the upper end of the battery bracket 23 is provided with a second air vent hole 236. The air inlet aperture 221 is respectively in communication with the first air vent hole 245 and the second air vent hole 236. The second air vent hole 236 is further in communication with the opening of the first cavity 253. Therefore, when the electronic cigarette is inhaled, the external air enters through the first air vent hole 245, the air inlet aperture 221 and the second air vent hole 236, taking away the air in the first cavity 253 when flowing through the opening of the first cavity 253, and then flows out from the air inlet hole 222, the air inlet opening 152, the communication groove 155, the atomizing cavity 151, the air guiding groove 157, the air guiding portion 168, the airflow channel 165 and the smoke outlet 131, so that a negative pressure is generated in the first cavity 253, the first sensor 251 detects the change in the air pressure and generates a corresponding airflow signal, that is, a high-level signal. At this time, the opening of the second cavity 254 is closed by the cooperating portion 153, there is no change in the air pressure in the second cavity 254, and the second sensor 252 is kept in the state of outputting a low-level signal. When the airflow signal of the first sensor 251 is at a high level and the airflow signal of the second sensor 252 is at a low level, it is concluded that an atomization start signal is detected. After the atomization start signal is detected, the atomization mode is started, and the first control board 29 controls the heating member 21 to work, in order to atomize the e-liquid on the liquid suction member 17. It is understood that, the external air entering from the first air vent hole 245 can also take away the smoke in the atomizing cavity 151 after entering the atomizing cavity 151.

It should be noted that when the user does not perform any sucking and disassembly operations on the electronic cigarette, there is no change in the air pressure in the first cavity 253 and the second cavity 254, the first sensor 251 and the second sensor 252 are both kept in the state of outputting low-level signals, the heating member 21 does not work; that is, neither self-cleaning nor atomization is performed. When the user only sucks the battery device 20, the air in the first cavity 253 and the second cavity 254 is sucked out, both the first cavity 253 and the second cavity 254 have negative pressure, the first sensor 251 and the second sensor 252 both generate high-level signals. At this time, the heating member 21 does not work either, thereby preventing the heating member 21 from operating in an abnormal state.

Figure 27:
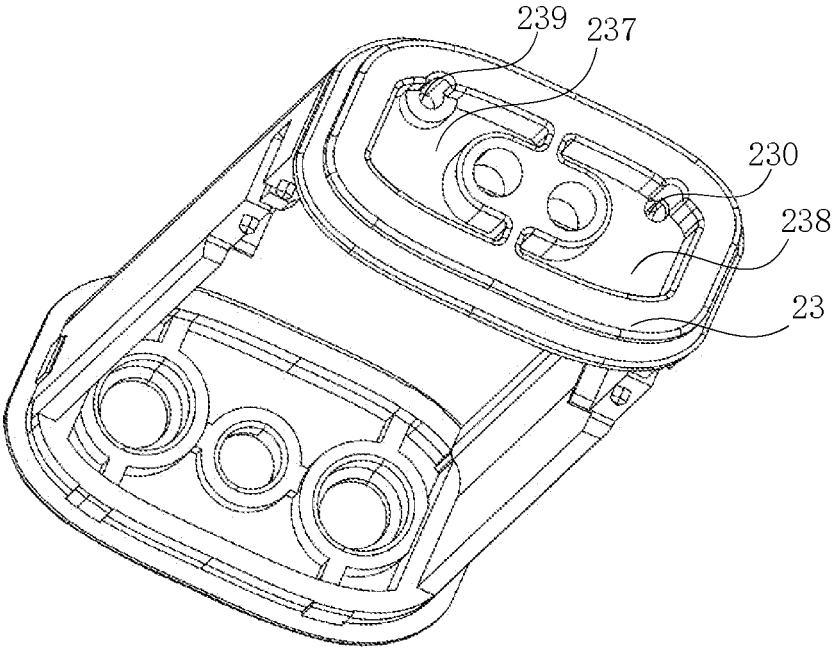
FIG. 27 is another perspective view of the battery bracket of the battery device shown in FIG. 21.

In order to prevent the condensate of the smoke or the leaked e-liquid from entering the first cavity 253 and the second cavity 254 to affect the operation of the first sensor 251 and the second sensor 252, as shown in FIG. 27, the upper surface of the battery bracket 23 is recessed downward to form a first receiving groove 237 and a second receiving groove 238. The bottom wall of the first receiving groove 237 is provided with a communication portion 239 protruding upward along the axial direction of the battery device 20, and the communication portion 239 is in communication with the first receiving groove 237 and the opening of the first cavity 253. Please refer to FIG. 25, the lower surface of the bracket sealing member 22 protrudes downward to form a partition portion 229. When the bracket sealing member 22 is installed in place, the air inlet hole 222 and the communication portion 239 are located on opposite sides of the partition portion 229. That is, the air inlet hole 222 and the communication portion 239 are staggered. Since the communication portion 239 is protruded out, and the air inlet hole 222 and the communication portion 239 are staggered, even if the condensate of the smoke or the leaked e-liquid enters the battery device 20, it cannot enter the first cavity 253 through the air inlet hole 222 and the communication portion 239, but will remain in the first receiving groove 237. Under the suction action of the user, the external air enters the first receiving groove 237 through the first air vent hole 245, the air inlet aperture 221 and the second air vent hole 236, and then flows out through the air inlet hole 222, the air inlet opening 152, the communication groove 155, the atomizing cavity 151, the air guiding groove 157, the air guiding portion 168, the airflow channel 165 and the smoke outlet 131. In this process, the air in the first cavity 253 is taken out by the external air through the opening of the first cavity 253, the communication portion 239 and the first receiving groove 237, so that a negative pressure is generated in the first cavity 253. The first sensor 251 detects the change in the air pressure and generates a corresponding airflow signal, that is, a high-level signal is generated. It is understood that, in other embodiments not shown, a waterproof and breathable membrane may also be provided at the opening of the first cavity 253. In this way, the air in the first cavity 253 can be sucked out smoothly, and liquid such as condensate or leaked e-liquid is isolated from the first cavity 253 by the waterproof and breathable membrane. Alternatively, a deforming member is provided at the opening of the first cavity 253, and the deforming member is deformed under the suction action of the user, so that the space enclosed by the first cavity 253 and the deforming member becomes larger. The air pressure in the space decreases, the first sensor 251 detects the change in the air pressure and generates a corresponding airflow signal; when the suction is stopped, the deforming member recovers, and the air pressure in the space recovers. The deforming member isolates liquid such as condensate or leaked e-liquid from the first cavity 253. In this embodiment, the detection assembly 25 further includes a deformation portion 225, the deformation portion 225 is formed by protruding downward from the lower surface of the bracket sealing member 22 corresponding to the cooperating hole 223, and the deformation portion 225 is a hollow structure with an open upper end. Please refer to FIG. 23, when the bracket sealing member 22 is installed on the battery bracket 23, the deformation portion 225 extends into and is located in the second receiving groove 238. A communication hole 230 is provided in the bottom wall of the second receiving groove 238, and the communication hole 230 is respectively in communication with the opening of the second cavity 254 and the second receiving groove 238. The deformation portion 225 seals the opening of the second cavity 254 by sealing the communication hole 230. At this time, the deformation portion 225 cooperates with the second cavity 254 to form a sealed space for accommodating the second sensor 252. When the cartridge 10 is installed in place, the cooperating portion 153 is inserted into the deformation portion 225 through the cooperating hole 223 to seal the deformation portion 225, which is equivalent to seal the opening of the second cavity 254. When the cartridge 10 is pulled out, the deformation portion 225 is deformed under the action of the cooperating portion 153, the sealed space enclosed by the second cavity 254 and the deformation portion 225 becomes larger, so that a negative pressure is generated in the space, the second sensor 252 detects the change in the air pressure and generates a corresponding airflow signal; that is, a high-level signal is generated. The deformation portion 225 separates the second sensor 252 in the second cavity 254 from the outside. Therefore, the condensate of the smoke or the leaked e-liquid can be prevented from entering the second cavity 254 to affect the normal operation of the second sensor 252.

It is understood that, as a part of the detection assembly 25, the deformation portion 225 may also be directly formed on the battery bracket 23 and located at the opening of the second cavity 254, and cooperate with the second cavity 254 to form a sealed space for accommodating the second sensor 252. At this time, the cooperating hole 223 of the bracket sealing member 22 is set to penetrate the upper and lower surfaces of the bracket sealing member 22, so that when the cartridge 10 is installed in place, the cooperating portion 153 is inserted into the deformation portion 225 through the cooperating hole 223 to seal the deformation portion 225. At the same time, the deformation portion 225 can isolate the second sensor 252 in the second cavity 254 from the outside, and prevent the condensate of the smoke or the leaked e-liquid from entering the second cavity 254. In addition, the second sensor 252 generates an airflow signal by detecting the change of the air pressure in the cavity where it is located. Therefore, it is only necessary to ensure that the cavity where the second sensor 252 is located has no change of air pressure after the cartridge 10 is installed, and will have change of air pressure when the cartridge 10 is removed. The change of air pressure may be the change of air pressure directly caused when the cooperating portion 153 is pulled out relative to the second cavity 254 when the deformation portion 225 is not provided, or when the deformation portion 225 is provided, the change of air pressure that acts on the deformation portion 225 when the cooperating portion 153 is pulled out relative to the second cavity 254, and in this case, the opening of the deformation portion 225 is the opening of the second cavity 254. Correspondingly, the opening of the second cavity 254 is in a closed state after the cartridge 10 is installed, and is in an open state after the cartridge 10 is removed, so that the above-mentioned pressure change can be generated.

The battery device 20 is equipped with a dual sensor structure, which can cooperate with the cooperating portion 153 of the cartridge 10 to generate a signal when the cartridge 10 is removed, so that the electronic cigarette can automatically remove the residue on the heating member 21 when the cartridge 10 is removed, so as to realize self-cleaning. Thus, the service life of the heating member 21 and the electronic components in the battery device 10 is improved.

In the second embodiment, a portion of the lower surface of the bottom base 15 away from the air inlet opening 152 forms as the cooperating portion 153, the detection assembly 25 includes a state detection circuit (not shown), the state detection circuit is configured to detect the installation state of the cartridge 10. When the cartridge 10 is installed on the battery device 20, the state detection circuit cooperates with the cooperating portion 153 to be in a conducting state; when the cartridge 10 is removed from the battery device 20, the state detection circuit loses cooperation with the cooperating portion 153 and is in a disconnected state. The disconnection signal of the state detection circuit corresponds to the separation signal generated when the cartridge 10 is removed from the battery device 20. In this embodiment, a switch element 653 is provided in the state detection circuit, when the cartridge 10 is installed on the battery device 20, the cooperating portion 153 drives the switch element 653 to turn on the state detection circuit. When the cartridge 10 is removed from the battery device 20, the switch element 653 is separated from the cooperating portion 153 and reset, so that the state detection circuit is disconnected to generate a separation signal.

Figure 13:
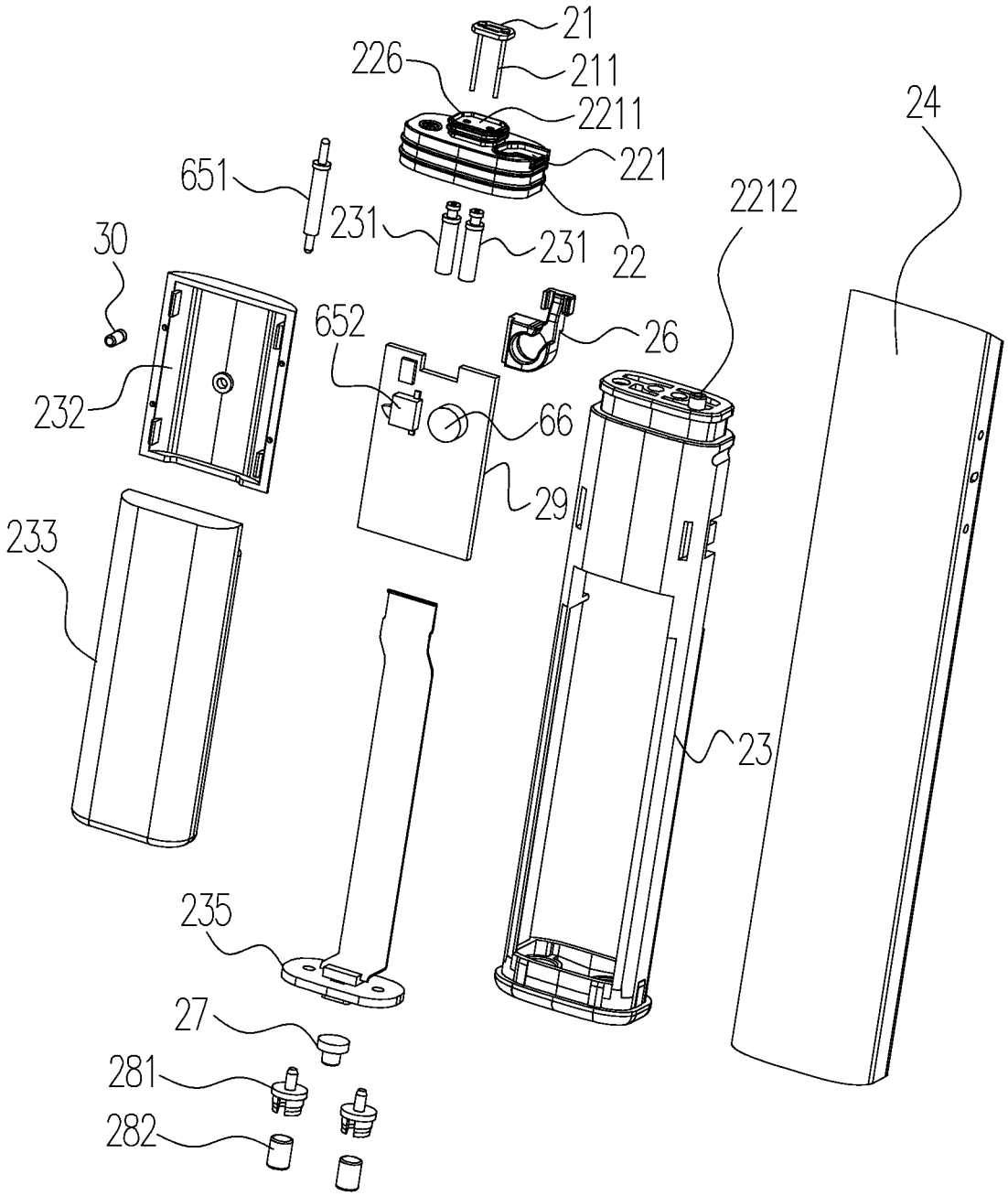
FIG. 13 is an exploded view of the battery device of the electronic cigarette shown in FIG. 9 from another perspective.

Please refer to FIG. 13, in actual implementation, the switch element 653 includes an ejector pin 651 and a switch button 652, and the battery device 20 is provided with an installation through hole (not shown) for installing the ejector pin on the installation side. The ejector pin 651 is inserted in the installation through hole, and the ejector pin 651 protrudes outwards from the bracket sealing member 62 corresponding to the position of the cooperating portion 153 of the cartridge 10. The ejector pin 651 is connected with an elastic member and can automatically reset after the external force is removed. The switch button 652 is arranged on the first control board 29 where the state detection circuit is located and corresponds to the position of the ejector pin 651. The switch button 652 is connected with an elastic member and can automatically reset after the external force is removed. When the cartridge 10 is installed on the battery device 20, the cooperating portion 153 presses the switch button 652 to a closed position through the ejector pin 651. When the cartridge 10 is removed from the battery device 20, the ejector pin 651 is reset under the action of its corresponding elastic member, and the switch button 652 is reset to an opened position under the action of its corresponding elastic member, at this time, the state detection circuit is disconnected and a separation signal is generated. The elastic member connected to the ejector pin 651 can be omitted, and the switch button 652 can drive the ejector pin 651 to reset when the switch button 652 is reset to the opened position under the action of its corresponding elastic member. The cooperating portion 153 capable of pushing the ejector pin 651 can be a surface or a groove or a protrusion of the bottom base 15 of the cartridge 10, as long as the ejector pin 651 can be pressed down with the movement of the cartridge 10, there is no restriction on the shape of the cooperating portion 153. It is understood that, the reset member that drives the ejector pin 651 and the switch button 652 to reset may be other members in addition to the elastic member, for example, magnetic member. Specifically, a pair of magnetic members that repel each other magnetically are provided in the switch button 652. In the natural state, under the action of repulsive force, the switch button 652 is in the opened position; when the ejector pin 651 presses the switch button 652, the switch button 652 is pressed to the closed position by overcoming the repulsive force.

It is understood that, the structure of the switch element 653 of this embodiment is not limited to this, for example, the switch element 653 is only a switch button, at the same time, the cooperating portion 153 provided on the cartridge 10 is an ejector rod. When the cartridge 10 is installed, the ejector rod on the cartridge 10 can press the switch button to its closed position. When the cartridge 10 is removed from the battery device 20, the ejector rod leaves from the switch button, and the switch button is reset under the action of its corresponding elastic member to disconnect the state detection circuit. Or, the switch element 653 is only a switch button, the top end of the switch button protrudes out of the bracket sealing member 22, and at the same time, the cooperating portion 153 provided on the cartridge 10 is a flat surface or a groove. When the cartridge 10 is installed, the cartridge 10 can directly press the switch button to its closed position; and when the cartridge 10 is removed from the battery device 20, the cartridge 10 leaves from the switch button, and the switch button is reset under the action of its corresponding elastic member to disconnect the state detection circuit.

The battery device 20 is provided with a state detection circuit and a resettable switch element 653, which can cooperate with the cooperating portion 153 of the cartridge 10 to generate a signal when the cartridge 10 is removed, so that the electronic cigarette can automatically remove the residue on the heating member 21 when the cartridge 10 is removed, so as to realize self-cleaning. Thus, the service life of the heating member 21 and the electronic components in the battery device 20 is improved.

In the above two embodiments, the cooperating portion is in contact with the detection assembly when the cartridge is installed on the battery device, and is separated from the detection assembly when the cartridge is removed from the battery device. The detection assembly is configured to generate a separation signal when it is separated from the cooperating portion, and generate a connection signal when it is in contact with the cooperating portion. It is understood that, in other embodiments not shown, the cooperating portion and the detection assembly may also adopt other matching methods, as long as the cartridge is removed from the battery device, the detection assembly generates a separation signal, and when the cartridge is connected to the battery device, the detection assembly generates a connection signal. For example, the cooperating portion and the detection assembly are always not in contact with each other, specifically, the detection assembly includes a light source and a light sensor. When the cartridge is installed on the battery device, the light beam generated by the light source is reflected by the cooperating portion, so that the light sensor detects the light beam and the light sensor generates a connection signal. When the cartridge is removed, the light beam is not reflected, so that the light sensor detects no light beam and the light sensor generates a separation signal.

Figure 12:
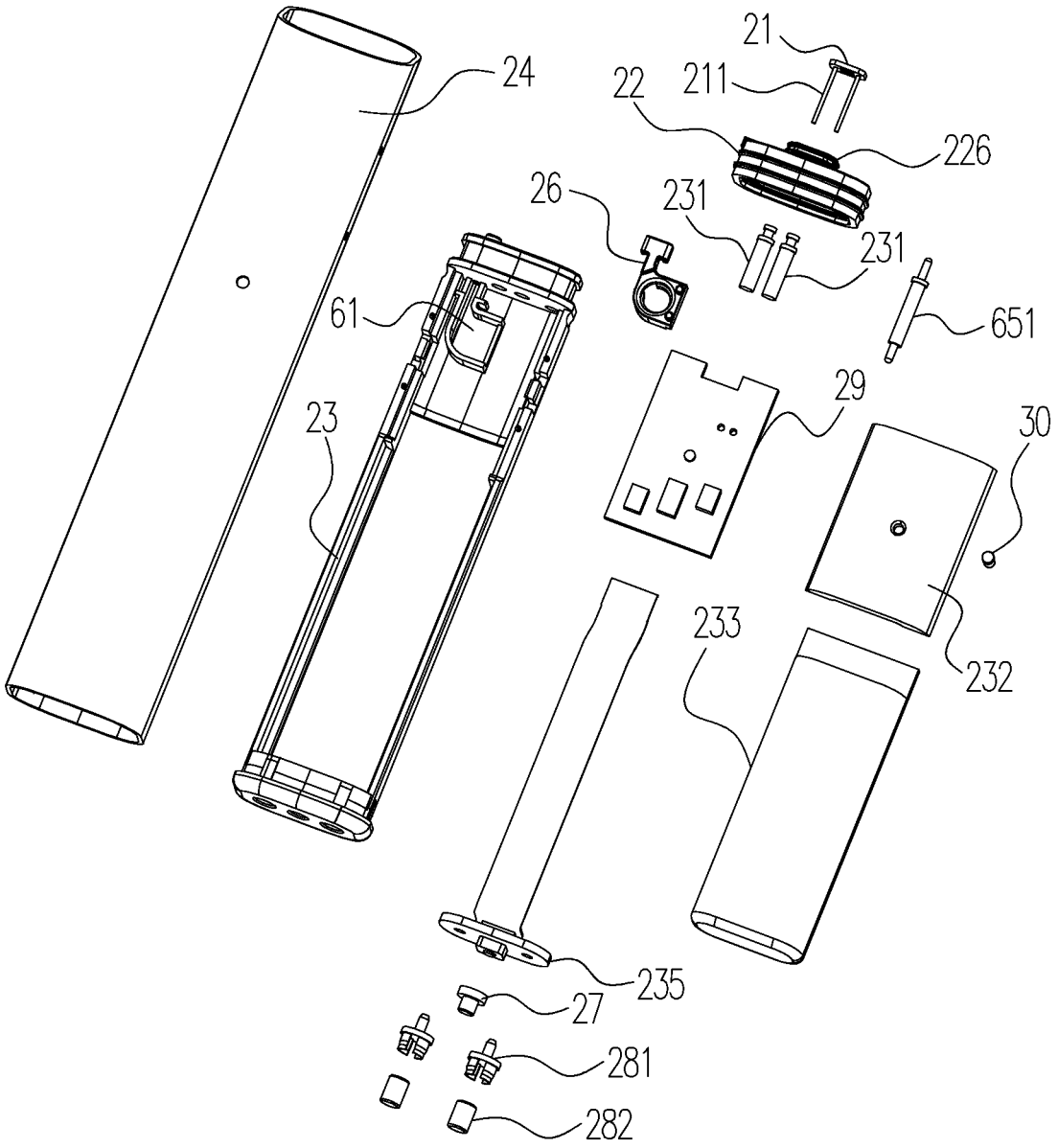
FIG. 12 is an exploded view of the battery device of the electronic cigarette shown in FIG. 9.

Please refer to FIG. 12 and FIG. 13 again, a hollow cavity 61 is provided in the battery bracket 23, the battery device 20 further includes a sensor sealing member 26 and a sensor 66. The sensor 66 is connected to the first control board 29 and installed in the sensor sealing member 26 and received in the hollow cavity 61. The hollow cavity 61 is in communication with the suction nozzle 13. The sensor 66 is configured to detect the airflow state in the hollow cavity 61. When the air in the hollow cavity 61 is sucked out under the suction action of the user, a negative pressure is generated in the hollow cavity 61, the sensor 66 generates an airflow signal, and the first control board 29 controls the heating member 21 to perform atomization work according to the airflow signal. In this way, when the state detection circuit is turned on, the electronic cigarette confirms that the cartridge 10 is in the installed state, and at this time, whether the user is performing a suction operation can be determined according to the airflow signal of the sensor 66. When the user sucks the electronic cigarette, the air in the hollow cavity 61 is sucked out, the hollow cavity 61 is in a negative pressure state, and the airflow signal generated by the sensor 66 is at a high level. At this time, the first control board 29 controls the battery 233 to supply power to the heating member 21, so that the heating member 21 is energized to generate heat to perform atomization work. It should be noted that after the first control board 29 receives the separation signal that the cartridge 10 is removed from the battery device 20, it indicates that the cartridge 10 has been removed, at this time, even if the airflow signal detected is at a high level, the first control board 29 does not control the battery 233 to supply power to the heating member 21, that is, the heating member 21 cannot perform atomization work, which can effectively play a child protection function and prevent the battery device 20 from being triggered by mistake when only the opening of the battery device 20 is sucked. In this embodiment, the sensor 66 is an airflow sensor, which is configured to generate an airflow signal when the airflow is flowing. It is understood that, in other embodiments not shown, the sensor 66 is an air pressure sensor, which is configured to generate an airflow signal when a negative pressure is generated in the hollow cavity 61 when the air flows out. It is understood that, when the type of the sensor 66 is different, the relevant information of the airflow used for detection is different, which may be the flow rate of the airflow or the change in the air pressure caused by the flowing of the airflow. The sensor 66 generates an airflow signal when detecting the corresponding information about the airflow. It is understood that, the above-mentioned airflow signal constitutes a suction signal, that is, when the detection assembly 25 generates the connection signal and also the sensor 66 generates the suction signal, the first control board 29 controls the battery 233 to supply power to the heating member 21, so that the heating member 21 performs atomization work.

Figure 9:
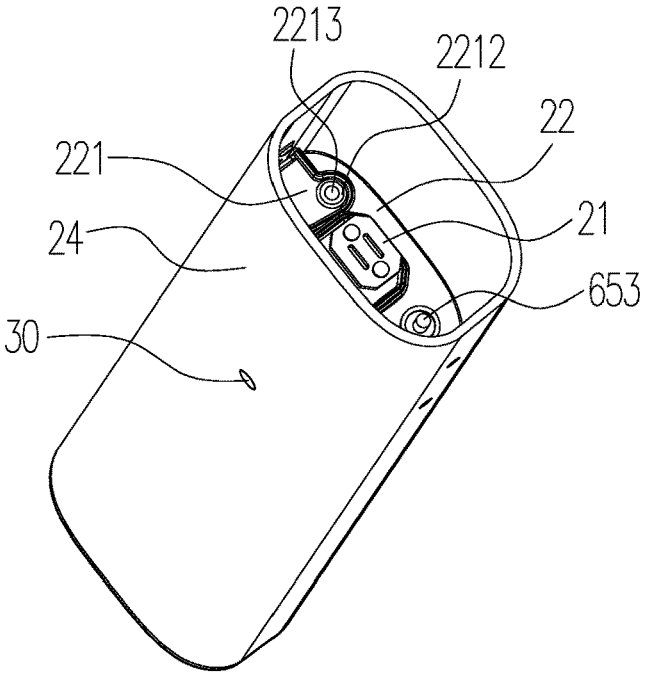
FIG. 9 is a perspective view of the battery device of the electronic cigarette shown in FIG. 1.
Figure 10:
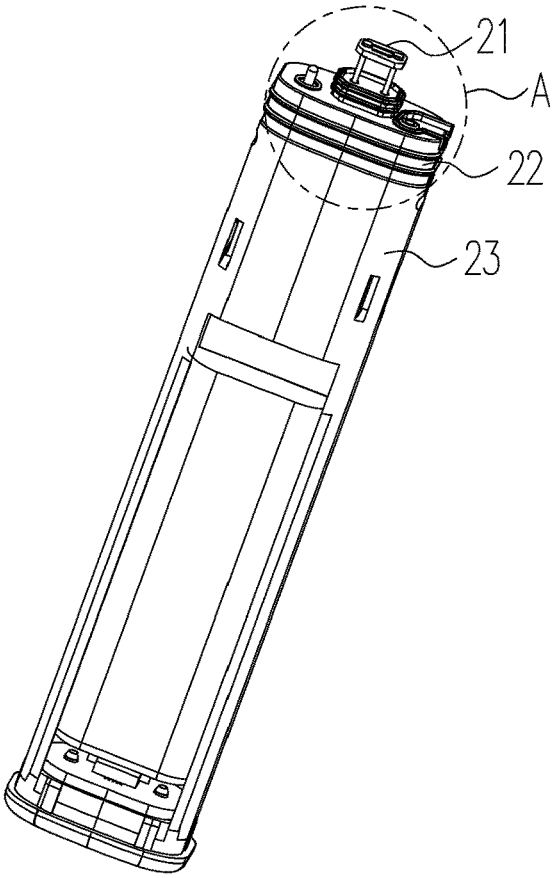
FIG. 10 is another perspective view of the battery device of the electronic cigarette shown in FIG. 1 (the battery casing is omitted)
Figure 11:
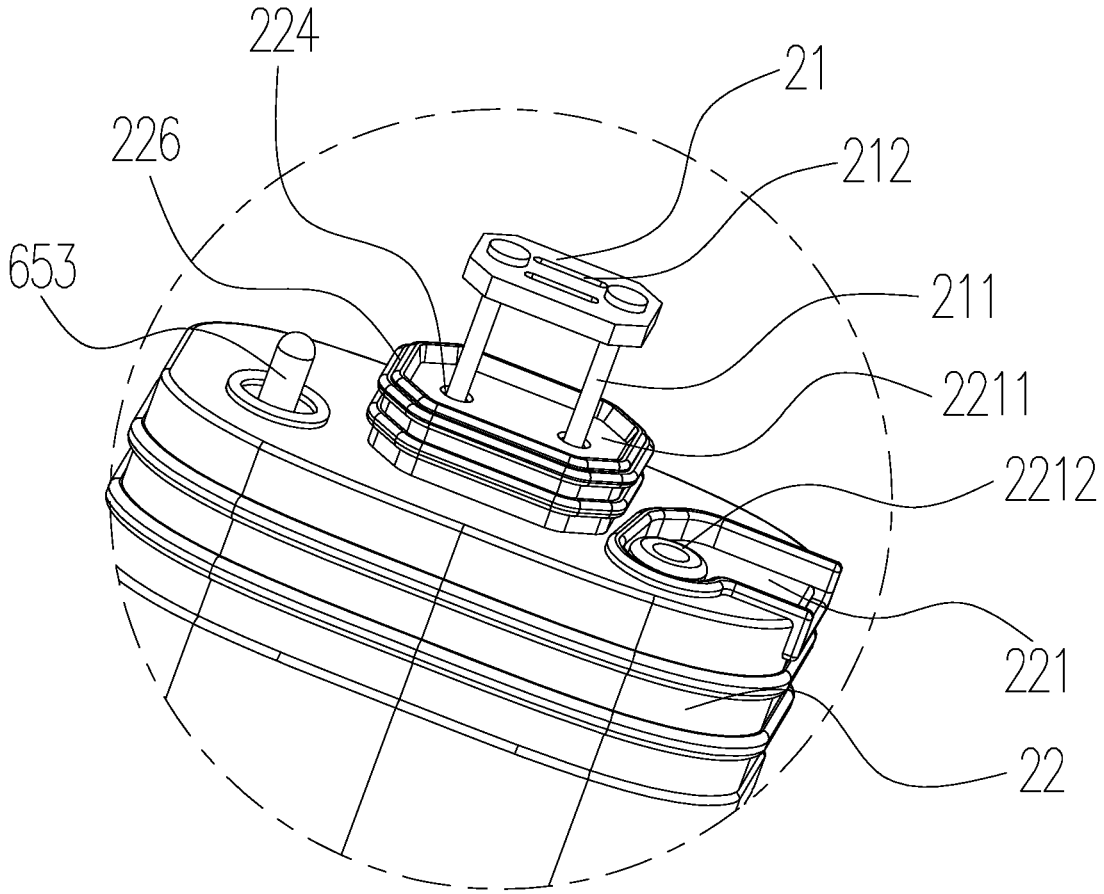
FIG. 11 is a partially enlarged view of the portion A in the battery device of the electronic cigarette shown in FIG. 10.

Please refer to FIGS. 9, 10 and 11, the center portion of the upper surface of the bracket sealing member 22 extends upward to form a protrusion 226 along the axial direction of the bracket sealing member 22. The top of the protrusion 226 is recessed downward to form a liquid collecting groove 2211. The top of the liquid collecting groove 2211 is provided with two insertion holes 224 passing through the upper and lower surfaces of the bracket sealing member 22. The two pins 211 of the heating member 21 respectively pass through the insertion holes 224, and then are electrically connected to the corresponding conductive posts 231. In actual use, the condensate generated when the smoke is cooled can be collected in the liquid collecting groove 2211 to prevent the condensate from entering the inside of the battery device 20 and causing damage to other components. In addition, the liquid collecting groove 2211 is arranged at a predetermined distance from the heating member 21. The heat generated after the heating member 21 is energized can atomize the condensate in the liquid collecting groove 2211 to achieve a cleaning effect on the condensate in the liquid collecting groove 2211. In addition, it should be noted that when the cartridge 10 is installed in place, the protrusion 226 is inserted into the atomizing cavity 151, and the cavity wall of the atomizing cavity 151 is in contact with the outer surface of the protrusion 226. In this way, the condensate in the atomizing cavity 151 can only enter the liquid collecting groove 2211, and will not leak to other places.

The upper surface of the bracket sealing member 22 is provided with an air inlet aperture 221 on one side of the protrusion 226, and the air inlet aperture 221 corresponds to the air inlet opening 152. An air vent hole 245 is provided in the side wall of the battery casing 24, the air vent hole 245 is in communication with the outside environment and the air inlet aperture 221. A sensing tube 2212 is formed by protruding from the upper surface of the battery bracket 23, and the sensing tube 2212 has a tubular structure with both ends passing through. The inner cavity of the sensing tube 2212 forms a sensing channel 2213, the lower end of the sensing channel 2213 is in communication with the hollow cavity 61, the upper end of the sensing tube 2212 passes through the bracket sealing member 22 and extends into the air inlet aperture 221. When the cartridge 10 and the battery device 20 are installed in place, the air inlet aperture 221 and the sensing channel 2213 are both in communication with the air inlet opening 152. When the user sucks the electronic cigarette, the external air enters the air inlet aperture 221 through the air vent hole 245, taking away the air in the hollow cavity 61 when flowing through the upper opening of the sensing channel 2213, and then flows out from the air inlet opening 152, the communication groove 155, the atomizing cavity 151, the air guiding groove 157, the air guiding portion 168, the airflow channel 165 and the smoke outlet 131, so that a negative pressure is generated in the hollow cavity 61, and the sensor 66 generates an airflow signal. At this time, the first control board 29 controls the battery 233 to supply power to the heating member 21, so that the heating member 21 is energized to generate heat to perform atomization work. The external air flowing into the atomizing cavity 151 can carry out the smoke through the air guiding groove 157, the air guiding portion 168, the airflow channel 165 and the smoke outlet 131 for the user to inhale. In addition, a waterproof and breathable membrane (not shown) can be installed at the upper opening of the sensing tube 2212, so that the condensate cannot enter the hollow cavity 61 to prevent the condensate from contacting the sensor 66. The air in the hollow cavity 61 can be sucked smoothly, so that the sensor 66 detects the relevant information of the airflow. It is understood that, the waterproof and breathable membrane may also be arranged in other positions, as long as the sensor 66 is isolated from the air inlet opening 152. For example, the waterproof and breathable membrane may be provided in the hollow cavity 61 or in the sensing channel 2213. It is understood that, in other embodiments not shown, a deforming member can be provided corresponding to the opening of the hollow cavity 61, and the sensor 66 is located in the space enclosed by the deforming member and the hollow cavity 61. When the user sucks, the deforming member deforms, the volume of the space increases, so that the air pressure in the space decreases, the sensor 66 detects the change in the air pressure and generates a corresponding airflow signal; when the suction is stopped, the deforming member recovers, and the air pressure in the space recovers. The deforming member can isolate liquids such as condensate or leaked e-liquid from the hollow cavity 61.

Please refer to FIG. 2 again, in this embodiment, the opening of the battery casing 24 is set as an oblique opening, and one of the surfaces of the suction nozzle 13 is correspondingly set as an inclined surface. When the cartridge 10 and the battery device 20 are installed in place, the oblique opening of the battery casing 24 and the oblique surface of the suction nozzle 13 are engaged with each other. In this way, when the cartridge 10 is installed, the cartridge 10 can only be inserted into the accommodating cavity 242 in a single direction, to ensure that after the cartridge 10 is inserted, the sensing channel 2213 is corresponding to the air inlet opening 152. Specifically, the battery casing 24 has a first end (not labelled) and an opposite second end (not labelled), and the second end is an open end. The cartridge 10 is detachably inserted into the battery casing 24 through the open end. In order to prevent the user from arbitrarily touching the heating member 21 to cause undesired scalding, the distance from the lowest point of the open end to the upper surface of the heating member 21 is greater than zero, so that the heating member 21 is located inside the accommodating cavity 242. The size of the open end is relatively small, so that it is difficult for the user's fingers to extend into, thereby preventing the user from contacting the heating member 21. The battery casing 24 has a first limiting portion (not labeled) and a second limiting portion (not labeled). The distance from the first limiting portion to the first end is smaller than the distance from the second limiting portion to the first end. Correspondingly, the suction nozzle 13 is provided with a first positioning portion (not labeled) and a second positioning portion (not labeled). The distance from the first positioning portion to the suction end is greater than the distance from the second positioning portion to the suction end. When the cartridge 10 and the battery device 20 are installed in place, the first positioning portion resists the first limiting portion, and the second positioning portion resists the second limiting portion. When installing, if the first positioning portion is aligned with the second limiting portion and the second positioning portion is aligned with the first limiting portion, then the cartridge 10 cannot be installed in place. In this embodiment, two opposite surfaces of the battery casing 24 constitute a first limiting surface and a second limiting surface. Both the first limiting surface and the second limiting surface extend from the first end to the second end along the axial direction of the battery device 20, and the distance of the first limiting surface extending along the axial direction of the battery device 20 is smaller than the distance of the second limiting surface extending along the axial direction of the battery device 20. The side of the first limiting surface at the second end is the first limiting portion, and the side of the second limiting surface at the second end is the second limiting portion. Correspondingly, two opposite surfaces of the suction nozzle 13 constitute a first positioning surface and a second positioning surface. The first positioning surface and the second positioning surface both extend along the axial direction of the cartridge 10 from the suction end, and the distance of the first positioning surface extending along the axial direction of the cartridge 10 is greater than the distance of the second positioning surface extending along the axial direction of the cartridge 10. The side of the first positioning surface away from the suction end is the first positioning portion, and the side of the second positioning surface away from the suction end is the second positioning portion. It is understood that, in other embodiments, the first limiting portion and the second limiting portion may also be arranged in other ways, as long as they are not arranged symmetrically along the central axis of the battery device 20. Similarly, the first positioning portion and the second positioning portion only need to be arranged not axially symmetrically along the central axis of the cartridge 10. For example, the first limiting portion and the second limiting portion may be located on the same side of the open end of the battery casing 24. Specifically, the side is an inclined edge, the lower portion of the inclined edge is the first limiting portion, and the higher portion of the inclined edge is the second limiting portion. Correspondingly, the first positioning portion and the second positioning portion are located on the same side of the suction nozzle 13 away from the suction end. The side is an inclined edge. The portion of the inclined edge farther from the suction end is the first positioning portion, and the portion of the inclined edge closer to the suction end is the second positioning portion.

Please refer to FIG. 11 again, in a specific embodiment, the heating member 21 is provided with at least one slot 212 passing through the upper and lower surfaces of the heating member 21 to facilitate the flowing of the smoke to pass through the heating member 21. On the other hand, when the cartridge 10 is installed in place, the liquid suction member 17 can be deformed under the action of external force and partially retained in the slot 212. In this way, the liquid suction member 17 can not only contact the surface of the heating member 21, but also contact the inner wall of the slot 212, to increase the contact area between the heating member 21 and the liquid suction member 17, and accordingly, to improve the atomization efficiency. The length of the slot 212 is 1-2 mm, and the width of the slot 212 is 0.2-0.5 mm. On the one hand, the length of the slot 212 needs to be shorter than the maximum length of the heating member 21, and the two ends of the heating member 21 are left for mounting the pins 211. On the other hand, the width of the slot 212 is relatively small, which can prevent the e-liquid from leaking through the slot 212.

In addition, the heating member 21 is in the shape of a sheet, and the thickness of the heating member 21 is in the range of 0.2-3 mm. In a specific embodiment, the thickness of the heating member 21 is in the range of 0.45-0.55 mm. If the heating member 21 is too thick, it is not conducive to heat conduction. If the heating member 21 is too thin, the strength is insufficient, and the heating member 21 is easily broken. The maximum width of the heating member 21 can be selected in the range of 1.5-4.5 mm. In a specific embodiment, the selection range of the maximum width of the heating member 21 is 2.5-3.5 mm. The maximum length of the heating member 21 can be selected in the range of 2.5-13.5 mm. In a specific embodiment, the selection range of the maximum length of the heating member 21 is 4-5 mm. When the maximum width and the maximum length of the heating member 21 are within the above ranges, it can ensure that the heating member 21 smoothly passes through the lower opening of the atomizing cavity 151, and the heating member 21 has a sufficient heating area. There are through holes (not labeled) on both sides of the heating member 21, the slot 212 is located between the through holes, the pins 211 are inserted into the through holes and then fixedly welded to the heating member 21. The pin 211 is made of a hard material, so that during the installation process of the cartridge 10, the heating member 21 will not be deformed or deviated due to compression.

Figure 14:
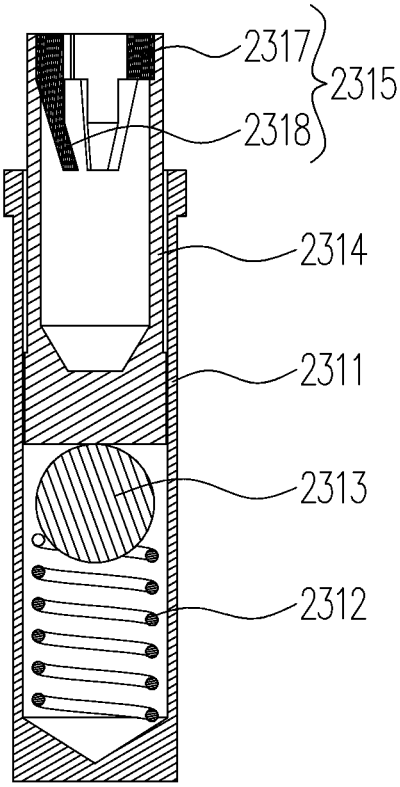
FIG. 14 is a schematic view of the conductive post in the battery device shown in FIG. 12.

In addition, please refer to FIG. 14, the conductive post 231 configured to install the heating member 21 is an elastic conductive post. Thus, during installation, the heating member 21 and the liquid suction member 17 are in elastic contact, so that a certain processing error can be allowed to ensure that the heating member 21 and the liquid suction member 17 are in contact with each other. In a specific embodiment, the conductive post 231 includes a first connecting portion and a second connecting portion, the first connecting portion is fixed to the heating member 21, and the second connecting portion is fixed to the battery device main body. The first connecting portion can move away from or toward the second connecting portion under the action of external force. Specifically, the first connecting portion includes a fixing tube 2314 and a claw 2315 installed in one end of the fixing tube 2314, the second connecting portion is an outer sleeve 2311, and the fixing tube 2314 is movably arranged in the outer sleeve 2311. The conductive post 231 also includes an elastic member 2312 and an insulating member 2313 received in the outer sleeve 2311. One end of the elastic member 2312 elastically resists the lower end of the outer sleeve 2311, and the other end of the elastic member 2312 elastically resists the insulating member 2313. The lower end of the fixing tube 2314 is in contact with the insulating member 2313. When the fixing tube 2314 is pressed, the fixing tube 2314 compresses the elastic member 2312 through the insulating member 2313 and then retracts into the outer sleeve 2311. When the pressing force on the fixing tube 2314 is released, the fixing tube 2314 moves upward under the restoring action of the elastic member 2312 to partially extend out of the outer sleeve 2311. The claw 2315 includes a collar 2317 fixedly connected to the inner wall of the fixing tube 2314 and a clamping portion 2318 installed on the lower end of the collar 2317. One end of the clamping portion 2318 opposite to the collar 2317 is bent toward the central axis of the collar 2317, so that the clamping portion 2318 is an elastic member. When the pin 211 of the heating member 21 is installed, the pin 211 passes through the collar 2317 and is squeezed by the clamping portion 2318 to realize the fixing of the heating member 21, which is simple and convenient to operate. In addition, the insulating member 2313 is disposed between the elastic member 2312 and the fixing tube 2314, so that the elastic member 2312 and the fixing tube 2314 are isolated from each other by the insulating member 2313 without contacting with each other, and the insulating member 2313 is made of an insulating material. The size of the conductive post 231 is relatively small, so that the elastic member 2312 installed inside the conductive post 231 is very small. Assuming that a current flows through the elastic member 2312, the elastic member 2312 is easily broken. Under the action of the insulating member 2313, when it is energized, the current does not flow through the elastic member 2312, but flows through the outer sleeve 2311, the fixing tube 2314 and the claw 2315, to prevent the phenomenon that the current flows through the elastic member 2312 when the heating member 21 is working and the elastic member 2312 is energized to generate heat and cause damage. On the other hand, the insulating member 2313 is an insulating ball, which can limit the elastic member 2312 and prevent the position of the elastic member 2312 from shifting during multiple pressing and restoring processes to cause the elastic member 2312 to fail. It is understood that, the elastic member 2312 includes, but is not limited to, spring, stainless steel sheet, or copper sheet that have elasticity and rigidity.

Figure 15:
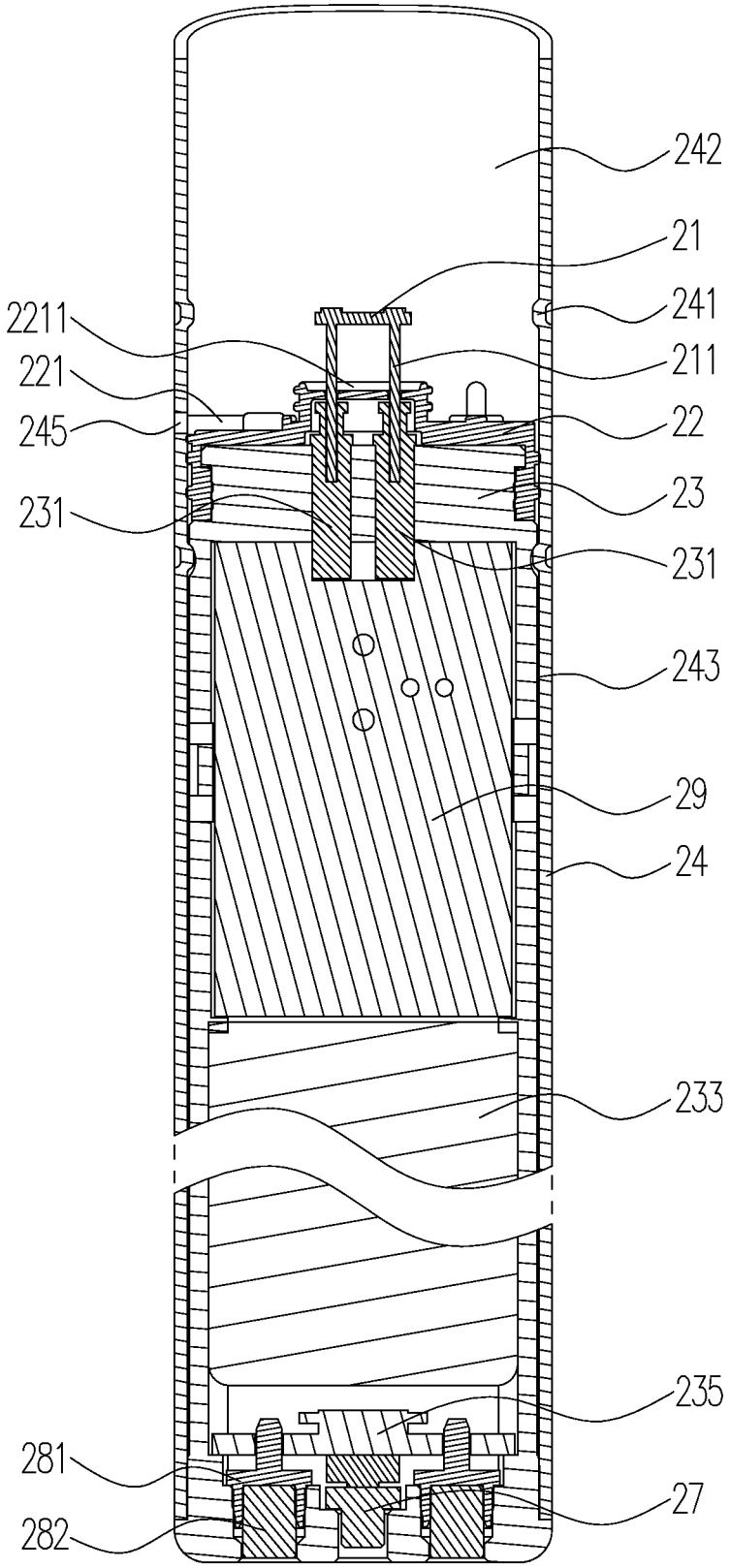
FIG. 15 is a cross-sectional view of the battery device of the electronic cigarette shown in FIG. 9.
Figure 16:
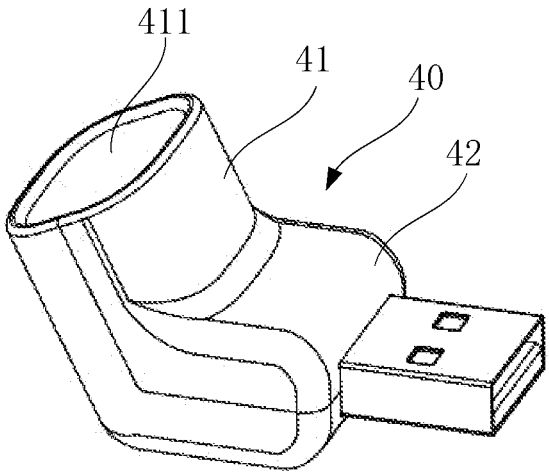
FIG. 16 is a schematic view of the charging base of the electronic cigarette shown in FIG. 1.
Figure 17:
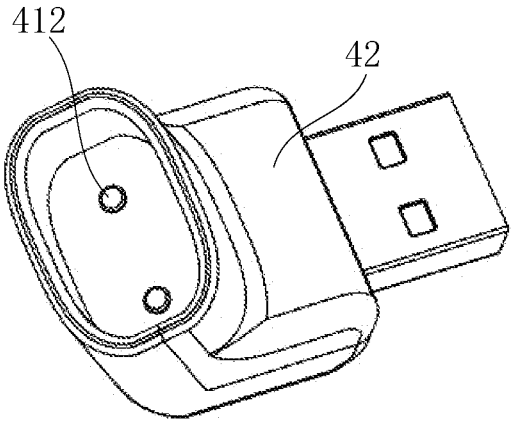
FIG. 17 is another schematic view of the charging base of the electronic cigarette shown in FIG. 1.

Please refer to FIG. 12, FIG. 13 and FIG. 15, in the present application, the battery 233 is a rechargeable battery. The battery device 20 is provided with a charging connection portion (not labeled) on one end away from the heating member 21. The charging connection portion includes a second control board 235, a connecting post 281 and a contacting electrode 282. The contacting electrode 282 is connected to the second control board 235 through the connecting post 281. The battery bracket 23 is provided with a through hole for exposing the contacting electrode 282. Correspondingly, please refer to FIGS. 16 and 17, a charging base 40 for charging the battery 233 is provided with an electronic cigarette connection part 41 and a power connection part 42. The electronic cigarette connection portion 41 is provided with an electronic cigarette insertion slot 411 and a charging post 412 located in the electronic cigarette insertion slot 411. The electronic cigarette insertion slot 411 is configured to fix the electronic cigarette. The charging post 412 is configured to electrically connect with the contacting electrode 282 on the battery device 20. The power connection part 42 is provided with a charging interface, such as a USB interface or a plug. There is a preset angle θ between the electronic cigarette connection part 41 and the power connection part 42, wherein $90° < \theta < 180°$, for example, the preset angle θ is 155°, which can prevent the electronic cigarette from interfering with the protruding objects on the wall during charging, and is also convenient for the user to access.

Please refer to FIG. 12, FIG. 13 and FIG. 15 again, in order to allow the user to remove the residue on the heating member 21 according to their needs, in this embodiment, the battery device 20 is further provided with an operating switch 27. The operating switch 27 is connected to the second control board 235, and is configured to trigger the second control board 235 to control the heating member 21 to work according to the preset parameters under the operation of the user to remove the residue on the heating member 21. The lower end of the battery bracket 23 is provided with a through hole for accommodating the operating switch 27. When the self-cleaning function needs to be used, the user can use a tool to extend into the through hole and press the operating switch 27 to trigger it. The operating switch 27 is concealed, so that misoperation can be avoided.

In addition, please refer to FIG. 1, FIG. 12 and FIG. 13, in order to facilitate the user to understand the use status of the electronic cigarette, the battery device 20 is further provided with an indicator 30. The indicator 30 is fixed on the battery bracket 23 through a support cover 232, and is connected to the first control board 29. The battery casing 24 is provided with a through hole for observing the indicator 30.

The control method of the electronic cigarette of the above embodiments will be described in detail below.

Figure 19:
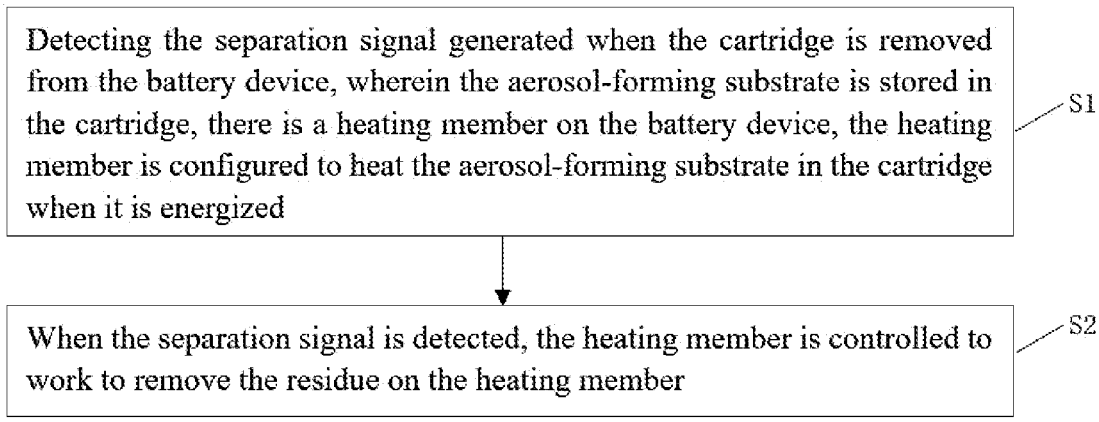
FIG. 19 is a flowchart of the control method of the electronic cigarette shown in FIG. 1.

Please refer to FIG. 19, the control method of the electronic cigarette of this embodiment includes but not limited to the following steps:

Step S1, detecting the separation signal generated when the cartridge is removed from the battery device, wherein the aerosol-forming substrate is stored in the cartridge, there is a heating member on the battery device, the heating member is configured to heat the aerosol-forming substrate in the cartridge when it is energized;

Step S2, when the separation signal is detected, the heating member is controlled to work to remove the residue on the heating member.

The electronic cigarette of the present application includes a cartridge and a battery device, the cartridge and the battery device are detachably connected. An aerosol-forming substrate is stored in the cartridge, and the aerosol-forming substrate can be e-liquid, tobacco paste, tobacco shreds, and other substances that can produce inhalable smoke. The battery device is provided with a heating member, and the heating member is configured for heating the aerosol-forming substrate in the cartridge to form smoke when it is energized. When the cartridge is removed from the battery device, the cartridge is separated from the heating member. At this time, the heating member may be adhered with the residue left during use. The residue is, for example, the aerosol-forming substrate remaining on the heating member or the carbide produced by heating. In one embodiment, the aerosol-forming substrate is e-liquid. The cartridge is provided with a corresponding liquid-suction member to supply the e-liquid to the heating member. When the cartridge is installed on the battery device, the liquid suction member is in contact with or close to the heating member, so that the e-liquid stored in the cartridge can be supplied to the heating member for atomization.

Corresponding to the above-mentioned first embodiment, when the first sensor and the second sensor are provided on the battery device, the step of detecting the separation signal generated when the cartridge is removed from the battery device includes:

Obtaining the first airflow signal of the first sensor and the second airflow signal of the second sensor, wherein the first sensor is arranged in the first cavity of the battery device, the second sensor is arranged in the second cavity of the battery device, the first cavity is in communication with the airflow channel of the electronic cigarette and is isolated from the second cavity, the second cavity is in a closed state when the cartridge is installed on the battery device and is in an open state after the cartridge is removed from the battery device;

If the first airflow signal is at a low level and the second airflow signal is at a high level, the separation signal generated when the cartridge is removed from the battery device is detected.

The first sensor is arranged in the first cavity of the battery device, the second sensor is arranged in the second cavity of the battery device, the first cavity is in communication with the airflow channel of the electronic cigarette, the first cavity and the second cavity are not in communication with each other and isolated from each other, the second cavity is in a closed state when the cartridge is installed on the battery device and in an open state after the cartridge is removed from the battery device. In actual implementation, the cartridge is provided with a sealing portion, the sealing portion is inserted into the opening of the second cavity and seals the opening when the cartridge is installed on the battery device. In this way, when the cartridge is removed from the battery device, the withdrawal of the sealing portion will generate negative pressure in the second cavity and cause airflow disturbance. The second airflow signal of the second sensor is a high-level signal. At the same time, since the user will not suck when removing the cartridge, there is no airflow through the airflow channel of the electronic cigarette, and the air pressure in the first cavity will not change when the cartridge is pulled out. Therefore, the first airflow signal of the first sensor is a low level signal. Thus, when the first airflow signal is at a low level and the second airflow signal is at a high level, it can be confirmed that the cartridge is currently being removed from the battery device. The first airflow signal is at a low level and the second airflow signal is at a high level, which is equivalent to the separation signal of the cartridge being removed from the battery device.

When the separation signal is detected, the electronic cigarette controls the heating member to work to remove the residue on the heating member. In actual implementation, the electronic cigarette controls the heating member to work according to preset parameters, thereby starting the self-cleaning mode to remove the residue on the heating member. The preset parameters include one of a preset working voltage, a preset temperature and a preset power, and a preset working time. The preset working voltage is greater than the working voltage when the electronic cigarette is in the smoking state, the preset working voltage can also be equal to the current output voltage of the battery. The preset temperature is greater than the working temperature when the electronic cigarette is in the smoking state. The working temperature is the atomizing temperature of the heating member when it is working normally. The preset power is greater than the working power when the electronic cigarette is in the smoking state. The working power is the atomizing power when the heating member is working normally. By adopting a higher working voltage, working temperature or working power, the adhered residue can be quickly removed in a short time. The preset working time is a relatively short time, for example, 1 second. Of course, in actual implementation, when the heating member is controlled to work according to the corresponding working parameters when the electronic cigarette is in the smoking state, the residue on the heating member can also be removed, the only difference lies in the length of time for removal.

When the battery device is provided with the first sensor and the second sensor respectively located in the first cavity and the second cavity, the control method of the electronic cigarette may further include the following steps:

If the first airflow signal and the second airflow signal are both low or both high, the heating member is controlled not to work.

Among them, if the first airflow signal and the second airflow signal are both low, it means that the electronic cigarette is in an idle state and the heating member does not work. When the electronic cigarette is sucked without a cartridge, there will be airflow in both the first cavity and the second cavity, and the first airflow signal and the second airflow signal are both high. If a child obtains the electronic cigarette and sucks the electronic cigarette, controlling the heating member to work will cause scalding. Therefore, when the first airflow signal and the second airflow signal are both at a high level, the heating member does not work.

When the battery device is provided with the first sensor and the second sensor respectively located in the first cavity and the second cavity, the control method of the electronic cigarette may further include the following steps:

If the first airflow signal is at a high level and the second airflow signal is at a low level, the heating member is controlled to work according to the corresponding working parameters when the electronic cigarette is in the smoking state.

Among them, when the user sucks the electronic cigarette, there is an airflow in the airflow channel of the electronic cigarette, and the airflow signal generated by the first sensor is at a high level. At this time, combined with the airflow signal of the second sensor, it can determine whether the cartridge is currently in the installed state. When the user sucks the electronic cigarette, the second sensor cannot detect the change of airflow only when the second cavity is in a closed state. It can be seen that if the second airflow signal is at a low-level signal at this time, it indicates that the second cavity is in a closed state and the cartridge is installed on the electronic cigarette. Therefore, when the first airflow signal is at a high level and the second airflow signal is at a low level, it indicates that the cartridge has been installed and the user is smoking. At this time, the electronic cigarette controls the heating member to work according to the corresponding working parameters when the electronic cigarette is in the smoking state, that is, controls the heating member to perform normal atomization work.

After the heating member is controlled to work according to the corresponding working parameters when the electronic cigarette is in the smoking state, the control method of the electronic cigarette may further include the following steps:

If the time when the resistance value of the heating member rises to a preset resistance value is less than a preset time period, the heating member is controlled to stop working;

If the time when the resistance value of the heating member rises to the preset resistance value is greater than or equal to the preset time period, the heating member is controlled to output power, and the resistance value of the heating member is maintained at the preset resistance value.

The preset resistance value is the atomizing resistance value of the electronic cigarette during the atomization work, which is the normal working resistance value. Usually, the electronic cigarette will set an atomizing temperature when it leaves the factory. The atomizing temperature corresponds to a resistance of the heating member. When the electronic cigarette is working, the battery device outputs voltage to the heating member to cause the heating member to work and monitors the resistance of the heating member in real time. When the resistance value of the heating member reaches the resistance value corresponding to the preset atomizing temperature, by controlling the output power, the resistance value of the heating member is stabilized at this resistance value, that is, the aforementioned atomizing resistance value. Of course, the atomizing resistance value can also be calculated according to the atomizing temperature or power actually set by the user. During the heating process of the electronic cigarette, if the time when the resistance value of the heating member rises to the preset resistance value is less than the preset time period, it means that the heating member heats too fast due to dry burning, and in order to protect the cartridge, it should stop heating at this time. If the time when the resistance value of the heating member rises to the preset resistance value is greater than or equal to the preset time period, the heating member is working normally, and at this time, by controlling the output power of the heating member, the resistance value of the heating member is stabilized at the preset resistance value. Stabilizing the resistance means that the deviation of the resistance of the heating member from the preset resistance is within a small range.

In another embodiment, corresponding to the above-mentioned second embodiment, when a state detection circuit is provided on the battery device, step S1 of detecting the separation signal generated when the cartridge is removed from the battery device, including:

Obtaining the on-off signal of the state detection circuit, wherein the state detection circuit is configured to detect the installation state of the cartridge, the state detection circuit is provided on the battery device, the state detection circuit is in a conducting state when the cartridge is installed on the battery device, the state detection circuit is in a disconnected state when the cartridge is removed from the battery device;

If the on-off signal is a disconnection signal, the separation signal generated when the cartridge is removed from the battery device is detected.

The state detection circuit is provided on the battery device to detect the installation state of the cartridge. In this embodiment, the state detection circuit is provided with a switch element for turning on and off the state detection circuit, the switch element includes an elastic member and a switch button connected to the elastic member. When the cartridge is installed on the battery device, the cartridge presses the switch button on the switch element by pressing the ejector pin provided on the battery device or by using the ejector rod provided on the cartridge, and the elastic member in the switch element is in a deformed state. The switch element is closed to turn on the state detection circuit. At this time, the on-off signal of the state detection circuit is the ON signal, that is, the state detection circuit changes from the OFF state to the ON state, then the electronic cigarette determines that the installation signal of the cartridge is detected or that the cartridge is in the installed state. When the cartridge is pulled out of the battery device, the cartridge no longer presses the ejector pin or ejector rod, the external force of the ejector pin or ejector rod on the switch button is removed, the elastic member in the switch element is restored, the switch button is reset, and the state detection circuit is disconnected. At this time, the on-off signal of the state detection circuit is the OFF signal, that is, the state detection circuit changes from the ON state to the OFF state, and the electronic cigarette detects the separation signal of the cartridge.

When the separation signal is detected, the electronic cigarette controls the heating member to work to remove the residue on the heating member. In actual implementation, the electronic cigarette controls the heating member to work according to preset parameters, thereby removing the residue on the heating member, wherein the preset parameters include one of a preset operating voltage, a preset temperature and a preset power, and a preset working time. The preset working voltage is greater than the working voltage when the electronic cigarette is in the smoking state. The preset working voltage can also be equal to the current output voltage of the battery. The preset temperature is greater than the working temperature when the electronic cigarette is in the smoking state, the working temperature is the atomizing temperature of the heating member when it is working normally. The preset power is greater than the working power when the electronic cigarette is in the smoking state. The working power is the atomizing power when the heating member is working normally. By adopting a higher working voltage, working temperature or working power, the adhered residue can be quickly removed in a short time. For example, the preset working time is a short time, such as 1 second. Of course, in actual implementation, the heating member is controlled to work according to the corresponding working parameters when the electronic cigarette is in the smoking state, and the residue on the heating member can also be removed.

When the battery device is provided with a state detection circuit and a sensor, the control method of the electronic cigarette may further include the following steps:

When the cartridge is in the installed state, obtaining the third airflow signal of the sensor, wherein the sensor is located in a cavity on the battery device, and the cavity is in communication with the airflow channel of the electronic cigarette;

If the third airflow signal is at a high level, the heating member is controlled to work according to the corresponding working parameters when the electronic cigarette is in the smoking state.

When the on-off signal of the state detection circuit on the battery device is the ON signal, the electronic cigarette confirms that the cartridge is in the installed state. At this time, it can determine whether the user is sucking according to the airflow signal of the sensor. When the user sucks the electronic cigarette, an airflow flows in the airflow channel of the electronic cigarette, and the airflow signal generated by the sensor is at a high level. At this time, the electronic cigarette controls the heating member to work according to the corresponding working parameters when the electronic cigarette is in the smoking state, that is, controls the heating member to perform normal atomization work. It should be understood that after detecting the separation signal that the cartridge is removed from the battery device, it determines that the cartridge has been removed and is in an uninstalled state, and at this time, even if the third airflow signal detected is at a high level, the heating member is not controlled to work.

After the heating member is controlled to work according to the corresponding working parameters when the electronic cigarette is in the smoking state, the control method of the electronic cigarette may further include the following steps:

If the time when the resistance value of the heating member rises to a preset resistance value is less than a preset time period, the heating member is controlled to stop working;

If the time when the resistance value of the heating member rises to the preset resistance value is greater than or equal to the preset time period, the heating member is controlled to output power, and the resistance value of the heating member is maintained at the preset resistance value.

The preset resistance value is the atomizing resistance value of the electronic cigarette during the atomization work, which is the normal working resistance value. Usually, the electronic cigarette will set an atomizing temperature when it leaves the factory. The atomizing temperature corresponds to a resistance of the heating member. When the electronic cigarette is working, the battery device outputs voltage to the heating member to cause the heating member to work and monitors the resistance of the heating member in real time. When the resistance value of the heating member reaches the resistance value corresponding to the preset atomizing temperature, by controlling the output power, the resistance value of the heating member is stabilized at this resistance value, that is, the aforementioned atomizing resistance value. Of course, the atomizing resistance value can also be calculated according to the atomizing temperature or power actually set by the user. During the heating process of the electronic cigarette, if the time when the resistance value of the heating member rises to the preset resistance value is less than the preset time period, it means that the heating member heats too fast due to dry burning, and in order to protect the cartridge, it should stop heating at this time. If the time when the resistance value of the heating member rises to the preset resistance value is greater than or equal to the preset time period, the heating member is working normally, and at this time, by controlling the output power of the heating member, the resistance value of the heating member is stabilized at the preset resistance value. Stabilizing the resistance means that the deviation of the resistance of the heating member from the preset resistance is within a small range.

In one embodiment, the control method of the electronic cigarette may further include the following steps:

Controlling the heating member to work according to the received preset operation signal to remove the residue on the heating member;

Obtaining the change rate of the resistance value of the heating member during the working process of the heating member;

If the resistance change rate is less than a preset change rate, controlling the heating member to stop working;

If the resistance change rate is greater than or equal to the preset change rate, controlling the heating member to work to remove the residue on the heating member.

Among them, a self-cleaning manual button is also provided at the bottom of the electronic cigarette. When the manual button is pressed, a preset operation signal for controlling the heating member to work is generated, and the heating member starts to heat for self-cleaning. The preset change rate refers to the change rate of the resistance value when the heating member is working to remove the residue when the cartridge is not installed. When the heating member works with preset parameters to remove the residue, the preset change rate refers to the change rate of the resistance value of the heating member when the heating member works with the preset parameters when the cartridge is not installed. In the process of self-cleaning, if the cartridge is still inserted on the electronic cigarette, the heating member will be adhered with more aerosol-forming substrate, so that the resistance change rate is less than the preset change rate. If the self-cleaning is continued at this time, the cartridge will be damaged. Thus, in order to ensure that the cartridge is in good condition, the heating member is controlled to stop working and stop self-cleaning. Conversely, if the resistance change rate is greater than or equal to the preset change rate, it is determined that the heating member is not in contact with the aerosol-forming substrate in the cartridge and the residue can be cleaned. At this time, the heating member is controlled to continue to work.

In the method of controlling the electronic cigarette of the present application, an aerosol-forming substrate is stored in the cartridge of the electronic cigarette, there is a heating member on the battery device. The heating member is configured to heat the aerosol-forming substrate in the cartridge when it is energized. When the separation signal that the cartridge is removed from the battery device is detected, the heating member is controlled to work to remove the residue on the heating member. In this way, the present application can automatically remove the residue on the heating member for self-cleaning when the cartridge is removed from the battery device, thereby improving the service life of the heating member.

Figure 28:
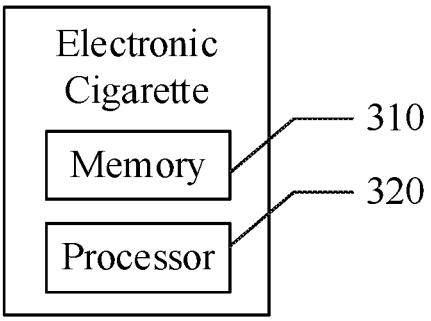
FIG. 28 is a block diagram of an electronic cigarette according to an embodiment of the present application.

FIG. 28 is a block diagram of an electronic cigarette in an exemplary embodiment of the present application. As shown in FIG. 28, the present application also provides an electronic cigarette, which includes a memory 310 and a processor 320, the memory 310 stores at least one program instruction, and the processor 320 loads and executes the at least one program instruction to implement the control method of the electronic cigarette as described above.

For the specific steps executed by the processor 320 in this embodiment, please refer to the description of the embodiments shown in FIG. 1 to FIG. 27, and details are not described herein again.

The present application also provides a computer storage medium on which computer program instructions are stored; when the computer program instructions are executed by a processor, the above-mentioned electronic cigarette control method is realized.

The aforementioned storage media include: U disk, mobile hard disk, read-only memory (Read-Only Memory, ROM), random access memory (Random Access Memory, RAM), magnetic disk, optical disk, or cloud, etc., which can store programs the medium of the code.

Please refer to the description of the embodiments shown in FIG. 1 to FIG. 27 for the specific steps of the computer program instructions stored in the computer storage medium of this embodiment when they are executed by the processor, which will not be repeated here.

Figure 29:
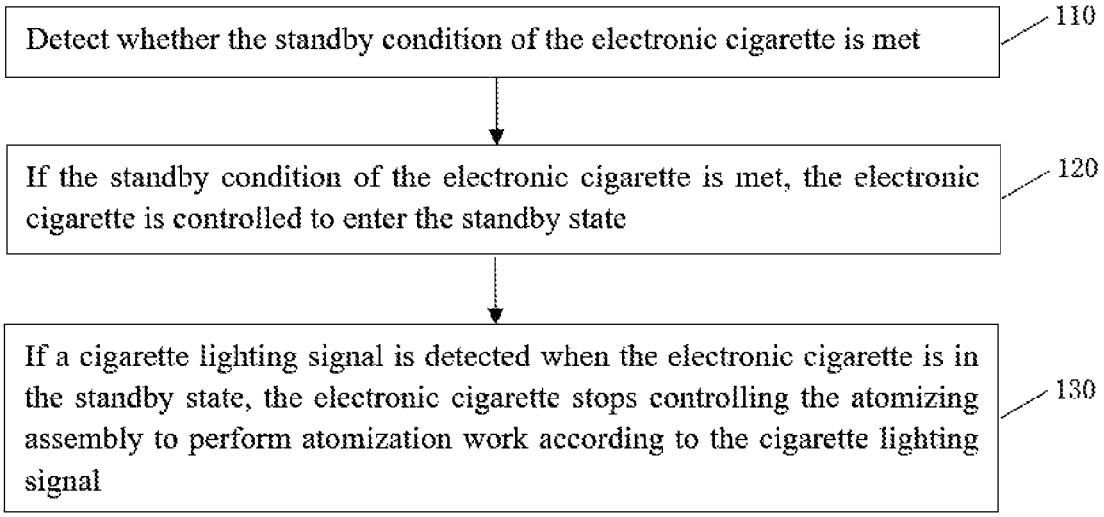
FIG. 29 is a flowchart of an electronic cigarette control method according to an embodiment of the present application.

Please refer to FIG. 29, it shows a flowchart of an electronic cigarette control method provided by an embodiment of the present application. As shown in FIG. 29, the control method of the electronic cigarette may include:

In step 110, detecting whether the standby condition of the electronic cigarette is met.

This step can be implemented in the following two ways:

The first method is to determine whether the electronic cigarette is operated; if the electronic cigarette has not been operated for a predetermined period of time, it is determined that the standby condition of the electronic cigarette is satisfied. The predetermined period of time can be set by the developer or customized by the user.

The specific implementation of determining whether the electronic cigarette is operated can be: obtaining the operated information of the electronic cigarette, the operated information includes cigarette lighting information and movement indication information; and determining whether the electronic cigarette is operated according to the operated information.

The cigarette lighting information is whether the electronic cigarette is lighted, that is, whether the atomizing assembly of the electronic cigarette is atomized. The movement indication information includes at least one of acceleration information of the electronic cigarette, liquid level information in the liquid storage cavity of the electronic cigarette, and flow information of e-liquid in the liquid storage cavity of the electronic cigarette;

Optionally, the specific implementation of determining whether the electronic cigarette is operated according to the cigarette lighting information can be: when the cigarette lighting signal is not detected, it is determined that the electronic cigarette has not been operated for smoking; or, when the atomization work is not performed according to the cigarette lighting signal, it is determined that the electronic cigarette is not operated for smoking; or, if the cigarette lighting signal and the suction signal are detected, it is determined that the electronic cigarette is operated for smoking, otherwise it is determined that the electronic cigarette is not operated for smoking.

The cigarette lighting signal involved in this application can be a signal generated when the cigarette lighting button on the electronic cigarette is operated. The cigarette lighting signal can also be the airflow signal detected by the sensor component in the electronic cigarette. The airway where the sensor component is located is in communication with the suction nozzle of the electronic cigarette, when the user sucks through the suction nozzle of the electronic cigarette, since the sensor component is arranged in the airway in communication with the suction nozzle, the sensor component can detect the change of the airflow in the airway, for example, air pressure change, airflow velocity change, etc. The sensor component can be a sensor such as an air pressure sensor, an airflow sensor, a pressure sensor, etc., for detecting airflow.

Optionally, when the cigarette lighting signal is not the airflow signal detected by the sensor component in the electronic cigarette, the suction signal can be the airflow signal detected by the sensor component in the electronic cigarette.

Optionally, the specific implementation of determining whether the electronic cigarette is operated according to the movement indication information can be: if the electronic cigarette is determined to be stationary according to the movement indication information, then it is determined that the electronic cigarette is not operated.

When the user holds the electronic cigarette to rotate or move the electronic cigarette, the electronic cigarette produces acceleration, the liquid level in the liquid storage cavity shakes, and the liquid in the liquid storage cavity flows. In this application, the electronic cigarette can obtain the movement indication information of the electronic cigarette; and according to the movement indication information, it is determined whether the electronic cigarette is stationary or shaking.

The determination of whether the electronic cigarette is stationary according to the movement indication information can be achieved in any of the following ways: 1. If the acceleration of the electronic cigarette is lower than or equal to a predetermined threshold, it is determined that the electronic cigarette is not operated; 2. If the change value of the liquid level in the liquid storage cavity is lower than or equal to a predetermined threshold, it is determined that the electronic cigarette has not been operated; 3. If the flow rate of the e-liquid in the liquid storage cavity is lower than or equal to a predetermined threshold, it is determined that the electronic cigarette is not operated. The predetermined threshold is usually set by the developer.

The liquid level detection in this application can be done by setting up a liquid level detector in the liquid storage cavity. The acceleration detection of the electronic cigarette can be detected by the gyroscope or other acceleration detection parts in the electronic cigarette. The flow velocity of the e-liquid in the liquid storage cavity can be detected by the flow velocity detection device in the liquid storage cavity. This application does not specifically limit the liquid height detection method, acceleration detection method, and e-liquid flow information detection method.

The second type is to detect whether a standby instruction is received; if a standby instruction is received, it is determined that the standby condition of the electronic cigarette is met. The standby instruction can be a standby instruction generated by operating the child lock button on the electronic cigarette, the standby instruction may also be a standby instruction generated when the electronic cigarette is being tapped, and the standby instruction may also be other, which will not be repeated in this embodiment.

Optionally, the specific implementation of detecting whether the standby instruction is received can be: acquiring the tap information of the electronic cigarette; and determining whether the standby instruction is received according to the tap information. Optionally, a 3D sensor can be provided in the electronic cigarette, and the data detected by the 3D sensor can be used to determine whether the electronic cigarette is tapped in order to obtain the tap information. When the tap information of the electronic cigarette indicates that the electronic cigarette has been tapped continuously for a second predetermined number of times, it is determined that the tap instruction is received. The second predetermined number of times can be set by the developer or customized by the user.

In step 120, if the standby condition of the electronic cigarette is met, the electronic cigarette is controlled to enter the standby state.

In step 130, if a cigarette lighting signal is detected when the electronic cigarette is in a standby state, the electronic cigarette stops controlling the atomizing assembly to perform atomization work according to the cigarette lighting signal.

By controlling the electronic cigarette to enter the standby state, the electronic cigarette in the standby state stops controlling the atomizing assembly to perform atomization work according to the cigarette lighting signal, to temporarily turn off the cigarette lighting function of the electronic cigarette.

For example, after the user smokes with the electronic cigarette, when the electronic cigarette is left stationary for a predetermined period of 1 minute, the electronic cigarette is controlled to enter the standby state, and the electronic cigarette stops atomizing according to the cigarette lighting signal. At this time, if a child picks up the electronic cigarette and accidentally touches the cigarette button, the electronic cigarette will not perform atomization work according to the cigarette lighting signal, so as to prevent the atomized smoke from being ingested by the child by mistake.

In summary, the method provided by the embodiment of the present application detects whether the standby condition of the electronic cigarette is met. If the standby condition of the electronic cigarette is met, the electronic cigarette is controlled to enter the standby state. If a cigarette lighting signal is detected when the electronic cigarette is in the standby state, the electronic cigarette stops controlling the atomizing assembly to perform atomization work according to the cigarette lighting signal. It solves the problem that a child picks up the electronic cigarette by mistake and touches the smoke button in the related technology, and the smoke is inhaled by the child and harms the physical and mental health of the child, so that the effect of increasing the child protection function of the electronic cigarette is achieved.

After the electronic cigarette enters the standby state, the user of the electronic cigarette can generate an atomization wake-up signal by operating the electronic cigarette to again activate the atomization function of the electronic cigarette. The specific realization can be as follows: when the electronic cigarette is in the standby state, if the atomization wake-up signal is detected, the electronic cigarette is controlled to enter the working state; when the electronic cigarette is in the working state, if a cigarette lighting signal is detected, the atomizing assembly is controlled to perform atomization work according to the cigarette lighting signal.

In an example, the user of the electronic cigarette can trigger the electronic cigarette to enter the working state by disassembling a predetermined component from the electronic cigarette and then reinstalling it, so as to trigger the electronic cigarette to enter the working state. The specific implementation can be as follows: after detecting that the predetermined component in the electronic cigarette is disassembled, if it is detected that the predetermined component is installed on the main body of the electronic cigarette again, then it is determined that the atomization wake-up signal is detected, wherein the predetermined component is the atomizer or the cartridge.

In an example, a probe or a button is provided on a mounting base, and the predetermined component abuts the probe or presses the button when the predetermined component is installed on the mounting base. When the electronic cigarette detects the operation signal generated when the probe is resisted or the button is pressed, it is determined that the predetermined component is installed on the main body of the electronic cigarette.

In another example, a heating member is provided in the predetermined component, when the predetermined component is installed on the mounting base, the heating member is connected to a load connection circuit in the main body of the electronic cigarette; when the electronic cigarette detects that a load is connected to the load connection circuit, it is determined that the predetermined component is installed on the main body of the electronic cigarette.

In another example, a magnetic member is provided in the predetermined component, the mounting base is provided with a Hall switch. When the predetermined component is installed on the mounting base, the Hall switch detects the magnetic member. The electronic cigarette detects whether the predetermined component is installed on the mounting base through the Hall switch. In actual implementation, the magnetic member can be a magnetic ring or a circular magnetic sheet arranged on the bottom portion or bottom end of the cartridge.

Optionally, a receiving cavity for the predetermined component is provided in the main body of the electronic cigarette, a mounting base for the predetermined component is arranged in the receiving cavity. The user of the electronic cigarette can install the predetermined component on the main body of the electronic cigarette by inserting the predetermined component into the receiving cavity. The electronic cigarette can also separate the predetermined component from the main body of the electronic cigarette by pulling the predetermined component out of the receiving cavity. In this embodiment, the user of the electronic cigarette can trigger the electronic cigarette to enter the working state by pulling the predetermined component out of the receiving cavity and then inserting it again.

In another embodiment, the user of the electronic cigarette can trigger the electronic cigarette to enter the standby state by pulling the predetermined component out of the receiving cavity, and then inserting the predetermined component into the receiving cavity to trigger the electronic cigarette to enter the working state. The specific implementation can be: when it is detected that the predetermined component is separated from the main body of the electronic cigarette, it is determined that a standby instruction is received, and the electronic cigarette is controlled to enter the standby state according to the standby instruction; when it is detected that the predetermined component is installed on the main body of the electronic cigarette, it is determined that the atomization wake-up signal is detected, and the electronic cigarette is controlled to enter the working state according to the atomization wake-up signal.

In another example, when the electronic cigarette meets the standby condition, the electronic cigarette is controlled to enter the standby state, and the predetermined component in the electronic cigarette is controlled to be separated from the main body of the electronic cigarette, wherein the predetermined component is the atomizer or the cartridge. In this manner, the user of the electronic cigarette can then install the predetermined component to the main body of the electronic cigarette, for example, by inserting the predetermined component into the corresponding receiving cavity so as to be mounted on the mounting base; when the electronic cigarette detects that the predetermined component is installed to the main body of the electronic cigarette, the electronic cigarette is controlled to enter the working state; and if the cigarette lighting signal is detected, the atomizing assembly is controlled to perform atomization work.

Taking the cartridge as an example, the main body of the electronic cigarette is provided with a receiving cavity for the cartridge, and a mounting base for the cartridge is provided in the receiving cavity. The mounting base can be provided with a pushing member, and when the electronic cigarette meets the standby condition, the pushing member is driven to push the cartridge so that the cartridge is separated from the mounting base.

In another example, when the electronic cigarette meets the standby condition, the electronic cigarette is controlled to enter the standby state, and the predetermined component in the electronic cigarette is controlled to rotate around a central axis of the predetermined component, so that a first element in the predetermined component is separated or far away from a second element of the main body of the electronic cigarette, wherein the predetermined component is the atomizer or the cartridge, and the electronic cigarette does not have the atomization ability when the first element is separated from or far away from the second element. In this manner, the user of the electronic cigarette can then operate the predetermined component to rotate and reset around the central axis of the predetermined component. When the electronic cigarette detects the resetting of the predetermined component, it is determined that the atomization wake-up signal is detected.

In another example, the user of the electronic cigarette can reset the predetermined component by rotating it, in order to trigger the electronic cigarette to enter the working state. The specific implementation can be: after the electronic cigarette detects that the first element is separated or far away from the second element on the main body of the electronic cigarette, if it is detected that the predetermined component rotates to a predetermined position (that is, resetting), it is determined that the atomization wake-up signal is detected, wherein when the predetermined component rotates to the predetermined position, the electronic cigarette has the atomization ability.

Optionally, the user of the electronic cigarette can trigger the electronic cigarette to enter the working state by rotating the predetermined component. The specific implementation can be: when the electronic cigarette is in the standby state, it is detected whether the predetermined component in the electronic cigarette is rotated, wherein the predetermined component is the atomizer or the cartridge; if it is detected that the predetermined component is rotated to the predetermined position, it is determined that the atomization wake-up signal is detected. Optionally, when the electronic cigarette detects that the first element is separated or far away from the second element on the main body of the electronic cigarette, it is determined the standby instruction is received and the standby state is entered, so that the user can trigger the electronic cigarette to enter the standby state by rotating the predetermined component.

Optionally, the first element and the second element in the electronic cigarette can be set in the following ways:

In the first type, the first element is an electrode on the cartridge, and the second element is an electrode on the main body of the electronic cigarette; when the first element and the second element are connected, the battery in the main body of the electronic cigarette can supply power to the atomizing assembly (for example, the heating member) in the predetermined component through the first element and the second element to perform the atomization work. When the electronic cigarette meets the standby condition, the predetermined component can be controlled to rotate around the central axis of the predetermined component; the electrode on the predetermined component is separated from the electrode on the main body of the electronic cigarette, so that the electronic cigarette stops atomizing according to the cigarette lighting signal when the cigarette lighting signal is detected.

In the second type, the first element is a liquid storage cavity in the predetermined component, a heating member and a liquid guide member are provided on the main body of the electronic cigarette, and the liquid guide member is the second element; two ends of the liquid guide member can extend into the liquid storage cavity. When the two ends of the liquid guide the extend into the liquid storage cavity, the liquid guide the can absorb the liquid in the liquid storage cavity. When the electronic cigarette controls the heating member to generate heat according to the cigarette lighting signal, the e-liquid on the liquid guide member can be atomized; when the electronic cigarette meets the standby condition, the predetermined component can be controlled to rotate around the central axis of the predetermined component, the liquid guide member is separated from the liquid storage cavity, and the liquid guide member is stopped to continue to absorb the e-liquid, so that the electronic cigarette stops atomizing according to the cigarette lighting signal when the cigarette lighting signal is detected.

In the third type, the first element is a liquid suction member in the predetermined component, the liquid suction member is configured to absorb e-liquid in the liquid storage cavity of the predetermined component, and the second element is a heating member. When the liquid suction member and the heating member are approaching, the liquid suction member absorbs the e-liquid in the liquid storage cavity, and the heating member heats and atomizes the e-liquid on the liquid suction member. When the electronic cigarette meets the standby condition, the predetermined component can be controlled to rotate around the central axis of the predetermined component to keep the liquid suction member away from the heating member, so as to avoid atomizing the e-liquid on the liquid suction member when the heating member is heated, so that the electronic cigarette stops the atomization work according to the cigarette lighting signal when the cigarette lighting signal is detected.

Optionally, a magnetic member can be provided on the predetermined component, and a Hall switch can be provided on the mounting base. The user of the electronic cigarette can keep the magnetic member at a preset distance or away from the Hall switch by rotating the predetermined component. The Hall switch can detect the magnetic member when the predetermined component is rotated to reset, and the Hall switch cannot detect the magnetic member when the predetermined component leaves the reset position. The electronic cigarette detects whether the predetermined component is rotated to reset through the Hall switch. In actual implementation, it is also possible to determine whether the predetermined component is rotated to reset by other means, which will not be repeated in this embodiment.

It should be noted that in this application, the predetermined component in the electronic cigarette is controlled to rotate around the central axis of the predetermined component, so that the first element in the predetermined component is separated or away from the second element on the main body of the electronic cigarette. In actual implementation, the first element and the second element can also be separated by other means. For example, the first element is driven to move to change its position, and the second element is driven to move to change its position. This embodiment will not be repeated herein.

When the electronic cigarette is in the standby state, the user of the electronic cigarette can also activate the atomization function of the electronic cigarette through any of the following wake-up methods:

In the first type, the user of the electronic cigarette taps the electronic cigarette to activate the atomization function of the electronic cigarette. The specific implementation can be as follows: the movement indication information of the electronic cigarette is acquired when the electronic cigarette is in the standby state, the movement indication information includes at least one of acceleration information of the electronic cigarette, liquid level information in the liquid storage cavity of the electronic cigarette, and flow information of e-liquid in the liquid storage cavity of the electronic cigarette; the tap information of the electronic cigarette is determined according to the movement indication information; and if the tap information reaches a first wake-up condition, it is determined that the atomization wake-up signal is detected.

The first wake-up condition can be set by the developer or customized by the user. For example, the first wake-up condition can be that the number of times the electronic cigarette is tapped reaches the first predetermined number of times, the first predetermined number of times can be set by the developer or customized by the user, and this embodiment does not specifically limit the first wake-up condition.

In actual implementation, a 3D sensor can be provided in the electronic cigarette, and the data detected by the 3D sensor can be configured to determine whether the electronic cigarette is in a static state or has been tapped. For example, when the electronic cigarette is tapped, the electronic cigarette will shake. It can detect whether the electronic cigarette shakes according to the information detected by the 3D sensor, and if it occurs shaking, it is determined that the electronic cigarette has been tapped.

In the second type, the user of the electronic cigarette operates the activation button on the electronic cigarette to start the atomization function of the electronic cigarette. The specific implementation can be as follows: the operation information generated by operating the activation button is acquired when the electronic cigarette is in the standby state; when the operation information reaches a second wake-up condition, it is determined that the atomization wake-up signal is detected.

The second wake-up condition can be set by the system developer or customized by the user. For example, the second wake-up condition can be that the activation button is continuously pressed multiple times, or the second wake-up condition can be that the activation button is long pressed for a preset first duration. This embodiment does not specifically limit the second wake-up condition.

In the third type, the user of the electronic cigarette inputs a fingerprint at the fingerprint input device of the electronic cigarette to activate the atomization function of the electronic cigarette. The specific implementation can be as follows: obtaining the fingerprint collected by the fingerprint input device when the electronic cigarette is in the standby state; the collected fingerprint is compared with a preset fingerprint. When the collected fingerprint matches with the preset fingerprint, it is determined that the atomization wake-up signal is received, and the atomizing assembly is controlled to atomize according to the cigarette lighting signal.

In the fourth type, a face recognition device is installed on the electronic cigarette, and the user of the electronic cigarette performs face recognition on the electronic cigarette to activate the atomization function of the electronic cigarette.

In an example, the specific implementation can be: using a face recognition device to collect a face image when the electronic cigarette is in the standby state; when the face image matches with a preset face image, it is determined that the atomization wake-up signal is received, and the atomizing assembly is controlled to atomize according to the cigarette lighting signal.

In another example, when the electronic cigarette is in the standby state, the face recognition device is configured to collect the face image; determining whether it is a child user according to the facial features in the face image; if it is determined that it is not a child user, it is determined that the atomization wake-up signal is received, and the atomizing assembly is controlled to atomize according to the cigarette lighting signal.

In another example, when the electronic cigarette is in the standby state, the face recognition device is configured to collect the face image; identifying the facial features in the face image to determine the age of the user; if the user's age is higher than or equal to a preset age, it is determined that the atomization wake-up signal is received, and the atomizing assembly is controlled to perform atomization work according to the cigarette lighting signal. The preset age can be set by the developer or customized by the user. For example, the preset age can be 18 years old.

In the fifth type, the user of the electronic cigarette presses a pressure button or a pressure sensor to activate the atomization function of the electronic cigarette. The specific implementation can be as follows: obtaining the pressure value detected by the pressure button or pressure sensor when the electronic cigarette is in the standby state; when the detected pressure value reaches a preset pressure value, it is determined that the atomization wake-up signal is received, and the atomizing assembly is controlled to perform atomization work according to the cigarette lighting signal. The preset pressure value can be set by the developer or customized by the user. For example, the developer can set the preset pressure value higher than the maximum output force of the child.

In the sixth type, the user of the electronic cigarette speaks a preset voice command used for waking up the electronic cigarette so as to activate the atomization function of the electronic cigarette. The specific implementation can be as follows: starting the voice collection device when the electronic cigarette is in the standby state; obtaining the voice information collected by the voice collection device; if the voice information contains a preset voice command, it is determined that the atomization wake-up signal is received, and the atomizing assembly is controlled to perform the atomization work according to the cigarette lighting signal. The preset voice command can be set by the developer or customized by the user. For example, the developer can set the voice command to be any one of power-on, atomization, start-up, etc., which is not specifically limited in this embodiment.

In the seventh type, when the user of the electronic cigarette brings a terminal device bound to the electronic cigarette close to the electronic cigarette, the atomization function of the electronic cigarette is activated. The specific implementation can be as follows: when the electronic cigarette is in the standby state, the electronic cigarette uses the wireless communication technology to search for the terminal device in a predetermined range (the communication range supported by the wireless communication technology); if it is detected that the terminal device bound to the electronic cigarette or the terminal device bound to the electronic cigarette establishes a wireless connection, it is determined that the atomization wake-up signal is received, and the atomizing assembly is controlled to perform the atomization work according to the cigarette lighting signal. Or, the terminal device bound to the electronic cigarette sends an atomization wake-up signal to the electronic cigarette through wireless communication technology or wired communication technology. When the electronic cigarette receives the atomization wake-up signal, the atomizing assembly is controlled to perform atomization work according to the cigarette lighting signal.

The wireless communication technology may include any of Bluetooth, NFC (Near Field Communication), infrared and other wireless technologies. Wired communication can be realized after connecting via USB data cable.

In the eighth type, an iris recognition device is installed on the electronic cigarette, and the user of the electronic cigarette performs iris recognition on the electronic cigarette to activate the atomization function of the electronic cigarette. The specific implementation can be: when the electronic cigarette is in the standby state, the iris recognition device is configured to collect the iris image; when the iris image matches with a preset iris image, it is determined that the atomization wake-up signal is received, and the atomizing assembly is controlled to perform the atomization work according to the cigarette lighting signal.

In the ninth type, the user of the electronic cigarette can start the atomization function of electronic cigarette by entering the activation password. The specific implementation can be: getting the password entered by the user; if the password entered by the user is consistent with a preset activation password, it is determined that the atomization wake-up signal is received, and the atomizing assembly is controlled to perform atomization work according to the cigarette lighting signal.

In the tenth type, the user of the electronic cigarette can activate the atomization function of electronic cigarette by inputting an unlocking gesture. The specific implementation can be as follows: obtaining the unlocking gesture inputted by the user; if the unlocking gesture inputted by the user is consistent with a preset unlocking gesture, it is determined that the atomization wake-up signal is received, and the atomizing assembly is controlled to perform the atomization work according to the cigarette lighting signal.

In the eleventh type, the user of the electronic cigarette can start the atomization function of electronic cigarettes by shaking, and the specific implementation can be: obtaining shaking indication information of the electronic cigarette, where the shaking indication information includes at least one of acceleration information of the electronic cigarette, liquid level information in the liquid storage cavity of the electronic cigarette, and flow information of e-liquid in the liquid storage cavity of the electronic cigarette; determining the shaking frequency of the electronic cigarette according to the shaking indication information; if the shaking frequency of the electronic cigarette reaches a preset frequency threshold, it is determined that the atomization wake-up signal is received, and the atomizing assembly is controlled to perform atomization work according to the cigarette lighting signal.

In the twelfth type, the user of the electronic cigarette can use external devices (for example, USB) to start the atomization function of the electronic cigarette. The specific implementation can be as follows: if the electronic cigarette is not operated for a predetermined period of time, and it is detected that it is connected to an external device, it is determined that the atomization wake-up signal is received, and the atomizing assembly is controlled to perform atomization work according to the cigarette lighting signal.

In the thirteenth type, the user of the electronic cigarette can suck with force to activate the atomization function of the electronic cigarette. The specific implementation can be as follows: an independent airway is provided in the electronic cigarette, and the independent airway is connected to the suction nozzle of the electronic cigarette but isolated from the atomizing cavity in the electronic cigarette. An air pressure detection device is arranged in the independent airway, and when the air pressure value detected by the air pressure detection device reaches a preset air pressure threshold, it is determined that the atomization wake-up signal is received, and the atomizing assembly is controlled to perform atomization work according to the cigarette lighting signal.

The preset air pressure threshold can be set by the developer or can be customized by the user. The preset air pressure threshold can be an air pressure value that is difficult to reach in the independent airway when a child sucks.

In the fourteenth type, after the atomization function of the electronic cigarette is turned off, the electronic cigarette can periodically restart the atomization function of the electronic cigarette. The specific implementation can be as follows: when the electronic cigarette is not operated for a predetermined period of time, it starts timing; when the timing period reaches a preset restart period, it is determined that the atomization wake-up signal is received, and the atomizing assembly is controlled to perform atomization work according to the cigarette lighting signal.

Optionally, if the electronic cigarette is not detected to be operated within a preset second time period after the atomization function of the electronic cigarette is activated, the atomizing assembly of the electronic cigarette is controlled to stop atomization work according to the cigarette lighting signal; and when the atomization function is turned off for the preset restart duration, it is determined that the atomization wake-up signal is received, and the atomizing assembly is controlled to perform atomization work according to the cigarette lighting signal.

In the fifteenth type, the electronic cigarette recognizes the user's body shape information, and the body shape information includes at least one of height, weight, etc.; determining whether the user is a child user according to the body shape information; if the user is not a child user, it is determined that the atomization wake-up signal is received, and the atomizing assembly is controlled to perform atomization work according to the cigarette lighting signal.

In the sixteenth type, the user of the electronic cigarette reinstalls the predetermined component as previously detached from the electronic cigarette to activate the atomization function of the electronic cigarette. The specific implementation can be as follows: when it is detected that the electronic cigarette is switched from the state in which the predetermined component is not installed to the state in which the predetermined component is installed, it is determined that the atomization wake-up signal is received, and the atomizing assembly is controlled to perform atomization work according to the cigarette lighting signal.

The realization of detecting that the electronic cigarette is switched from a state in which the predetermined component is not installed to a state in which the predetermined component is installed can refer to the implementation of detecting that the predetermined component is installed on the main body of the electronic cigarette as described above, which will not be repeated here.

Optionally, when the atomization wake-up signal is detected, a prompt information for the atomization wake-up is displayed, and the prompt information can be prompted by any of text, voice, sound, indicator, and the like.

Optionally, if the electronic cigarette meets the standby condition, the electronic cigarette is controlled to enter the standby state, and a lock installed on the electronic cigarette is controlled to be locked; after that, the user can open the lock with a key to start the atomization function of the electronic cigarette. Correspondingly, when the electronic cigarette detects that the lock is opened, the atomizing assembly is controlled to perform atomization work when the cigarette lighting signal is detected.

In actual implementation, the user of the electronic cigarette can use the key to lock the lock on the electronic cigarette to trigger the electronic cigarette to enter the standby state. The specific implementation can be as follows: when detecting that the lock is locked, the electronic cigarette determines that a standby instruction is received and enters a standby state according to the standby instruction.

Optionally, if the electronic cigarette meets the standby condition, the electronic cigarette is controlled to enter the standby state, and a knob is controlled to rotate by a predetermined angle in a first direction from the initial position; and the user can rotate the knob by the predetermined angle in a second direction to activate the atomization function of the electronic cigarette. Correspondingly, when the electronic cigarette detects that the knob is rotated to the initial position, it is determined that the atomization wake-up signal is detected.

When the first direction is clockwise, the second direction is counterclockwise; and when the first direction is counterclockwise, the second direction is clockwise. The predetermined angle is usually set by the developer. The electronic cigarette displays indication information on the knob to instruct the user to rotate the knob in the second direction, such as an arrow.

In actual implementation, the user of the electronic cigarette can rotate the knob by the predetermined angle in the first direction from the initial position to a preset position to trigger the electronic cigarette to enter the standby state. The specific implementation can be: when detecting that the knob is rotated to the preset position, the electronic cigarette determines to receive a standby instruction, and enters a standby state according to the standby instruction.

Optionally, when the electronic cigarette is in the working state, the user of the electronic cigarette can also trigger the electronic cigarette to enter the standby state through any of the following operation methods:

In the first type, the user of the electronic cigarette operates the child lock button on the electronic cigarette to trigger the electronic cigarette to enter the standby state. The specific implementation can be: the operation information generated if the child lock button is operated when the electronic cigarette is in the working state; when the operation information reaches the standby condition, it is determined that the atomization wake-up signal is detected.

The standby condition can be set by the system developer or customized by the user. For example, the standby condition can be that the child lock button is continuously pressed multiple times, or the standby condition can be that the child lock button is long pressed for the preset third time period, this embodiment does not specifically limit the standby condition.

In the second type, the user of the electronic cigarette inputs a fingerprint at the fingerprint input device of the electronic cigarette, to trigger the electronic cigarette to enter the working state. The specific implementation can be: acquiring the fingerprint collected by the fingerprint input device when the electronic cigarette is in the standby state; the collected fingerprint is compared with a preset fingerprint, and when the collected fingerprint matches with the preset fingerprint, it is determined that the standby instruction is received.

In the third type, a face recognition device is installed on the electronic cigarette, and the face recognition device is used to collect a face image; according to the facial features in the face image, it is determined whether it is a child user; if it is determined to be a child user, it is determined that the standby instruction is received.

In the fourth type, when the electronic cigarette is in the standby state, the face recognition device is configured to collect the face image; the facial features in the face image are recognized to determine the user's age; if the user's age is lower than the preset age, it is determined that the standby instruction is received. The preset age can be set by the developer or customized by the user. For example, the preset age can be 18 years old.

In the fifth type, the user of the electronic cigarette presses the pressure button or pressure sensor to trigger the electronic cigarette to enter the standby state. The specific implementation can be: obtaining the pressure value detected by the pressure button or pressure sensor when the electronic cigarette is in the standby state; when the detected pressure value reaches a preset pressure value, it is determined that the standby instruction is received. The preset pressure value can be set by the developer or customized by the user.

In the sixth type, the user of the electronic cigarette speaks a preset voice command for instructing the electronic cigarette to stand by to trigger the electronic cigarette to enter the standby state. The specific implementation can be: starting the voice collection device when the electronic cigarette is in the standby state; acquiring the voice information collected by the voice collection device; if the voice information contains a preset voice instruction, it is determined that the standby instruction is received. The preset voice command can be set by the developer or customized by the user. For example, the developer can set the voice command to be any of standby, sleeping, shutdown, etc., which is not specifically limited in this embodiment.

In the seventh type, when the electronic cigarette and the bound terminal device exceed a preset distance, the electronic cigarette determines to receive the standby instruction. The preset distance can be set by the system developer, or can be customized by the user, which is not specifically limited in this embodiment.

In the eighth type, an iris recognition device is provided on the electronic cigarette, and the user of the electronic cigarette performs iris recognition on the electronic cigarette to trigger the electronic cigarette to enter the standby state. The specific implementation can be: when the electronic cigarette is in the standby state, the iris recognition device is configured to collect the iris image; when the iris image matches with a preset iris image, it is determined that the standby instruction is received.

In the ninth type, the user of the electronic cigarette can trigger the electronic cigarette to enter the standby state by entering the shutdown password. The specific implementation can be: getting the password entered by the user; if the password entered by the user is consistent with a preset shutdown password, it is determined that the standby instruction is received.

In the tenth type, the user of the electronic cigarette can trigger the electronic cigarette to enter the standby state by inputting standby gestures. The specific implementation can be: obtaining the standby gesture inputted by the user; if the standby gesture inputted by the user is consistent with a preset standby gesture, it is determined that the standby instruction is received.

In the eleventh type, the user of the electronic cigarette can trigger the electronic cigarette to enter the standby state by shaking. The specific implementation can be: obtaining the shaking indication information of the electronic cigarette, the shaking indication information includes at least one of acceleration information of the electronic cigarette, liquid level information in the liquid storage cavity of the electronic cigarette, and flow information of the e-liquid in the liquid storage cavity of the electronic cigarette; determining the shaking frequency of the electronic cigarette according to the shaking indication information; if the shaking frequency of the electronic cigarette reaches a preset frequency threshold, it is determined that the standby instruction is received.

In the twelfth type, the user of the electronic cigarette can use an external device to trigger the electronic cigarette to enter the standby state, the specific implementation can be: if it is detected that the electronic cigarette is connected to the external device, it is determined that the standby instruction is received. Or, when the electronic cigarette establishes a connection with the external device in a wired or wireless manner, the user sends a standby instruction to enter the standby state to the electronic cigarette through the external device, and the electronic cigarette enters the standby state after receiving the standby instruction.

In the thirteenth type, the user of the electronic cigarette can suck with force to trigger the electronic cigarette to enter the standby state. The specific implementation can be as follows: an independent airway is provided in the electronic cigarette, and the independent airway is connected with the suction nozzle of the electronic cigarette but is isolated from the atomizing cavity in the electronic cigarette; an air pressure detection device is arranged in the independent airway, and when the air pressure value detected by the air pressure detection device reaches a preset air pressure threshold, it is determined that a standby instruction is received.

The preset air pressure threshold can be set by the developer or customized by the user.

In the fourteenth type, the electronic cigarette recognizes the user's body shape information, the body shape information includes at least one of height, weight, etc.; determining whether the user is a child user according to the body shape information; if the user is a child user, it is determined that the standby instruction is received.

In the fifteenth type, the user of the electronic cigarette removes the predetermined component from the electronic cigarette to trigger the electronic cigarette to enter the standby state. The specific implementation can be: when it is detected that the electronic cigarette is switched from the state in which the predetermined component is installed to the state in which the predetermined component is not installed, it is determined that the standby instruction is received.

It should be noted that in actual implementation, the electronic cigarette can support at least one wake-up mode described in this application, and can also support at least one standby operation mode described in this application. The wake-up mode and the standby operation mode supported by the same electronic cigarette can be the same or different.

An embodiment of the present application also provides a computer-readable storage medium, one or more instructions are stored in the computer-readable storage medium; when the one or more instructions are executed by the processor in the electronic cigarette, the method for controlling the electronic cigarette described in any of the foregoing embodiments is implemented.

An embodiment of the present application also provides a control device for the electronic cigarette, the control device includes a memory and a processor; at least one program instruction is stored in the memory; the processor loads and executes the at least one program instruction to implement the method for controlling the electronic cigarette described in any of the foregoing embodiments.

The terms "first" and "second" are only used for descriptive purposes, and cannot be understood as indicating or implying relative importance or implicitly indicating the number of technical features. Therefore, the defined "first" and "second" features may explicitly or implicitly comprise one or more of these features. In the description of the present application, unless otherwise specified, "plurality" means two or more.

Those of ordinary skill in the art can understand that all or part of the steps in the foregoing embodiments can be implemented by hardware, or by a program instructing relevant hardware to be completed. The program can be stored in a computer-readable storage medium. The storage medium mentioned can be a read-only memory, a magnetic disk or an optical disk, etc.

Taking the above-mentioned ideal embodiment according to the present application as enlightenment, through the above description, the relevant staff can make various changes and modifications without departing from the scope of the present application. The technical scope of the present application is not limited to the content of the specification, and its technical scope must be determined according to the scope of the claims.

What is claimed is:

1. A cartridge for an electronic cigarette, wherein the cartridge comprises a liquid storage cavity, an atomizing cavity, a liquid suction member, a liquid outlet, a smoke outlet and an air inlet opening, the liquid outlet is in communication with the liquid storage cavity, the liquid suction member, the smoke outlet and the air inlet opening are all in communication with the atomizing cavity, the liquid suction member is arranged between the liquid outlet and the atomizing cavity; before the cartridge is used, the liquid outlet is in a closed state, such that e-liquid in the liquid storage cavity is isolated from the liquid suction member; when the cartridge is used, the liquid outlet is in an open state, such that the e-liquid in the in the liquid storage cavity flows out through the liquid outlet and is absorbed by the liquid suction member; wherein the cartridge further comprises a cartridge casing and a sealing member, the liquid storage cavity and the liquid outlet are provided in the cartridge casing, the sealing member penetrates into the liquid storage cavity from outside of the cartridge and seals the liquid outlet; when the sealing member is pulled in a direction away from the liquid storage cavity, the sealing member is separated from the liquid outlet, the liquid outlet is opened, and the liquid storage cavity supplies the e-liquid to the liquid suction member.

2. The cartridge according to claim 1, wherein one end of the cartridge casing away from the liquid outlet is sealed by a sealing pad, the sealing pad is provided with a through hole, the sealing member comprises an operating portion and a sealing portion, the sealing portion comprises a first sealing portion and a second sealing portion connected to each other, one end of the operating portion extends to the outside of the cartridge, another end of the operating portion extends into the liquid storage cavity and is connected to the first sealing portion, a connecting position between the first sealing portion and the operating portion has a transverse cutout, the second sealing portion is configured to seal the liquid outlet; when the operating portion is pulled in a direction away from the liquid storage cavity, the second sealing portion is separated from the liquid outlet and the liquid outlet is opened; when the operating portion is continued to be pulled in a direction away from the liquid storage cavity until the second sealing portion abuts against the sealing pad, the first sealing portion is inserted into the through hole to seal the through hole, the operating portion and the first sealing portion are disconnected from each other from the transverse cutout.

3. The cartridge according to claim 2, wherein when pulling the sealing member, the sealing member is deformed under the pulling force, a gap is formed between the operating portion and an inner wall of the through hole, external air enters into the liquid storage cavity through the gap; an outer wall of the first sealing portion is provided with a sealing strip protruding outward along a radial direction of the first sealing portion, the sealing strip seals the through hole when the first sealing portion is inserted into the through hole.

4. The cartridge according to claim 1, wherein the cartridge further comprises a bottom base, a lower end of the cartridge casing extends downward along an axial direction of the cartridge casing to form a receiving portion, the bottom base is located in the receiving portion, a bottom base sealing member is provided between the bottom base and the cartridge casing, the bottom base sealing member is sleeved on the outside of an upper end of the bottom base, the liquid suction member is installed on the bottom base sealing member, the atomizing cavity and the air inlet opening are provided in the bottom base.

5. The cartridge according to claim 4, wherein a mounting portion protrudes downward from a lower surface of the bottom base sealing member, the mounting portion has a lower opening, the liquid suction member passes through the lower opening of the mounting portion and is received in the mounting portion, an upper end of the mounting portion is provided with a liquid passage hole in communicating with the liquid suction member, the liquid passage hole is also in communication with the liquid outlet when the liquid outlet is opened.

6. An electronic cigarette comprising the cartridge according to claim 1.

7. The electronic cigarette according to claim 6, wherein the electronic cigarette further comprises a battery device cooperating with the cartridge, the cartridge is detachably connected to the battery device, a heating member is provided on the battery device; when the cartridge is connected to the battery device, the heating member extends into the atomizing cavity and is in contact with the liquid suction member or maintains a preset distance from the liquid suction member.

8. The electronic cigarette according to claim 7, wherein the atomizing cavity has an opening, the size of the heating member matches the size of the opening; when the cartridge is used, the heating member extends into the atomizing cavity through the opening, the heating member is electrically driven to heat the e-liquid absorbed by the liquid suction member to form smoke, external air flows into the atomizing cavity through the air inlet opening under the action of suction and is mixed with the smoke and flows out through the smoke outlet.

* * * * *